US011891208B2

(12) United States Patent
Ross et al.

(10) Patent No.: US 11,891,208 B2
(45) Date of Patent: Feb. 6, 2024

(54) APPARATUS TO SEAL A METALLIC CONTAINER

(71) Applicant: BALL CORPORATION, Westminster, CO (US)

(72) Inventors: John R. Ross, Westminster, CO (US); Anthony J. Scott, Westminster, CO (US); Howard C. Chasteen, Newport Richie, FL (US); Linda A. Hines, Westminster, CO (US)

(73) Assignee: BALL CORPORATION, Westminster, CO (US)

( * ) Notice: Subject to any disclaimer, the term of this patent is extended or adjusted under 35 U.S.C. 154(b) by 116 days.

(21) Appl. No.: 17/486,205

(22) Filed: Sep. 27, 2021

(65) Prior Publication Data

US 2022/0009668 A1 Jan. 13, 2022

Related U.S. Application Data

(62) Division of application No. 16/052,236, filed on Aug. 1, 2018, now Pat. No. 11,130,606, which is a division (Continued)

(51) Int. Cl.
*B65D 1/02* (2006.01)
*B21D 51/40* (2006.01)

(Continued)

(52) U.S. Cl.
CPC ..... *B65D 1/0246* (2013.01); *B21D 51/40* (2013.01); *B65B 7/2857* (2013.01); *B65D 39/08* (2013.01);

(Continued)

(58) Field of Classification Search
CPC ..... B65D 39/04; B65D 43/0229; B65D 2539/003; B65D 39/08; B65D 1/0246; B21H 3/02
See application file for complete search history.

(56) References Cited

U.S. PATENT DOCUMENTS 1,602,126 A 5/1923 Russell
2,026,304 A 12/1935 Florentine (Continued)

FOREIGN PATENT DOCUMENTS

CA 2665477 5/2008
DE 2644387 4/1978

(Continued)

OTHER PUBLICATIONS

Notice of Allowance for Canada Patent Application No. 2,938,867, dated Oct. 25, 2022, 1 page.

(Continued)

*Primary Examiner* — Ernesto A Grano
(74) *Attorney, Agent, or Firm* — Sheridan Ross P.C.

(57) ABSTRACT

The present invention relates generally to a container that may be sealed and reclosed with a threaded closure. More specifically, the present invention relates to methods of manufacturing a metallic container having an opening with inwardly facing threads that are formed after a threaded closure is inserted at least partially into the opening. The container opening may be selectively sealed and reclosed with the threaded closure which releasably engages the container threads.

20 Claims, 28 Drawing Sheets

Related U.S. Application Data of application No. 14/616,299, filed on Feb. 6, 2015, now Pat. No. 10,040,593.

(60) Provisional application No. 61/937,125, filed on Feb. 7, 2014.

(51) Int. Cl.

| | |
|---|---|
| ***B65D 39/08*** | (2006.01) |
| ***B65D 51/28*** | (2006.01) |
| ***B65B 7/28*** | (2006.01) |
| *B65D 39/04* | (2006.01) |
| *B21H 3/02* | (2006.01) |

(52) U.S. Cl.

CPC ..... *B65D 51/28* (2013.01); *B21H 3/02* (2013.01); *B65D 39/04* (2013.01); *B65D 2401/05* (2020.05); *B65D 2401/15* (2020.05); *B65D 2539/003* (2013.01); *B65D 2539/006* (2013.01)

(56) References Cited

U.S. PATENT DOCUMENTS 2,038,524 A 4/1936 Carvalho
2,117,407 A 1/1937 Davis
2,102,666 A * 12/1937 Annen ..... B65D 43/0229 229/5.5
2,207,564 A 7/1940 Wackman
2,337,456 A 12/1943 Draper
2,505,641 A * 4/1950 Howe ..... B65D 43/0229 220/296
2,559,658 A * 7/1951 Pottle ..... B65D 43/0229 220/296
2,661,862 A * 12/1953 Howe ..... B65D 43/0229 220/640
2,769,293 A 11/1956 Cox
3,142,280 A 7/1964 William
3,338,775 A * 8/1967 Down ..... B29C 66/542 156/582
3,452,897 A 7/1969 Anthony
3,550,832 A 12/1970 Fitzgerald
3,811,174 A 5/1974 Eichinger
3,812,646 A 5/1974 Baldyga et al.
3,817,420 A 6/1974 Heisler
3,979,015 A 9/1976 Arfert
4,007,851 A * 2/1977 Walker ..... B65D 41/348 215/307
4,054,229 A 10/1977 Arfert
4,189,824 A 2/1980 Dillon et al.
4,221,105 A 9/1980 Guest
4,333,584 A 6/1982 Gall
4,823,537 A 4/1989 Duke
4,880,131 A * 11/1989 Gallagher ..... B65D 43/0218 206/508
5,016,775 A 5/1991 Buedenbender
5,078,290 A 1/1992 Ochs
5,138,858 A 8/1992 Johnson et al.
5,207,341 A 5/1993 Yeager
5,240,138 A * 8/1993 Gallagher ..... B65D 43/0218 220/658
5,293,765 A 3/1994 Nussbaum-Pogacnik
5,704,240 A * 1/1998 Jordan ..... B21D 51/2615 72/106
5,718,352 A 2/1998 Diekhoff et al.
5,755,130 A 5/1998 Tung et al.
5,785,198 A 7/1998 Credle, Jr.
5,806,707 A 9/1998 Boehm et al.
5,822,843 A 10/1998 Diekhoff et al.
5,875,906 A * 3/1999 Price ..... B65D 55/0863 215/276
6,010,026 A 1/2000 Diekhoff et al.
6,010,028 A 1/2000 Jordan et al.
6,032,829 A * 3/2000 Geisinger ..... B65D 39/08 215/209
6,102,225 A 8/2000 Lynn
6,123,212 A * 9/2000 Russell ..... B65D 41/3423 215/44
6,206,222 B1 3/2001 Cudzik
6,301,766 B1 10/2001 Kollé
6,626,310 B2 9/2003 Taha
6,959,830 B1 11/2005 Kanou et al.
6,981,601 B2 * 1/2006 Laveault ..... B65D 41/485 215/354
7,147,123 B2 12/2006 Yamashita
7,171,840 B2 2/2007 Kanou et al.
7,555,927 B2 7/2009 Hanafusa et al.
7,798,357 B2 9/2010 Hanafusa et al.
7,824,750 B2 11/2010 Takegoshi et al.
7,905,130 B2 * 3/2011 Marshall ..... B21D 51/2615 72/452.1
7,942,028 B2 5/2011 Gillest et al.
8,016,148 B2 9/2011 Walsh
8,037,728 B2 10/2011 Hosoi
8,037,734 B2 10/2011 Hanafusa et al.
8,091,402 B2 * 1/2012 Hanafusa ..... B21D 51/38 72/379.4
8,132,439 B2 3/2012 Hanafusa et al.
8,356,722 B2 1/2013 Dubs et al.
8,360,266 B2 1/2013 Adams et al.
8,474,634 B1 7/2013 Branson et al.
8,496,131 B2 7/2013 Forrest et al.
8,505,350 B2 8/2013 Marshall et al.
8,613,369 B2 12/2013 Kitto
8,740,001 B2 6/2014 Hanafusa et al.
9,073,113 B2 7/2015 Nishimoto
9,227,748 B2 1/2016 Nakagawa et al.
9,265,287 B2 2/2016 Sims et al.
9,594,947 B1 3/2017 Kotagiri et al.
9,617,043 B2 4/2017 McGirr et al.
9,694,947 B2 * 7/2017 Olson ..... B65D 1/0207
9,821,926 B2 * 11/2017 Robinson ..... B21D 51/2638
10,040,593 B2 * 8/2018 Ross ..... B21D 51/40
10,518,940 B2 * 12/2019 Vanon ..... B65D 41/348
10,875,684 B2 * 12/2020 Ross ..... B65D 41/3428
11,130,606 B2 9/2021 Ross et al.
11,446,730 B2 * 9/2022 Ross ..... B21D 51/48
2005/0008458 A1 1/2005 Keech et al.
2005/0039416 A1 * 2/2005 Hidding ..... B65D 41/62 215/246
2005/0067365 A1 * 3/2005 Hanafusa ..... B65D 1/0246 215/43
2005/0115294 A1 6/2005 Kanou et al.
2007/0017089 A1 1/2007 Hosoi
2007/0062952 A1 * 3/2007 Kobayashi ..... B29C 57/02 220/288
2008/0011702 A1 * 1/2008 Walsh ..... B65D 1/0207 215/44
2008/0017642 A1 1/2008 King
2008/0047922 A1 * 2/2008 Olson ..... B65D 41/12 53/488
2010/0051576 A1 * 3/2010 Tran ..... B65D 51/185 215/386
2010/0065528 A1 3/2010 Hanafusa et al.
2010/0326946 A1 12/2010 Hanafusa et al.
2011/0164948 A1 7/2011 Marshall et al.
2012/0031913 A1 2/2012 Moore et al.
2012/0269602 A1 10/2012 Hanafusa et al.
2013/0199017 A1 8/2013 Kurosawa et al.
2014/0116979 A1 5/2014 Dunwoody
2014/0298641 A1 * 10/2014 Siles ..... B65D 1/0207 29/527.5
2015/0013416 A1 * 1/2015 Hosoi ..... B21D 51/38 72/68
2016/0340088 A1 11/2016 Olson et al.
2017/0073110 A1 3/2017 Campbell
2017/0267415 A1 9/2017 Olson et al.
2018/0044155 A1 2/2018 Ross et al.
2018/0134460 A1 5/2018 Ramsey
2019/0084728 A1 3/2019 Bonfoey et al.

(56) References Cited

U.S. PATENT DOCUMENTS

| | | | | |
|---|---|---|---|---|
| 2020/0156139 | A1 | 5/2020 | Ross et al. | |
| 2020/0165044 | A1* | 5/2020 | Shah | B65D 49/12 |
| 2020/0406337 | A1 | 12/2020 | Ross | |

FOREIGN PATENT DOCUMENTS

| | | |
|---|---|---|
| DE | 3505426 | 3/1986 |
| DE | 20201342 | 5/2002 |
| EP | 0740971 | 11/1996 |
| EP | 0806345 | 11/1997 |
| EP | 2662295 | 11/2013 |
| EP | 2662296 | 11/2013 |
| EP | 2692657 | 2/2014 |
| EP | 2835188 | 2/2015 |
| EP | 2955131 | 12/2015 |
| GB | 714973 | 9/1954 |
| HU | 229285 | 10/2013 |
| JP | S44-25510 | 10/1969 |
| JP | S51-28374 | 3/1976 |
| JP | S51-73557 | 6/1976 |
| JP | S52-99181 | 8/1977 |
| JP | S63-123606 | 5/1988 |
| JP | H02-180159 | 7/1990 |
| JP | 3025724 | 6/1996 |
| JP | 2002-137032 | 5/2002 |
| JP | 2002-302137 | 10/2002 |
| JP | 2003-205924 | 7/2003 |
| JP | 2004-210403 | 7/2004 |
| JP | 2005-96843 | 4/2005 |
| JP | 3665002 | 6/2005 |
| JP | 2005-263230 | 9/2005 |
| JP | 2005-280768 | 10/2005 |
| JP | 4115133 | 7/2008 |
| JP | 4159956 | 10/2008 |
| JP | 4173388 | 10/2008 |
| JP | 2008-279510 | 11/2008 |
| JP | 2009-46189 | 3/2009 |
| JP | 2010-036986 | 2/2010 |
| JP | 2011-505302 | 2/2011 |
| JP | 2011-116456 | 6/2011 |
| JP | 4723762 | 7/2011 |
| JP | 2012-192984 | 10/2012 |
| JP | 5290569 | 9/2013 |
| JP | 5323757 | 10/2013 |
| JP | 2013-244996 | 12/2013 |
| JP | 5597333 | 10/2014 |
| JP | 5855233 | 2/2016 |
| JP | 5887340 | 3/2016 |
| RU | 2326033 | 6/2008 |
| RU | 2522059 | 7/2014 |
| RU | 2642231 | 1/2018 |
| WO | WO 94/20237 | 9/1994 |
| WO | WO 99/32363 | 7/1999 |
| WO | WO 00/50311 | 8/2000 |
| WO | WO 2009/115377 | 9/2009 |
| WO | WO 2009/134132 | 11/2009 |
| WO | WO 2010/117009 | 10/2010 |
| WO | WO 2011/078057 | 6/2011 |
| WO | WO 2012/133391 | 10/2012 |
| WO | WO 2012/143322 | 10/2012 |
| WO | WO 2012/144490 | 10/2012 |
| WO | WO 2013/167478 | 11/2013 |
| WO | WO 2013/167483 | 11/2013 |
| WO | WO 2016/166112 | 10/2016 |

OTHER PUBLICATIONS

Extended European Search Report for European Patent Application No. 19881482.4, dated Dec. 5, 2022, 14 pages.
Official Action for U.S. Appl. No. 16/674,986, dated Dec. 7, 2022, 14 pages.
Official Action with English Translation for Brazil Patent Application No. BR112016018055-0, dated May 16, 2022 6 pages.
Partial Supplementary Search Report for European Patent Application No. 19881482.4, dated Jul. 4, 2022 13 pages.
Official Action (English translation) for Japan Patent Application No. 2021-523917, dated May 24, 2022 2 pages.
Decision to Grant for Russia Patent Application No. 2021115804/05, dated May 23, 2022.
Article 94(3) Communication for European Patent Application No. 20208217.8, dated Jan. 31, 2023, 6 pages.
Official Action for Mexico Patent Application No. MX/a/2021/004010, dated Feb. 15, 2023, 4 pages.
Official Action for Brazil Patent Application No. BR112021008418-5, dated Jan. 17, 2023, 4 pages.
Official Action for Australia Patent Application No. 2020304624, dated Jan. 13, 2023, 3 pages.
Official Action for U.S. Appl. No. 17/864,830, dated Feb. 28, 2023, 14 pages.
"Screw thread," retrieved from http://en.wikipedia.org/wii/Screw_thread, retrieved on Jan. 8, 2015, 17 pages.
"Electromagnetic forming," retrieved from http://en.wikipedia.org/wiki/Electromagnetic_forming, retrieved on Nov. 17, 2014, 4 pages.
International Search Report and Written Opinion for International (PCT) Patent Application No. PCT/US15/14840, dated Jun. 23, 2015, 12 pages.
International Preliminary Report on Patentability for International (PCT) Patent Application No. PCT/US2015/014840, dated Aug. 18, 2016 9 pages.
Official Action for Australian Patent Application No. 2015213747, dated May 24, 2018, 3 pages.
Official Action for Australia Patent Application No. 2015213747, dated Nov. 1, 2018 4 pages.
Notice of Acceptance for Australia Patent Application No. 2015213747, dated Feb. 25, 2019 4 pages.
Official Action with English Translation for Brazil Patent Application No. BR112016018055-0, dated Feb. 18, 2020 5 pages.
Official Action for Canada Patent Application No. 2,938,867, dated Feb. 9, 2018 4 pages.
Official Action for Canada Patent Application No. 2,938,867, dated Jun. 12, 2019 7 pages.
Official Action for Canada Patent Application No. 2,938,867, dated Apr. 8, 2020 3 pages.
Official Action for Canada Patent Application No. 2,938,867, dated Mar. 29, 2021 8 pages.
Partial Supplementary Search Report for European Patent Application No. 15747015.4, dated Sep. 29, 2017 12 pages.
Extended Search Report for European Patent Application No. 15747015.4, dated Jan. 16, 2018 10 pages.
Intention to Grant for European Patent Application No. 15747015.4, dated Nov. 13, 2019 8 pages.
Intention to Grant for European Patent Application No. 15747015.4, dated May 12, 2020 7 pages.
Extended Search Report for European Patent Application No. 20208217.8, dated Apr. 13, 2021 11 pages.
Official Action with English Translation for Japan Patent Application No. 2016-550581, dated Nov. 27, 2018 11 pages.
Official Action with English Translation for Japan Patent Application No. 2016-550581, dated Jun. 25, 2019 8 pages.
Official Action with English Translation for Japan Patent Application No. 2016-550581, dated Dec. 10,2019 8 pages.
Decision to Grant for Japan Patent Application No. 2016-550581, dated Feb. 18, 2020 3 pages.
Official Action with English Translation for Japan Patent Application No. 2020-047680, dated Apr. 6, 2021 8 pages.
Official Action for Mexico Patent Application No. MX/a/2016/010182, dated Oct. 15, 2019 3 pages.
Official Action with English Summary for Mexico Patent Application No. MX/a/2016/010182, dated Jul. 13, 2020 7 pages.
Notice of Allowance for Mexico Patent Application No. MX/a/2016/010182, dated Feb. 2, 2021 2 pages.
International Search Report and Written Opinion for International (PCT) Patent Application No. PCT/US19/59888, dated Feb. 25, 2020 11 pages.
Official Action for U.S. Appl. No. 14/616,299, dated Jan. 11, 2017 8 pages Restriction Requirement.

(56) References Cited

OTHER PUBLICATIONS

Official Action for U.S. Appl. No. 14/616,299, dated May 18, 2017 14 pages Restriction Requirement.
Official Action for U.S. Appl. No. 14/616,299, dated Aug. 30, 2017 14 pages.
Official Action for U.S. Appl. No. 14/6161,299, dated Jan. 10, 2018 14 pages.
Notice of Allowance for U.S. Appl. No. 14/6161,299, dated Apr. 10, 2018 11 pages.
Official Action for U.S. Appl. No. 16/052,236, dated Jul. 21, 2020 6 pages Restriction Requirement.
Official Action for U.S. Appl. No. 16/052,236, dated Oct. 15, 2020 10 pages.
Official Action for U.S. Appl. No. 16/052,236, dated Mar. 16, 2021 13 pages.
Notice of Allowance for U.S. Appl. No. 16/052,236, dated May 26, 2021 9 pages.
Official Action for Canada Patent Application No. 2,938,867, dated Dec. 16, 2021 5 pages.
Official Action with English Translation for Japan Patent Application No. 2020-037680, dated Oct. 5, 2021 12 pages.
International Preliminary Report on Patentability for International (PCT) Patent Application No. PCT/US2019/059888, dated May 20, 2021 8 pages.
International Search Report and Written Opinion for International (PCT) Patent Application No. PCT/US2020/038640, dated Sep. 8, 2020 9 pages.
Official Action for U.S. Appl. No. 16/674,986, dated May 28, 2021 9 pages. Restriction Requirement.
Official Action for U.S. Appl. No. 16/674,986, dated Oct. 6, 2021 9 pages.
Official Action for Australia Patent Application No. 2019374778, dated Feb. 25, 2022 3 pages.
Official Action with English Translation for Russia Patent Application No. 2021115804/05, dated Feb. 28, 2022.
International Preliminary Report on Patentability for International (PCT) Patent Application No. PT/US2020/038640, dated Jan. 6, 2022 6 pages.
Official Action for U.S. Appl. No. 16/906,772, dated Feb. 2, 2022 14 pages.
Official Action for U.S. Appl. No. 16/674,986, dated May 9, 2022 13 pages.
Notice of Allowance for U.S. Appl. No. 16/906,772, dated May 12, 2022 8 pages.
Notice of Allowance for Australia Patent Application No. 2019374778, dated Sep. 5, 2022, 4 pages.
Official Action for Canada Patent Application No. 3118298, dated Aug. 29, 2022, 3 pages.
Notice of Allowance (with English translation) for Japan Patent Application No. 2021-523917, dated Oct. 4, 2022, 5 pages.

* cited by examiner

APPARATUS TO SEAL A METALLIC CONTAINER

CROSS-REFERENCE TO RELATED APPLICATIONS

This U.S. Non-Provisional Application is a Divisional of and claims the benefit of priority from U.S. Non-Provisional patent application Ser. No. 16/052,236, filed on Aug. 1, 2018, now U.S. Pat. No. 11,130,606, which is a Divisional Application of, and claims priority to, U.S. patent application Ser. No. 14/616,299 filed on Feb. 6, 2015, now U.S. Pat. No. 10,040,593, which claims priority under 35 U.S.C. § 119(e) to U.S. Provisional Patent Application Ser. No. 61/937,125 filed Feb. 7, 2014, which are each incorporated herein by reference in their entirety.

FIELD OF THE INVENTION

The present invention relates generally to a container that may be sealed and reclosed with a threaded closure. More specifically, the present invention relates to a metallic container and an apparatus and method of manufacturing a metallic container having an opening with inwardly facing threads and a threaded closure. The opening of the metallic container may be closed and sealed and selectively reclosed with the threaded closure which releasably engages the threads of the metallic container.

BACKGROUND

Metallic and glass beverage bottles are generally sealed by a crown cap or closure that cannot be used to reclose or reseal the container. The lack of a closure that can be used to reclose and/or reseal a beverage container after the container is opened creates several problems. First, the contents of an opened container must be consumed quickly or the contents will go flat, spoil, oxidize, or be otherwise wasted. Second, opened containers may tip over and spill the contents, creating a mess and further waste. Finally, containers that are not equipped with a closure that can be re-used to reclose the container cannot generally be re-used, thus creating waste and environmental concerns.

Beverage bottles with external threads on a neck portion are known. However, bottles with external threads are expensive to produce, leak, and have a low dispense rates. In addition, the diameter of the bore of a bottle with external threads is limited by the internal pressure required for the product. Some products would benefit from a container with a larger diameter bore, but known closures used to seal containers with external threads are not able to prevent pressure induced blowout or failure of the seal on containers with large diameter bores and certain internal pressures. Further, drinking from containers with external threads can be uncomfortable, adversely affecting consumer satisfaction of the beverage. Due to the numerous limitations associated with known threaded metal beverage containers and closures, there is an unmet need for a metallic container with a threaded closure that is cost effective to produce, has improved pressure resistance, and provides an enjoyable drinking experience to the consumer.

SUMMARY OF THE INVENTION

The present invention provides novel methods and apparatus of producing a new and useful resealable container adapted to receive a novel threaded closure. In one aspect of the present invention, a metallic container is provided, the metallic container generally comprising a bottom dome portion, a sidewall portion, and a neck portion extending upwardly from the sidewall portion. Further, threads are formed on at least a portion of the neck portion of the metallic container. An opening is positioned on an uppermost portion of the neck portion and a finish with a predetermined shape is formed on the uppermost portion of the neck portion. The finish is adapted to be rigid and dimensionally consistent and may include one or more exterior, upper, and interior sealing surfaces. In one embodiment, the finish is a curl. Although generally applicable to metal containers, the embodiments and various aspect of the present invention may be used and implemented on containers comprised of other materials, including glass, plastic, paper, and combinations thereof.

In accordance with one aspect of the present invention, a novel method of manufacturing a metallic container is provided. This includes, but is not limited to, a method generally comprising: (1) forming a container body in a preferred shape, the container body comprised of a bottom portion, a sidewall portion, a neck portion extending upwardly from the sidewall portion, and an opening positioned on an uppermost portion of the neck portion; (2) providing a threaded closure comprised of a closure body adapted to be inserted at least partially into the opening of the neck portion, the closure body having closure threads formed on at least a portion of an outer surface of the closure body; (3) inserting the threaded closure into the opening of the neck portion; and (4) forming container threads on at least a portion of the neck portion by applying a force against an exterior surface of the neck portion to compress the portion of the neck portion against the threaded closure, wherein the threaded closure is removably interconnected to the neck portion of the container body. In one embodiment, a seal is formed between the threaded closure and the container body by contact between the neck portion of the container body and a portion of the threaded closure above the closure threads. In another embodiment, a seal is formed between the threaded closure and the container body by contact between the neck portion of the container body and a portion of the threaded closure below the closure threads.

Optionally, the method may further comprise: (5) forming a curl on the uppermost portion of the neck portion. The curl has an exterior surface, an upper surface, and an interior surface. At least one of a plug seal, a top seal, and an outer seal formed on an extension extending radially outwardly from an upper circumference of the closure body of the threaded closure contact at least one of the surfaces of the curl. In one embodiment, at least the interior surface of the curl is adapted to engage a seal formed on the threaded closure.

In one embodiment, forming the container threads comprises positioning a hydraulic bag proximate to the exterior surface of the neck portion and expanding the hydraulic bag to press the portion of the neck portion against the threaded closure. In another embodiment, forming the container threads comprises directing a stream of a liquid or a gas against the exterior surface of the neck portion to press the portion of the neck portion against the threaded closure. In yet another embodiment, forming the container threads comprises pressing a tool against the exterior surface of the neck portion to press the portion of the neck portion against the threaded closure. In still another embodiment, forming the container threads further comprises inserting a mandrel into a chamber formed in the closure body. The mandrel supports the closure body when the force is applied against the exterior surface of the neck portion to form the container threads. In one embodiment, the mandrel is formed of sections that can move inwardly and outwardly to change the circumference of the mandrel. In another embodiment, the mandrel is inflatable or expandable.

In still another embodiment, at least a portion of the neck portion of the container body has a conical shape and the closure body of the threaded closure has a shape to match the conical neck portion. The container threads are formed on at least a portion of the conical neck portion by applying the force against an exterior surface of the conical neck portion. In another embodiment, the threaded closure further comprises a chamber formed in the closure body. The chamber has an upper aperture, a cover releasably interconnected to the closure body, and a predetermined volume sufficient to store at least one of a foodstuff, a liquid, a gas, a flavoring, a prize, a cleaning product, a beauty aid, and a tool.

In another embodiment, the threaded closure further comprises a tamper indicator that is altered after the closure body is at least partially removed from the container body. In one embodiment, the tamper indicator is interconnected to at least one of an upper portion of the threaded closure body and a lower portion of the threaded closure body. In another embodiment, the tamper indicator may comprise a ring interconnected to an upper circumference of the closure body by a serrated band. The serrated band is adapted to fracture when the closure body is rotated and the ring contacts a curl or other feature formed on the uppermost portion of the neck portion. After the serrated band fractures, the ring is retained on the neck portion of the container body. In another embodiment, the tamper indicator may comprise a ring interconnected to a lower portion of the closure body by a serrated band. The serrated band is adapted to fracture when the closure body is rotated and the ring contacts an interior surface of an annular ring formed in the neck portion of the container body. The ring is then retained within the container body.

In one embodiment, the threaded closure further comprises at least one channel formed through the closure threads formed on the closure body. The at least one channel is adapted to provide communication from an interior of the container body to ambient air when the threaded closure is rotated to remove the threaded closure from the opening of the bottle body. The pressure is released before the closure threads lose thread engagement with the container threads to prevent unintended expulsion of the threaded closure from the opening of the container body.

In yet another embodiment the method may optionally further comprise forming an annular ring on the container body neck portion below the container threads. The annular ring is adapted to contact at least one of: a seal extending downwardly from a lower portion of the threaded closure body; a liner interconnected to a portion of the threaded closure body; and a gasket or a wad interconnected to a portion of the threaded closure body. The annular ring may be formed before or after the threaded closure is inserted into the opening of the container body.

In accordance with another aspect of the present invention, a novel method of manufacturing a closable metallic container is provided. This includes, but is not limited to, a method generally comprising: (1) forming a metallic container comprising a bottom portion, a sidewall portion, a neck portion extending upwardly from the sidewall portion, and an opening positioned on an uppermost portion of the neck portion; (2) trimming an uppermost portion of the neck portion to a desired length; (3) forming a curl on the uppermost portion of the neck portion; (4) inserting a threaded closure at least partially into the opening of the metallic container; and (5) pressing a tool against an exterior surface of the neck portion to push the neck portion against the threaded closure to form container threads on a portion of the neck portion, wherein the threaded closure is removably interconnected to the opening of the metallic container by rotating the threaded closure.

In one embodiment, the threaded closure comprises: a closure body; a chamber formed in the closure body; closure threads formed on at least a portion of an outside surface of the closure body; and at least one seal adapted to contact a surface of the metallic container.

Optionally, in one embodiment, the method may further comprise: (6) forming an annular ring in the neck portion of the metallic container; and (7) interconnecting a liner to a lower portion of the closure body. When the tool forms the container threads, the curl is drawn downwardly towards the annular ring and the liner is at least partially compressed between an interior surface of the annular ring and the lower portion of the closure body. The liner seals the opening of the metallic container.

In another embodiment, the method may further comprise: (8) interconnecting a liner to a lower portion of the closure body; and (9) after inserting the threaded closure into the opening of the metallic container, forming an annular ring in the neck portion proximate to the lower portion of the closure body. An interior surface of the annular ring contacts the liner and forces at least a portion of the liner further into an interior of the metallic container. The liner seals the opening of the metallic container.

In one embodiment, the threaded closure further comprises as least one aperture formed through the closure body. In another embodiment, the method may further comprise forming an annular ring in the neck portion and injecting a cleaning solution into the chamber formed in the closure body. The cleaning solution flows from the chamber and through the at least one aperture to clean a space between the closure body and an interior surface of the container threads.

In another embodiment, the threaded closure further comprises a gas permeation barrier. In one embodiment, the gas permeation barrier comprises an impermeable material injected into a portion of the closure body. In another embodiment, the gas permeation barrier comprises an impermeable material applied to at least one of an interior surface and an exterior surface of the closure body.

It is another aspect of the present invention to provide a reclosable metallic container. The reclosable metallic container generally comprises, but is not limited to: (1) a container body comprised of a bottom portion, a sidewall portion, a neck portion extending upwardly from the sidewall portion, container threads formed on at least a portion of said neck portion, an opening positioned on an uppermost portion of the neck portion, and a curl formed on the uppermost portion of the neck portion; (2) a threaded closure comprised of a closure body adapted to be inserted at least partially into the opening of the neck portion; (3) closure threads formed on at least a portion of an outside surface of the closure body, (4) at least one seal adapted to engage at least one of the curl of the neck portion, an interior surface of the neck portion, and an exterior surface of the neck portion; and (5) a tamper indicator that provides a visible indication when a seal formed between the threaded closure and the metallic container has been broken. In one embodiment, an upper portion of the threaded closure has a diameter greater than the opening of the container body neck portion.

In another embodiment, the reclosable metallic container optionally further comprises a liner interconnected to a portion of the threaded closure. The liner contacts at least a portion of an annular ring formed in the neck portion of the container body to seal the opening of the neck portion. The liner may be positioned either above or below the closure threads. In one embodiment, the annular ring is pre-formed. In another embodiment, the annular ring is formed after the threaded closure is inserted into the bore of the metallic container.

In still another embodiment of the present invention, a chamber with an upper aperture is formed in the closure body of the threaded closure. A cover releasably interconnected to the closure body may be used to the chamber. The chamber may include at least one aperture formed through the closure body.

In yet another aspect of the present invention, at least one channel is formed through the closure threads. In one embodiment, which comprises a threaded closure with a seal positioned above the closure threads, the channel is adapted to allow a fluid to flow from a space between the container threads and the closure threads to a sealed interior of the container body. In another embodiment comprising a threaded closure with a seal positioned below the closure threads, the channel is adapted to allow a cleaning fluid to flow from a space between the container threads and the closure threads to an exterior of the container body. In this manner, the space between the container threads and the closure threads may be cleaned by introducing a cleaning fluid into the chamber. The cleaning fluid then flows through at least one aperture formed through the closure body and out of the space to the exterior of the container body.

In one embodiment, at least a portion of the neck portion of the container body has a conical portion. The container threads are formed on at least a portion of the conical neck portion and an upper portion of the container threads has an exterior diameter greater than an exterior diameter of a lower portion of the container threads. In another embodiment, the threaded closure has a conical closure body with a shape to match the conical neck portion of the container body. Closure threads are formed on the conical closure body.

In accordance with still another aspect of the present invention, a novel method of manufacturing a metallic container with a removable closure is provided. This includes, but is not limited to, a method generally comprising: (1) forming a container body comprised of a bottom portion, a sidewall portion, a neck portion extending upwardly from the sidewall portion, and an opening positioned on an uppermost portion of the neck portion; (2) providing a removable closure comprised of a non-threaded closure body adapted to be inserted at least partially into the opening of the neck portion; (3) inserting at least a portion of the removable closure body into the opening of the neck portion; and (4) simultaneously forming threads on at least a portion of the container body neck portion and on at least a portion of the removable closure body, wherein the removable closure is interconnected to the neck portion of the container body.

In one embodiment, simultaneously forming the threads comprises inserting a mandrel into a chamber formed in said removable closure body. A tool is then pressed against an exterior surface of the container body neck portion to compress the container body neck portion against the removable closure body. Optionally, the mandrel may have a threaded exterior surface.

In another embodiment, simultaneously forming the threads comprises positioning a thread forming tool proximate to an exterior surface of the container body neck portion. A tool is then pressed against an interior surface of a chamber formed in the removable closure body to compress the removable closure body and the container body neck portion against a contoured surface of the thread forming tool. In still another embodiment, the non-threaded closure body of the removable closure is comprised of a compressible material. In one embodiment, the compressible material of the threaded closure body is one of rubber, plastic, cork, and synthetic cork material.

In one embodiment, the method further comprises forming a seal between the removable closure and the container body, wherein the seal is positioned above the removable closure threads. In another embodiment, the method further comprises forming a seal between the removable closure and the container body, wherein the seal is positioned below the removable closure threads.

In accordance with another aspect of the present invention, an apparatus for forming threads on a metallic container is disclosed. The apparatus generally comprises, but is not limited to: (1) a first chuck operable to support and hold the metallic container in a predetermined position, the metallic container comprising a bottom dome portion, a sidewall portion, a neck portion extending upwardly from the sidewall portion, a finish with a predetermine shape positioned at an uppermost portion of the neck portion, and an opening formed on the uppermost portion of the neck portion; (2) a second chuck operable to position a closure body of a threaded closure at least partially in the opening of the metallic container; (3) an annular ring forming tool operable to form an annular ring on the metallic container; and (4) a thread forming tool operable to apply a force to an exterior surface of the neck portion to compress a portion of the neck portion against closure threads formed on an exterior surface of the threaded closure to form bottle threads on at least a portion of the neck portion of the metallic container.

In one embodiment, the thread forming tool comprises a thread roller operable to move around a circumference of the neck portion to apply the force to the exterior surface of the neck portion. In another embodiment, the thread forming tool comprises a hydraulic bag operable to be positioned proximate to the neck portion and expand to apply the force to the exterior surface of the neck portion. In still another embodiment, the thread forming tool comprises a hydroforming tool operable to direct a stream of liquid against the exterior surface to apply the force to the exterior surface of the neck portion. In yet another embodiment, the thread forming tool comprises an electro-magnetic forming tool operable to create a magnetic field to apply the force to the exterior surface of the neck portion. In another embodiment, the annular ring forming tool comprises a pilfer roller, the pilfer roller operable to move around circumferences of the metallic container and the threaded closure.

In one embodiment, the apparatus may further comprise a mandrel with an unthreaded exterior surface operable to be inserted into a chamber formed in the closure body of the threaded closure, the exterior surface of the mandrel adapted to contact and support the closure body as the thread forming tool applies the force to the exterior surface of the neck portion to form the bottle threads. In yet another embodiment, the apparatus includes means for conforming a portion of the neck portion to the closure threads of the threaded closure.

It is another aspect of the present invention to provide a method of manufacturing a threaded closure. The method generally comprises: (1) forming a closure body adapted to be inserted at least partially into an opening of a metallic container; (2) forming closure threads on at least a portion of an outside surface of the closure body; and (3) forming a seal on the closure body. In one embodiment, the method further may optionally further comprise one or more of: (4) forming an extension extending radially outwardly from an upper circumference of the closure body; (5) forming a chamber with an upwardly facing aperture in the closure body; (6) filling the chamber with a product; (7) interconnecting a cover to seal the aperture of the chamber; and (8) forming holes through the closure body to the chamber.

In one embodiment, the threaded closure is provided with transverse channels formed through the closure threads. The transverse channels enable controlled venting of the metallic container when the threaded closure is removed from the metallic container. When the seal between the threaded closure and the metallic container is broken, the channels allow compressed gas to escape from the interior of the metallic container to ambient air pressure before the closure threads lose thread engagement with the threads of the metallic container. Thus, the transverse channels may prevent the closure from being forcefully ejected from the bottle during removal of the closure by compressed gas within the metallic container and also allow for easy removal of the threaded closure.

In one embodiment, the cover of the chamber is releasably interconnected to the top of the threaded closure and may be comprised of foil, plastic, paper, cardboard, or any other material known in the art. In still another embodiment, the threaded closure is formed with a solid top portion and without an internal chamber. Optionally, threaded closures with the solid top portion may have an internal web to provide structural support to the threaded closure.

In still another aspect of the present invention, a seal may be formed between the metallic container and the threaded closure by a wad of a compressible material that is at least partially impervious to gas and liquids (hereinafter "wad") and similar to a crown sealing material. In one embodiment, the wad may allow a small amount of gas to slowly escape from the bottle. The wad is positioned between the metallic container and the threaded closure. The wad may be positioned on the exterior surface of the threaded closure before the threaded closure is inserted into the bore of the metallic container. Optionally, the wad could be positioned on the upper surface of the curl of the metallic container. After positioning the wad, the threaded closure is inserted into the bore of the metallic container and a top load is applied to the top of the threaded closure to compress the wad between the contact surfaces of the curl of the metallic container and the threaded closure.

In one embodiment, the body of the closure is reformed by a mandrel. As the body of the closure is reformed, a wad of a compressible sealing material is compressed between the metallic container and the threaded closure. Compressing the wad causes the wad to deform and fill the spaces between contact surfaces of the metallic container and the threaded closure, sealing the metallic container. In one embodiment, the seal between the metallic container and the threaded closure is formed by a combination of both the wad and one or more of a plug seal, a top seal, or an outer seal of the threaded closure contacting the seal surfaces of the metallic container. Optionally, a bead of a liquid sealant that is at least partially impervious to gas and liquids may be applied to the contact surfaces of the metallic container or the threaded closure before the threaded closure is inserted into the bore of the metallic container. After the threaded closure is inserted into the metallic container, the liquid sealant flows between the contact surfaces of the metallic container and the threaded closure, substantially filling the spaces. The liquid sealant then hardens to create a seal.

In another aspect of the present invention, a seal may be formed by a wad or liquid sealant positioned between an interior surface of a metallic container and the body of the threaded closure. In one embodiment, the wad or liquid sealant is positioned on a lower exterior surface of the body of the threaded closure before inserting the threaded closure into the bore of the metallic container. After the threaded closure is inserted into the bore, threads are formed on at least a portion of the neck of the metallic container. An annular ring is formed in the neck of the metallic container by any method known to those of skill in the art. The annular ring compresses an interior surface of the neck of the metallic container into the wad or liquid sealant on the threaded closure, compressing and deforming the wad or liquid sealant to fill the space between the interior surface of the neck and the lower exterior surface of the threaded closure, sealing the metallic container.

It is another aspect of the present invention to provide a threaded closure that may be rotated further into the metallic container to release a seal between the threaded closure and the metallic container. A drinking chamber with an open top is formed in a closure body of the threaded closure. Threads are formed on at least a portion of an outside surface of the closure body of the threaded closure. Apertures are formed through the closure body to the drinking chamber. The apertures may be lower on the closure body than the threads. The apertures allow fluid communication between the interior of the metallic container and the drinking chamber of the threaded closure. A gasket, wad, liquid sealant, or layer of a silicon oxide material is positioned on a portion of the outside surface of the closure body lower on the body than the apertures. The threaded closure is then inserted into the bore of the metallic container and threads are formed on the metallic container. A pilfer roller or thread roller forms an annular ring in the metallic container by pressing against the exterior surface of the neck to press an interior surface of the neck of the metallic container against the sealant. The annular ring compresses and deforms the wad or liquid sealant between the interior surface of the neck and the closure body of the threaded closure, substantially filling the space between the interior surface of the neck and the closure body of the threaded closure to create the seal. The annular ring also prevents the threaded closure from being removed from the bore of the metallic container because the annular ring has an inner diameter that is less than the outer diameter of the body of the threaded closure.

The seal between the threaded closure and the metallic container is broken by rotating the closure in a first direction to move the closure further into the metallic container, thereby releasing the contents of the metallic container through the apertures into the drinking chamber where the contents may be consumed. The threaded closure can then be rotated in a second direction to rotate the threaded closure further out of the metallic container to recompress the sealant to reclose and/or re-seal the metallic container. A cover may optionally seal the drinking chamber to keep the drinking chamber clean and sanitary. The cover may be formed of foil, plastic, paper, cardboard, or any other suitable material known to those of skill in the art. In one embodiment, the cover may be hingedly interconnected to the threaded closure. The hinged cover can be lifted up to consume contents from the drinking chamber and then lowered to reclose the drinking chamber.

It is another aspect of the present invention to provide a tamper indicator that identifies to a consumer whether the threaded closure has been at least partially removed from the bore of a container. As will be appreciated by one of skill in the art, the tamper indicator may be used with containers formed of any material including, without limitation aluminum, steel, tin, plastic, glass, paper, and any combination thereof. In one embodiment, the tamper indicator comprises a band severably interconnected to a portion of the threaded closure body above or below the closure threads. When the threaded closure is rotated to open the container, the band separates from the threaded closure body identifying that the seal between the container and the threaded closure has been released.

In another embodiment the tamper indicator comprises a band with axial serrations that fracture when the threaded closure is at least partially rotated to open the container. When the axial serrations fracture, the band flares radially outwardly providing a visual indication that the seal between the container and the threaded closure has been broken.

In yet another embodiment of the present invention the tamper indicator comprises at least one of a shrink film, a wax, a plastic, a metallic foil, a paper material, or a paint applied to the threaded closure and the container. The material of the tamper indicator must be at least partially damaged or compromised by a consumer before or during rotation of the threaded closure by a consumer to open the container.

In still another aspect of the present invention, the tamper indicator is displayed by a gap found between the threaded closure and upper surface of the container. More specifically, the threaded closure body includes a projection which allows the threaded closure to be removed from the container to release the seal between the threaded closure and the container. If the threaded closure is re-inserted by a consumer into the container, the threaded closure may be rotated by the consumer to reseal the container. After the threaded closure is rotated a predetermined amount into the container to re-establish the seal between the threaded closure and the container, the projection contacts an annular ring formed in the neck of the container. The contact between the projection of the threaded closure and the annular ring of the container prevents further rotation of the threaded closure and therefore prevents further downward movement of the threaded closure into the opening of the container. Stated otherwise, after the seal between the threaded closure and the container is broken or compromised, the threaded closure may be used to reseal the container but a visible gap is formed between the upper surface of the container and a portion of the threaded closure to identify that the original seal between the threaded closure and container has been compromised.

The projection may be either integrally formed on the closure body or interconnected to the closure body. In one embodiment, the annular ring is discontinuous. In another embodiment, the annular ring and the projection are positioned above the container threads and the closure threads. In yet another embodiment, the annular ring and the projection are positioned below the container threads and the closure threads.

In another embodiment, the projection comprises a liner interconnected to an exterior surface of the threaded closure body. After the threaded closure is inserted into the bore of the container, an annular ring formed in neck of the container deforms the liner downwardly further into the bore of the container. If the threaded closure is at least partially removed from the container, the threaded closure may be rotated to reseal the container. However, after the seal between the threaded closure and the container is reestablished, the liner contacts the annular ring preventing further closing rotation of the threaded closure. Thus, the liner allows only a partial re-insertion of the threaded closure into the bore of the container.

In another embodiment, the projection comprises a plurality of uni-directional extensions on the threaded closure body. The threaded closure with the uni-directional extensions is introduced vertically into the bore of the unthreaded container during capping in a manner that cannot be duplicated by the consumer. More specifically, the neck of the container includes a dis-continuous annular ring formed at a predetermined location. The dis-continuous annular ring may be pre-formed or formed after the threaded closure is inserted into the bore of the container. After the threaded closure is inserted into the bore of the container, threads are formed in the container. The container threads prevent a direct vertical re-insertion of the threaded closure into the bore by the consumer. The uni-directional extensions allow the consumer to rotate the threaded closure in an opening direction to remove the threaded closure from the container. The threaded closure may be used to reseal the container. However, after the seal between the container and the threaded closure is re-established, the uni-directional extensions contact the dis-continuous annular ring preventing further rotation of the threaded closure in the closing direction. The threaded closure cannot be rotated completely into the bore of the container, thus visually identifying to a consumer that the seal between the container and the threaded closure has been compromised.

In another embodiment, the projection comprises a plurality of tamper projections on the exterior surface of the closure body. After the threaded closure is inserted into the bore of the container, an annular ring is formed in the container. The annular ring is positioned proximate to the tamper projections. As the annular ring is formed, the interior surface of the annular ring contacts the tamper projections and moves the tamper projections to an at least partially folded position. The threaded closure may then be rotated to open the container. When the threaded closure is rotated enough to release the seal between the threaded closure and the container, the tamper projections move above the annular ring and return to an unfolded position. The threaded closure may then be rotated to reseal the container. After the seal is re-established, the tamper projections contact the upper surface of the annular ring and prevent further rotation of the threaded closure in a direction to facilitate closing. A visible gap between the upper surface of the container and a portion of the threaded closure identifies to a consumer that the seal between the container and the threaded closure has been broken or compromised.

In still another embodiment of the present invention, the structure comprises a tamper skirt on the exterior surface of the closure body. An annular ring formed in the container after the threaded closure is inserted into the bore of the container contacts the tamper skirt and folds the tamper skirt down toward the threaded closure body. When the threaded closure is rotated in an opening direction a sufficient amount to release the seal between the container and the threaded closure, the tamper skirts moves above the annular ring and returns to the initial, substantially unfolded position. The threaded closure may be rotated in a closing direction an amount sufficient to reseal the container. However, after the seal between the container and the threaded closure is re-established, the tamper skirt contacts the upper surface of the annular ring and prevents further rotation of the threaded closure in the closing direction. The threaded closure thus cannot be completely rotated back into the container and visually identifies to a consumer that the seal between the container and the threaded closure has been broken or compromised. In one embodiment, the tamper skirt comprises a plurality of individual skirts.

Additional features and advantages of embodiments of the present invention will become more readily apparent from the following discussion, particularly when taken together with the accompanying drawings.

Although generally referred to herein as "metallic container," "metallic bottle," "beverage container," "container," and/or "bottle," it should be appreciated that the current invention may be used with containers of any size or shape including, without limitation, beverage cans and beverage bottles. Accordingly, the term "container" is intended to cover containers of any type. Further, as will be appreciated by one of skill in the art, although the methods and apparatus of the present invention are generally related to metallic containers and metallic bottles, the methods and apparatus of the present invention are not limited to metallic containers and may be used to form containers of any material, including without limitation aluminum, steel, tin, plastic, glass, paper, or any combination thereof.

The term "threads" as used herein refers to any type of helical structure used to convert a rotational force to linear motion. Threads may be symmetric or asymmetric, of any predetermined size, shape, or pitch, and may have a clockwise or counter-clockwise wrap. Threads may be formed on straight or tapered portions of a metallic container or a threaded closure and the threads may comprise one or more leads. Additionally, it will be appreciated by one of skill in the art, that both helical threads and lug threads may be used with metallic containers and threaded closures of the present invention.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about." In addition, although various exemplary dimensions are provided to illustrate one exemplary embodiment of the present invention, it is expressly contemplated that dimensions of bottles and threaded closures may be varied and still comport with the scope and spirit of the present invention.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the summary of the invention given above and the detailed description of the drawings given below serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figure 1:
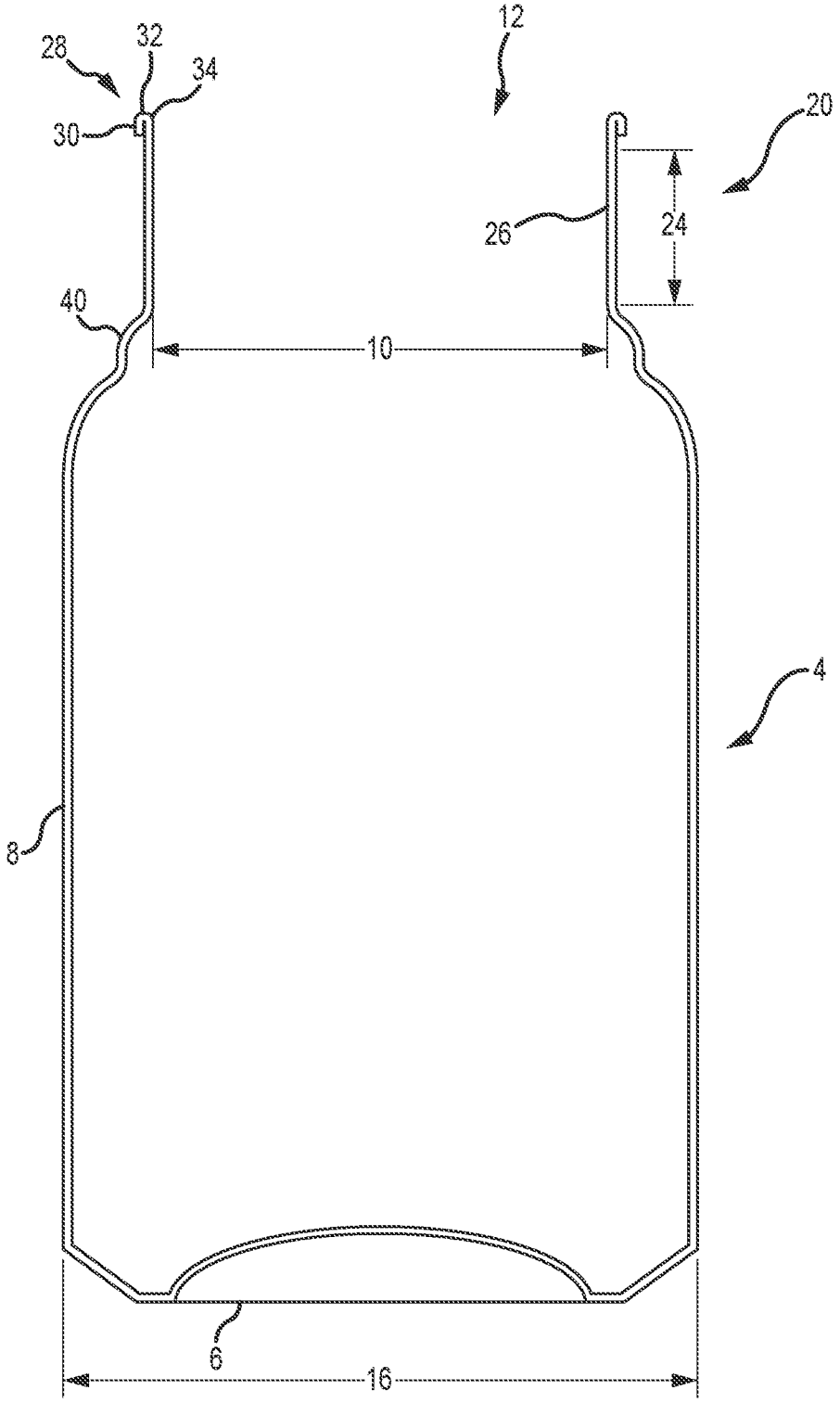
FIG. 1 is a cross-sectional front elevation view of a metallic container according to one embodiment of the present invention prior to threads being formed on the neck of the metallic container.
Figure 2A:
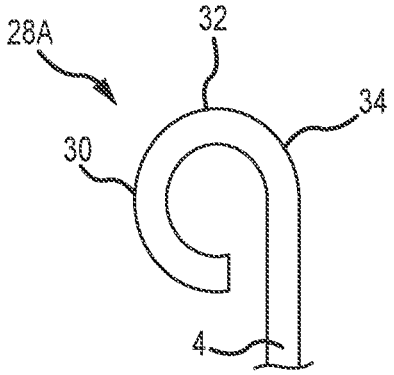
FIGS. 2A-2F are partially fragmented cross-sectional front elevation views depicting various configurations of an uppermost portion of a metallic container according to embodiments of the present invention.
Figure 2B:
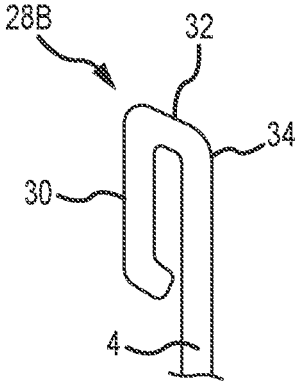
Figure 2C:
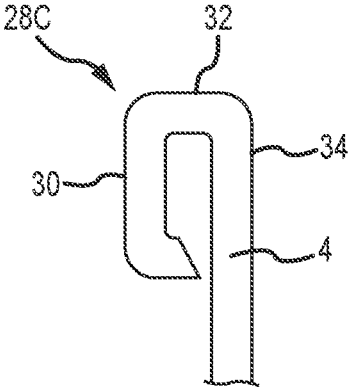
Figure 2D:
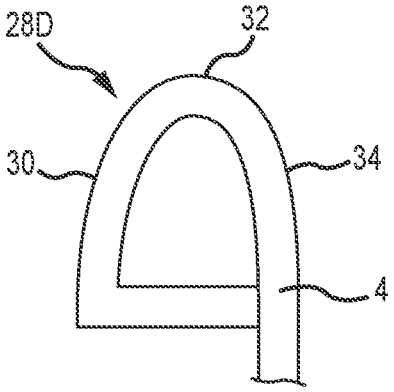
Figure 2E:
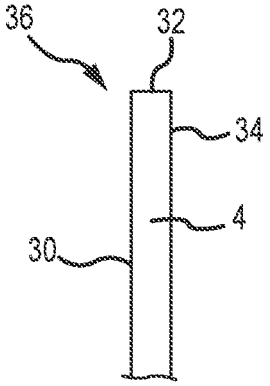
Figure 2F:
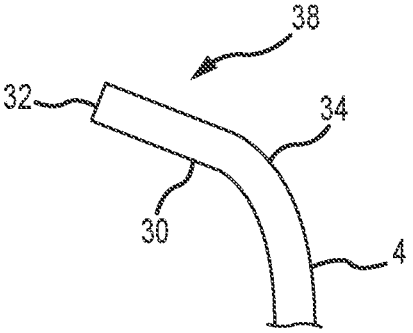

Similar components and/or features may have the same reference number. Components of the same type may be distinguished by a letter following the reference number. If only the reference number is used, the description is applicable to any one of the similar components having the same reference number.

A component list of the various components shown in drawings is provided herein:

| Number | Component |
|---|---|
| 4 | Metallic container |
| 6 | Bottom dome portion |
| 8 | Sidewall |
| 10 | Neck interior diameter |
| 12 | Bore |
| 16 | Outer diameter |
| 20 | Neck |
| 22 | Annular ring |
| 24 | Thread region |
| 26 | Inside surface of neck |
| 28 | Curl |
| 30 | Curl exterior surface |
| 32 | Curl upper surface |
| 34 | Curl interior surface |

-continued

| Number | Component |
|---|---|
| 36 | Straight trim |
| 38 | Flange |
| 40 | Stiffening bead |
| 41 | Lower surface of container threads |
| 42 | Container threads |
| 43 | Upper surface of closure threads |
| 44 | Closure |
| 45 | Lower surface of closure threads |
| 46 | Closure body |
| 47 | Thread peak |
| 48 | Thread valley |
| 49 | Aperture |
| 51 | Interior surface |
| 52 | Chamber |
| 53 | Cover |
| 54 | Top portion |
| 55 | Unthreaded region |
| 56 | Closure depth |
| 57 | Bottom portion |
| 58 | Exterior diameter of threads |
| 59 | Interior diameter of threads |
| 60 | Closure threads |
| 61 | Debossed portion |
| 62 | Stiffening band |
| 64 | Lug thread |
| 66 | Extension |
| 68 | Outer seal |
| 70 | Top seal |
| 72 | Plug seal |
| 73 | Uni-directional extension |
| 74 | Gas barrier |
| 75 | Skirt |
| 76 | Gas barrier |
| 77 | Lower portion of skirt |
| 78 | Sealant |
| 79 | Seal |
| 80 | Liner |
| 81 | Tamper projection |
| 82 | Tamper indicator |
| 83 | Upper surface of tamper indicator |
| 84 | Flexible extension |
| 85 | Tamper skirt |
| 86 | Serrated band |
| 87 | Axial serrations |
| 88 | Recess |
| 89 | Apparatus |
| 90 | Thread roller |
| 91 | Pilfer roller |
| 92 | Vertical axis |
| 93 | Pressing block |
| 94 | Chuck |
| 95 | Grip feature |
| 96 | Channels |
| 97 | Apertures |
| 98 | Cleaning solution |
| 99 | Contents of container |
| 100 | Cylindrical mandrel |
| 102 | Exterior surface |
| 104 | Mandrel sections |
| 106 | Threaded mandrel |
| 108 | Contoured surface of mandrel |
| 110 | Mandrel |
| 112 | Thread split |
| 114 | Contoured surface of thread split |
| 116 | Flutes |
| 118 | Valley |
| 119 | Peak |
| 120 | Area of gas transmission |
| 122 | Area of gas transmission |
| 124 | Gas barrier |
| 126 | Gas barrier |
| 128 | Opening direction |
| 130 | Closing direction |

DETAILED DESCRIPTION

Various embodiments of the present invention are described herein and as depicted in the drawings. The present disclosure has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. It is expressly understood that although FIGS. 1-33 depict metallic containers and embodiments of an apparatus and methods of manufacturing metallic containers adapted to receive a threaded closure, the present invention is not limited to these embodiments and may be used with containers of any shape, size, or material.

Referring now to FIG. 1, a cross-sectional front elevation view of a metallic container 4 according to one embodiment of the present invention is illustrated prior to forming threads on the metallic container 4. The metallic container 4 has a bottom dome portion 6 and a sidewall portion 8. A neck 20 extends upwardly from the sidewall portion 8. An opening or bore 12 is formed at an uppermost portion of the neck 20. The bore 12 is adapted to receive a threaded closure for selectively opening or closing the metallic container 4 after at least a portion of the neck 20 of the metallic container is threaded as described below. The metallic container 4 has been necked to a desired internal diameter 10 in a number of successive operations. Methods and apparatus used in necking metal containers are well known in the art as disclosed in U.S. Pat. No. 5,138,858 which is incorporated herein in its entirety by reference. In one embodiment, the interior diameter 10 of the bore 12 is between approximately 0.6 inches and approximately 4.0 inches prior to threading. In a more preferred embodiment, the interior diameter 10 is between approximately 0.8 inches and 2.2 inches prior to threading. In one embodiment, an outer diameter 16 of the metallic container 4 is between approximately 1.5 inches and approximately 5 inches. In a more preferred embodiment, the outer diameter 16 is between approximately 1.9 inches and approximately 3.1 inches.

The neck 20 has an interior surface 26 and a thread region 24 where threads are formed as described below. The threads formed on the neck 20 are adapted to threadably engage threads formed on an exterior surface of a threaded closure inserted at least partially in the bore 12. The thread region 24 may have a cylindrical, tapered, or conic shape or combinations thereof, or any other desired shape.

A top edge of the metallic container 4 is trimmed to a desired length and formed into a finish with a predetermined shape to create seal surfaces which are rigid, smooth, and dimensionally consistent. In one embodiment, the predetermined shape of the finish is a curl 28. The curl 28 may comprise one or more folds of the material of the metallic container 4 and has an exterior surface 30, upper surface 32, and interior surface 34 which are shown in FIG. 2. Optionally, in one embodiment, one or more stiffening beads 40 may be formed on the neck 20 during or after the necking.

Referring now to FIGS. 2A-2D, optional shapes of curls 28A, 28B, 28C, 28D are illustrated. The curl 28 can have a straight portion on one or more of the surfaces 30, 32, 34. Alternatively, one or more of the surfaces 30, 32, 34 of the curl 28 can be rounded. In one embodiment, curls 28A, 28B, 28C, or 28D may be formed of a material different than the material of the metallic container 4 interconnected to a straight trim 36 or a flange 38. In one embodiment, illustrated in FIG. 2E, the curl 28 is replaced by a straight trim 36 at the top edge of the metallic container 4. In still another embodiment, illustrated in FIG. 2F, optionally the curl 28 is replaced by a flange 38. It will be appreciated by one of skill in the art that the flange 38 can have any desired shape and may extend from the neck of the metallic container 4 at any desired angle.

Figure 3:
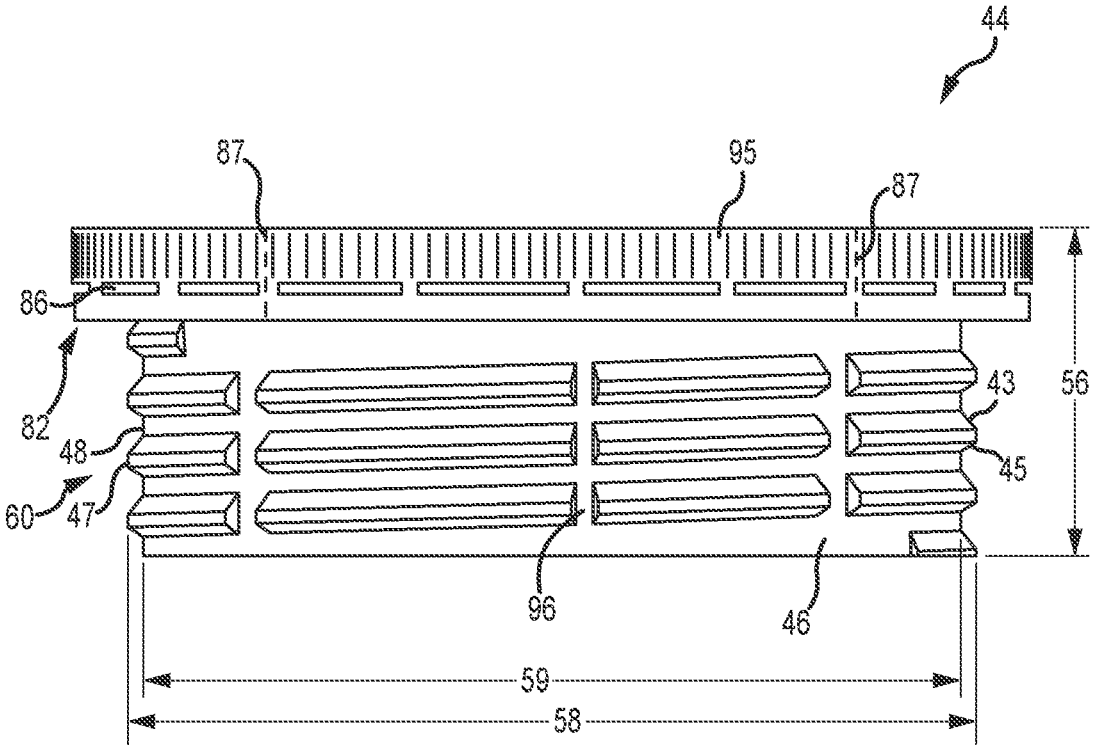
FIG. 3 is a front elevation view of a threaded closure according to one embodiment of the present invention.

Referring now to FIG. 3, a threaded closure 44 according to one embodiment of the present invention is illustrated. The threaded closure 44 may be formed of wood, cork, molded plastic, metal (including, without limitation, aluminum, steel, tin, or any combination thereof), synthetic material, glass, paper, or combinations thereof. The threaded closure 44 has a body 46 with a predetermined depth 56. In one embodiment, the depth 56 of the body 46 is between approximately 0.5 inches and approximately 2.0 inches, but it will be appreciated by one of skill in the art that the depth 56 can be modified to be deeper or shallower based on the application.

Helical threads 60 are formed on an exterior surface of the body 46 of the threaded closure 44. The threads 60 have an exterior diameter 58 selected to fit into the bore 12 of a metallic container 4. In one embodiment, the exterior diameter 58 is between approximately 0.6 inches and approximately 4.0 inches. In a more preferred embodiment, the exterior diameter 58 is between approximately 0.8 inches and approximately 2.2 inches. In a still more preferred embodiment, the exterior diameter 58 is between approximately 1.1 inches and approximately 1.3 inches. Additionally, or alternatively, the exterior diameter 58 at the uppermost portion of the closure threads 60 is greater than the exterior diameter 58 at the lower-most portion of closure threads 60. Accordingly, in one embodiment, the upper-most portion of the closure threads 60 has an exterior diameter 58 that is from about 0.0 inches to about 0.015 inches greater than the exterior diameter of the lower-most portion of the closure threads 60.

In one embodiment, the threads 60 have an interior diameter 59 of between approximately 0.6 inches and approximately 4.0 inches. In another embodiment, the interior diameter 59 is between approximately 0.8 inches and approximately 2.2 inches. In a more preferred embodiment, the interior diameter 59 of the threads 60 is between approximately 1.05 inches and approximately 1.25 inches. It will be appreciated by one of skill in the art that the interior diameter 59 and the exterior diameter 58 of the threads 60 may be varied and still comport with the scope and spirit of the present disclosure.

The threads 60 have an upper surface 43, a lower surface 45, a peak 47, and a root or valley 48. In one embodiment, the threads 60 have a substantially symmetrical cross-sectional profile. In another embodiment, the cross-sectional profile of the threads 60 is not symmetric and the peak 47 of the threads 60 has a different profile than the valley 48 of the threads 60. In another embodiment, the upper surface 43 of the threads is substantially horizontal. In one embodiment, the threads 60 have more than one wrap around the body 46. In another embodiment, the threads 60 have between approximately 0.25 wraps to approximately 8 wraps around the body 46. In one embodiment, the threaded closure 44 includes a multi-lead thread formed of two or more individual threads. Each individual thread of the multi-lead thread can have a different number of thread wraps.

Optional channels 96 have been formed through the closure threads 60. The channels 96 provide communication between the interior of the metallic container 4 and a space between the container threads 42 and the closure threads 60. The channels 96 enable a controlled release of gas to release pressure from the interior of the metallic container 4 during removal of the threaded closure 44 by providing communication between the interior of the metallic container 4 and ambient air outside of the metallic container 4. After a seal between the metallic container 4 and the threaded closure 44 is broken, gas may escape through the channels 96 to the exterior of the metallic container 4 before the closure threads 60 lose thread engagement with threads 42 formed on the metallic container 4. This controlled release of pressure prevents the threaded closure 44 from being forcefully ejected from the metallic container 4 during opening and also allows for easy removal of the threaded closure 44. Moreover, the channels 96 prevent spitting or inadvertent upward release of product when the threaded closure 44 is removed from a metallic container 4 by allowing liquid product to drain downward out of the space between the container threads 42 and the closure threads 60. During handling, a filled metallic container 4 may be inverted allowing the liquid product to flow into the space between the threads 42, 60. When a metallic container 4 sealed by a threaded closure 44 without channels 96 is returned to a vertical position, the liquid product may not flow out of the space due to the surface tension of the liquid. If the liquid product remains in the space, the liquid product will block the path of the pressurized gas from the metallic container 4 when the metallic container 4 is opened. When a consumer rotates the threaded closure 44 to open the metallic container 4, the gas will push the residual liquid product trapped in the space between the threads 42, 60 out of the metallic container 4 and possibly onto the consumer. In contrast, when a metallic container 4 sealed by a threaded closure 44 with channels 96 is returned to a vertical position, the channels 96 form a path for the liquid product to flow downward back into the metallic container 4. When the threaded closure 44 is rotated, the channels 96 may also provide a path of least resistance for the escaping gas that is free of liquid product. In one embodiment, the channels 96 are substantially vertical. However, it will be appreciated by one of skill in the art that the channels 96 may have any orientation predetermined to form a path for the flow of liquid product downward into the metallic container 4 and to allow gas to escape when the metallic container is opened.

Optionally, a tamper indicator 82 may be formed on the threaded closure 44 to provide an indication to a consumer after the threaded closure 44 has been at least partially unthreaded from a metallic container 4. The tamper indicator 82 is adapted to be retained on a neck 20 of the metallic container 4 after a serrated band 86 fractures when the threaded closure 44 is rotated to open the metallic container 4. In another embodiment, the tamper indicator 82 includes axial serrations 87 instead of the serrated band 86. When the threaded closure 44 is removed from a metallic container 4, the serrations 87 fracture and sections of the tamper indicator 82 flair outwardly to indicate that the threaded closure 44 has been at least partially removed from the metallic container 4. In one embodiment, the tamper indicator 82 is integrally formed of the same material as the closure body 46. In another embodiment, the tamper indicator 82 is interconnected to the threaded closure 44 and is formed of a metal or a plastic material that is different than the material of the closure body 46.

Additionally, grip features 95 may be formed on an exterior surface of the threaded closure 44 to improve a consumer's grip. In one embodiment, illustrated in FIG. 3, the grip features 95 comprise knurls. In another embodiment, the grip features may comprise one or more of knurls, scallops, holes, and slots formed on one or more exterior surfaces of the threaded closure 44. In one embodiment, the grip features 95 are formed by a pilfer roller, described below. Optionally, one or more surfaces of the threaded closure 44 may be decorated with a preferred indicia. In one embodiment, an exterior top surface (or public side) of the threaded closure is decorated. In another embodiment, an interior surface (or product side) of the threaded closure is decorated. In still another embodiment, the decoration comprises one or more of a lithographic image, an embossed image, and a debossed image.

Figure 4:
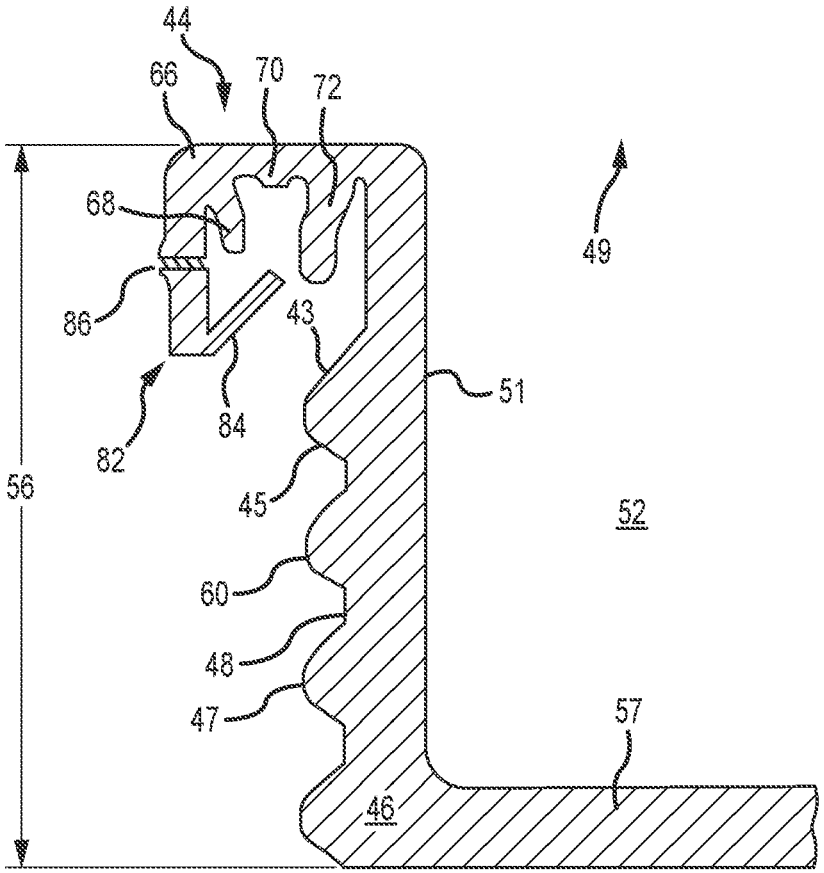
FIG. 4 is a partially fragmented cross-sectional front elevation view of a portion of a threaded closure according to one embodiment of the present invention.
Figure 4A:
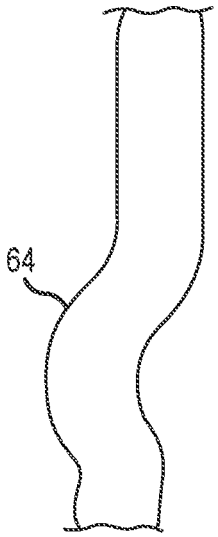
FIG. 4A is a partially fragmented cross-sectional front elevation view of an optional lug thread according to one embodiment of the present invention.

Referring now to FIG. 4, a partially fragmented cross-sectional front elevation view of a threaded closure 44 according to one embodiment of the present invention is illustrated prior to insertion into the bore 12 of a metallic container 4. The threaded closure 44 has helical threads 60, however, as will be appreciated by one of skill in the art, lug threads 64 may optionally be formed on the threaded closure 44 as illustrated in FIG. 4A. The threaded closure 44 includes a bottom portion 57 and a chamber 52. The chamber 52 can be used to retain or store items of any type. For example, foodstuffs, liquids, gases, flavorings, prizes, cleaning materials, chemicals, beauty aids, tools, and other materials may be stored in the chamber 52. The chamber 52 is accessible by an upwardly opening aperture 49. Optionally, the bottom portion 57 may be debossed or embossed to increase the rigidity of the threaded closure 44.

The body 46 of the threaded closure 44 may have a shape adapted to enable threaded closures 44 to be stacked to decrease the amount of space required to store the threaded closures 44. In one embodiment, the bottom portion 57 of the body 46 is adapted to at least partially fit into the chamber 52 of another threaded closure 44. In another embodiment, the bottom portion 57 at least partially fits into a deboss formed in the bottom portion 57 of another threaded closure 44.

Figure 14:
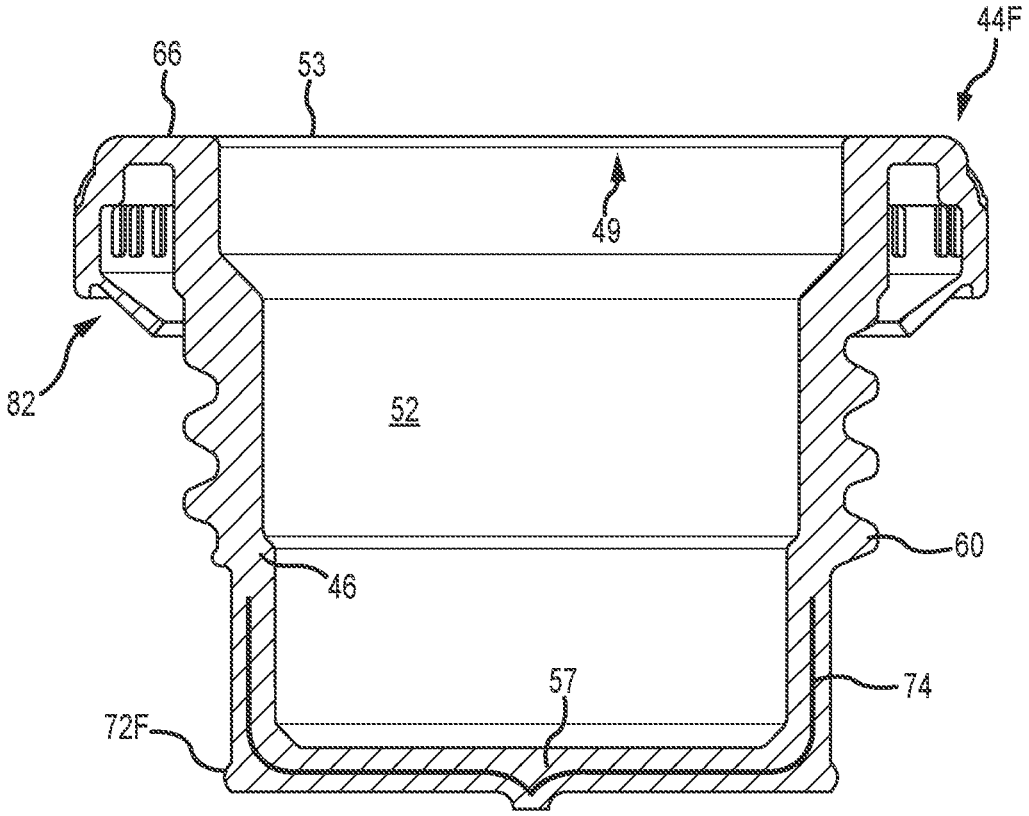
FIG. 14 is a cross-sectional front elevation view of yet another threaded closure of the present invention with an internal gas permeation barrier formed of a material injected into a portion of the body of the threaded closure and further illustrating a plug seal formed on the threaded closure body below the closure threads.
Figure 15:
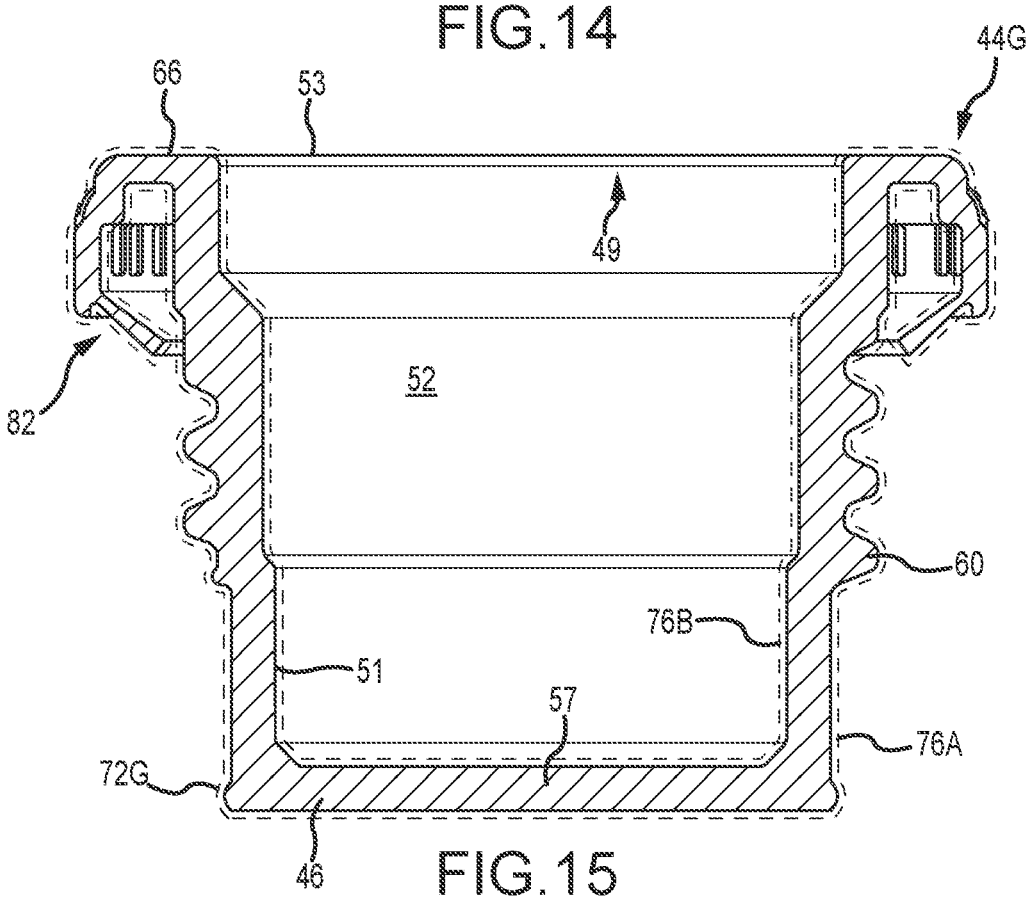
FIG. 15 is a cross-sectional front elevation view of a threaded closure of still another embodiment of the present invention with a gas permeation barrier formed of a coating that is applied to surfaces of the threaded closure.

The threaded closure 44 has an extension 66 extending radially outward from an upper circumference of the closure body 46. An outer seal 68, a top seal 70, and an inner or plug seal 72 are formed on the extension 66 and are sized and have a geometry adapted to contact and/or apply sealing forces to one or more of the surfaces 30, 32, 34 of the curl 28, trim 36, or flange 38 of a metallic container 4. Although illustrated in FIG. 4 extending from the extension 66, it will be appreciated by one of skill in the art that the plug seal 72 may extend directly from any predetermined location of the closure body 46. Further, the plug seal 72 may have any desired shape. Accordingly, in one embodiment, the plug seal 72 may be formed on, or extend from, the body 46 of the threaded closure 46. In another embodiment, the plug seal 72 is formed as a protrusion extending at least partially from the exterior surface of the body 46 of the threaded closure 44. In still another embodiment, the plug seal 72 is positioned above the closure threads 60. In yet another embodiment, the plug seal 72 is positioned below the closure threads 60 as illustrated in FIGS. 14 and 15. The outer seal 68, top seal 70, and plug seal 72 may be integrally formed on the threaded closure 44 or interconnected to the threaded closure. In one embodiment, the seals 68, 70, 72 may optionally be flexible or deformable to ensure sealing contact with the surfaces 30, 32, 34. In another embodiment, the seals 68, 70, 72 may be made of or include a material that differs from a material of the body 46 of the threaded closure 44. For example, the seals 68, 70, 72 may include or be made of cork, rubber, plastic, elastomers, silicon, elastomeric material, or other flexible and/or compressible materials. Additionally, or alternatively, the top seal 70 may be designed to prevent damage to the curl 28 during shipping and handling of the filled metallic container 4. Accordingly, in one embodiment, the top seal 70 may be a bumper adapted to absorb a force applied to the threaded closure 44 to prevent unintended release of the seal between the metallic container 4 and the threaded closure 44.

Figure 5A:
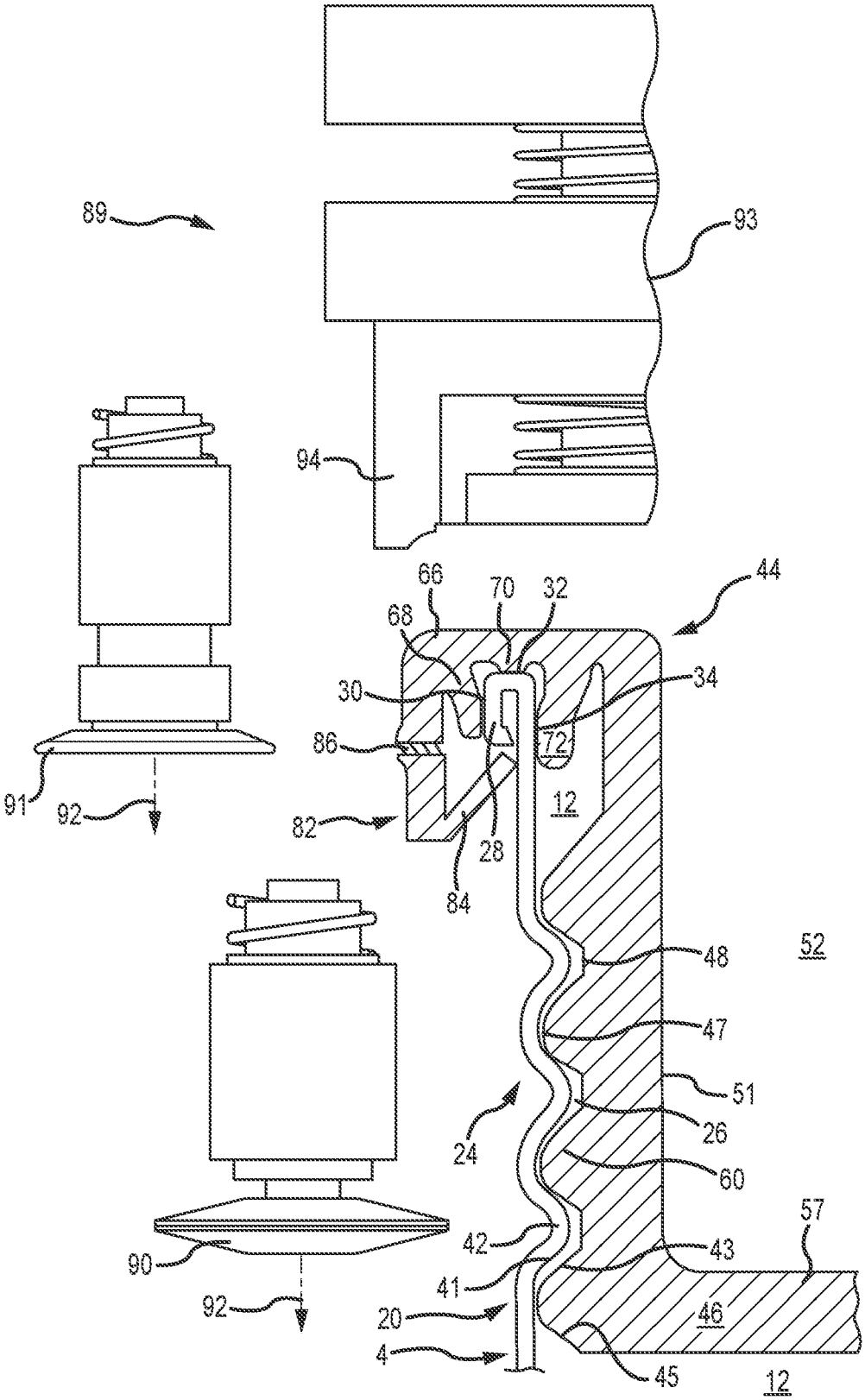
FIG. 5A illustrates a fragmented front elevation view of an apparatus operable to seal the metallic container of FIG. 1 with the threaded closure of FIG. 4 according to one embodiment of the present invention.

A tamper indicator 82 is formed on the extension 66. The tamper indicator 82 has a flexible extension 84 that enables the tamper indicator 82 to slide downward over the curl 28, trim 36, or flange 38 of a metallic container 4 when the threaded closure 44 is inserted into the bore 12 of the metallic container 4, as illustrated in FIG. 5A. In one embodiment, the tamper indicator comprises a zip strip formed of a scored material that must be pulled manually and at least partially and destructively removed from the threaded closure 44 before the threaded closure can be removed from the bore 12 of the metallic container 4. In one embodiment, the zip strip is formed of a material different than the material of the threaded closure 44. In another embodiment, the tamper indicator is a leash comprising a circumferential score or frangible band. As the consumer rotates the threaded closure to open the metallic container, the score is fractured. A first end of the leash is interconnected to a band retained on the neck 20 of the metallic container 4 and a second end of the leash is interconnected to the threaded closure 44 preventing loss of the threaded closure 44 and preventing the threaded closure from becoming litter.

Referring now to FIG. 5A, a partial view of an apparatus 89 operable to seal a metallic container 4 with a threaded closure 44 is illustrated according to embodiments of the present invention. Although not illustrated, it will be understood that the right side of the apparatus 89 is substantially symmetrical to the left side of the apparatus. The apparatus 89 generally includes thread rollers 90, pilfer rollers 91, and a pressing block 93. The thread rollers 90 and pilfer rollers 91 can rotate about a vertical axis 92. The thread rollers 90 are loaded with a relatively light spring load and can traverse along the vertical axis 92 to move vertically up and down. In one embodiment, the spring load of the thread rollers 90 is less than about 3 pounds. The pilfer rollers 91 are generally loaded with a heavy spring and do not traverse along the vertical axis 92. In one embodiment, the spring load may be 30 lbs. and the pilfer rollers 91 can traverse less than approximately 0.2 inches. The rollers 90, 91 are operable to rotate around the exterior of the metallic container 4 and apply a compressive force to predetermined portions of the metallic container 4 and the threaded closure 44. The rollers 90, 91 may be made of metal, rubber, plastic, or any other durable material known to those of skill in the art and can be of any shape or size and have contact surfaces of any profile. In one embodiment, two or more thread rollers 90 with contact surfaces of different profiles or sizes may be used to create the container threads 42. In another embodiment, the pilfer rollers 91 are operable to form serrations in one or more portions of the threaded closure 44. Although only one thread roller 90 and pilfer roller 91 are illustrated in FIG. 5A, in one embodiment the apparatus 89 may include two or more thread rollers 90 and two or more pilfer rollers 91.

The press block 93 includes a chuck 94 operable to hold the threaded closure 44 and press the threaded closure 44 downwardly into the bore 12 of the metallic container 4. The chuck 94 may also rotate the threaded closure 44. The apparatus 89 may also include a second chuck (not illustrated) to support the metallic container 4 and hold the metallic container 4 in a predetermined position. Additionally, the apparatus 89 may include one or more mandrels 100, 106, and 110 and a thread split 112 described in more detail hereinafter.

In operation, after the metallic container 4 is filled with a beverage, the apparatus 89 places the body 46 of the threaded closure 44 at least partially within the bore 12 of the metallic container 4. In one embodiment, before the threaded closure 44 is placed in the bore 12, the metallic container 4 has an unthreaded thread region 24 that is generally cylindrical. One or more thread rollers 90 of the apparatus 89 can be positioned in contact with an exterior surface of the thread region 24 of the neck 20 of the metallic container 4. Threads 42 are formed on the metallic container 4 by the thread rollers 90 as the material of the thread region 24 is compressed between contact surfaces of the thread rollers 90 and the closure threads 60 of the threaded closure 44. The thread rollers 90 generally start at the top of the thread region 24 of the metallic container 4 and work downwardly around the thread region 24. During the threading of the metallic container 4, a top-load may optionally be applied to the threaded closure 44 by the pressing block 93. In one embodiment, as the threads 42 are formed, the height of the metallic container 4 is decreased as the upper surface 32 of the curl 28 is drawn downwardly toward the bottom of the metallic container 4. In another embodiment, the thread rollers 90 start at the bottom of the thread region 24 and work upwardly. Methods and apparatus used to thread metal containers are disclosed in the following publications which are all incorporated herein in their entirety by reference: U.S. Patent Application Publication No. 2014/0263150, U.S. Patent Application Publication No. 2012/0269602, U.S. Patent Application Publication No. 2010/0065528, U.S. Patent Application Publication No. 2010/0326946, U.S. Pat. Nos. 8,132,439, 8,091,402, 8,037,734, 8,037,728, 7,798,357, 7,555,927, 7,824,750, 7,171,840, 7,147,123, 6,959,830, and International Application No. PCT/JP2010/072688 (publication number WO/2011/078057).

When the threaded closure 44 is inserted into the bore 12 of a metallic bottle 4, the pressure from the product within the metallic bottle 4 pushes the threaded closure 44 upward. The upper surface 43 of the closure threads 60 is pushed against and applies a force to a lower surface 41 of the container threads 42 and prevents unintended ejection of the threaded closure 44. In one embodiment (not illustrated), the upper surface 43 of the closure threads 60 and the lower surface 41 of the container threads 42 are substantially horizontal. The substantially horizontal surfaces 41, 43 improve the strength of the thread engagement between the closure threads 60 and the container threads 42 because the upward force of the upper surface 43 of the closure threads 60 is substantially perpendicular to the lower surface 41 of the container threads 42.

As illustrated in FIG. 5A, the threaded closure 44 may include a tamper indicator 82 interconnected to the extension 66 of the closure body 46 by a serrated band 86. The tamper indicator 82 has a flexible extension 84 that enables the tamper indicator 82 to slide downward over the curl 28 of the metallic container 4 when the threaded closure 44 is inserted into the bore 12 of the metallic container 4 by the apparatus 89. In one embodiment, the serrated band 86 is formed before the threaded closure 44 is inserted into the bore 12 of the metallic container 4. In another embodiment, the serrated band 86 is formed by tools of the apparatus 89 after the threaded closure 44 is inserted into the bore 12 of the metallic container 4.

After the metallic container 4 is sealed with the threaded closure 44, when a rotational force is applied to the threaded closure 44 to unthread the threaded closure 44 from the metallic container 4, the extension 84 of the tamper indicator 82 contacts a bottom surface of the curl 28, or another surface formed on the neck 20 of the metallic container, preventing the tamper indicator 82 from sliding back over the curl 28. As the rotational force continues to be applied to the threaded closure 44, the serrated band 86 interconnecting the tamper indicator 82 to the threaded closure 44 is severed and the tamper indicator 82 is retained on the neck 20 of the metallic container 4. The presence of the tamper indicator 82 on the neck of the metallic container provides a visual indication to a consumer that the closure 44 has been at least partially opened or unthreaded and the seal to the metallic container 4 compromised.

As illustrated in FIG. 5A, in one embodiment of the present invention, a seal between the metallic container 4 and the threaded closure 44 is created by a geometry of at least one of the seals 68, 70, 72 formed on the threaded closure 44. The seals 68, 70, 72 of the threaded closure 44 are adapted to contact and apply a sealing pressure to at least one of the exterior surface 30, upper surface 32, and interior surface 34 of the curl 28 of the metallic container 4. The seal keeps the product in the metallic container 4 without leakage or infiltration of liquid or gas. Additionally, the seal prevents the contents of the metallic container 4 from going flat or oxidizing. Optionally, the seal between the metallic container 4 and the threaded closure 44 is not axisymmetric. In a non-axisymmetric seal, a predetermined portion of the seal can provide an initial and controlled venting of pressurized gas when the metallic container 4 is opened. This controlled venting may prevent foaming of the product. A non-axisymmetric seal may be formed between a metallic container 4 and a threaded closure 44 of all embodiments of the present invention. In one embodiment, the thread roller 90 or the pilfer roller 91 may contact and apply a force to one or more surfaces of the extension 66 to ensure contact between the seals 68, 70, 72 of the threaded closure 44 and the surfaces 30, 32, 34 of the metallic container 4 seals the metallic container 4.

In addition to providing a sealing surface, in one embodiment the exterior surface 30 of the curl 28 is used to align and provide concentricity of the threaded closure 44 and the metallic container 4. Thus, contact between the exterior surface 30 of the curl 28 and the outer seal 68 of the threaded closure 44 aligns the threaded closure 44 and the metallic container 4 to ensure a tight seal is achieved during sealing and thread forming by the apparatus 89. In one embodiment, the apparatus 89 forms cuts or slots in the exterior surface 30 of a curl 28A-28D so that the exterior surface 30 is not continuous and is able to spring or flex for alignment with the threaded closure 44. Curls 28A-28D with a non-continuous exterior surface 30 are useful for aligning the threaded closure 44 and the metallic container 4 but do not provide a sealing surface for the threaded closure 44.

In one embodiment, the apparatus 89 includes a hydraulic bag operable to form the container threads 42. In operation, the hydraulic bag is positioned proximate the thread region 24 and then inflated or expanded to apply a force to the exterior surface of the thread region 24. The force applied by the hydraulic bag reforms the thread region and the threads 60 of the threaded closure 44 form the container threads 42. Optionally, in one embodiment, the hydraulic bag includes one or more ridges that substantially correspond to the valleys 48 of the threaded closure 44. Referring now to FIG. 5C, in another embodiment, the apparatus 89 includes a hydraulic tool 101 operable to direct a high pressure stream of a liquid or a gas against an exterior surface of the thread region 24 to apply a force to the thread region 24 to form the container threads 42. In still another embodiment, the apparatus 89 may form the container threads 42 with an electromagnetic (EM) forming tool. The EM forming tool is placed in proximity to the thread region 24 of the metallic bottle. A pulse of current is forced through a work coil of the EM forming tool creating a magnetic field around the EM forming tool that reforms the thread region 24, forming the container threads 42. The threads 42 may be formed without any contact by the EM forming tool. In one embodiment, the EM forming tool is inserted at least partially into the chamber 52 of the threaded closure 44 and the magnetic field attracts the metal of the thread region 24. In another embodiment, the EM forming tool is positioned proximate an exterior portion of the thread region and the magnetic field repels the metal of the thread region 24.

Figure 5B:
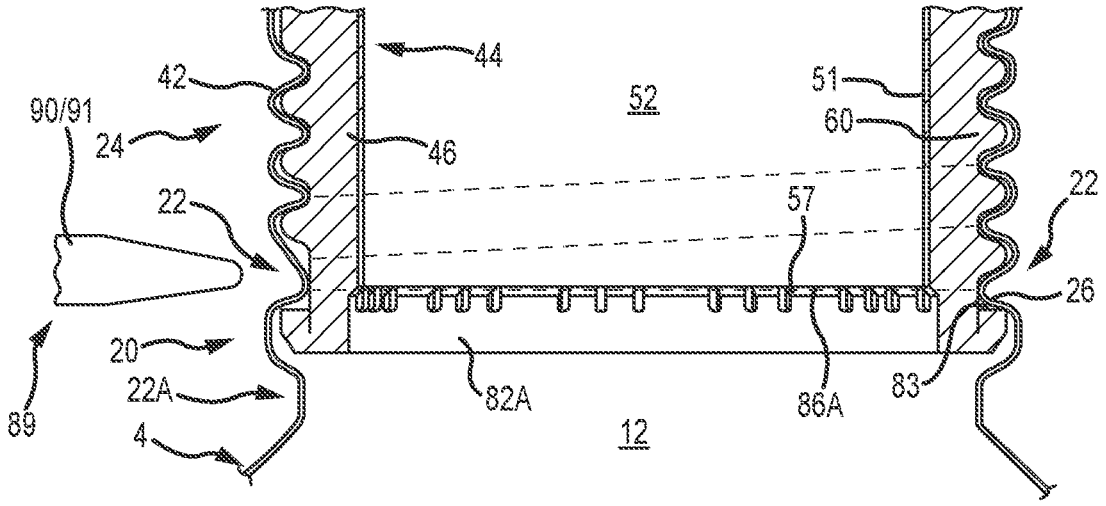
FIG. 5B illustrates the apparatus of FIG. 5A forming an annular bead in the metallic container of FIG. 1 sealed with a threaded closure including a pilfer indicator according to another embodiment of the present invention.
Figure 5C:
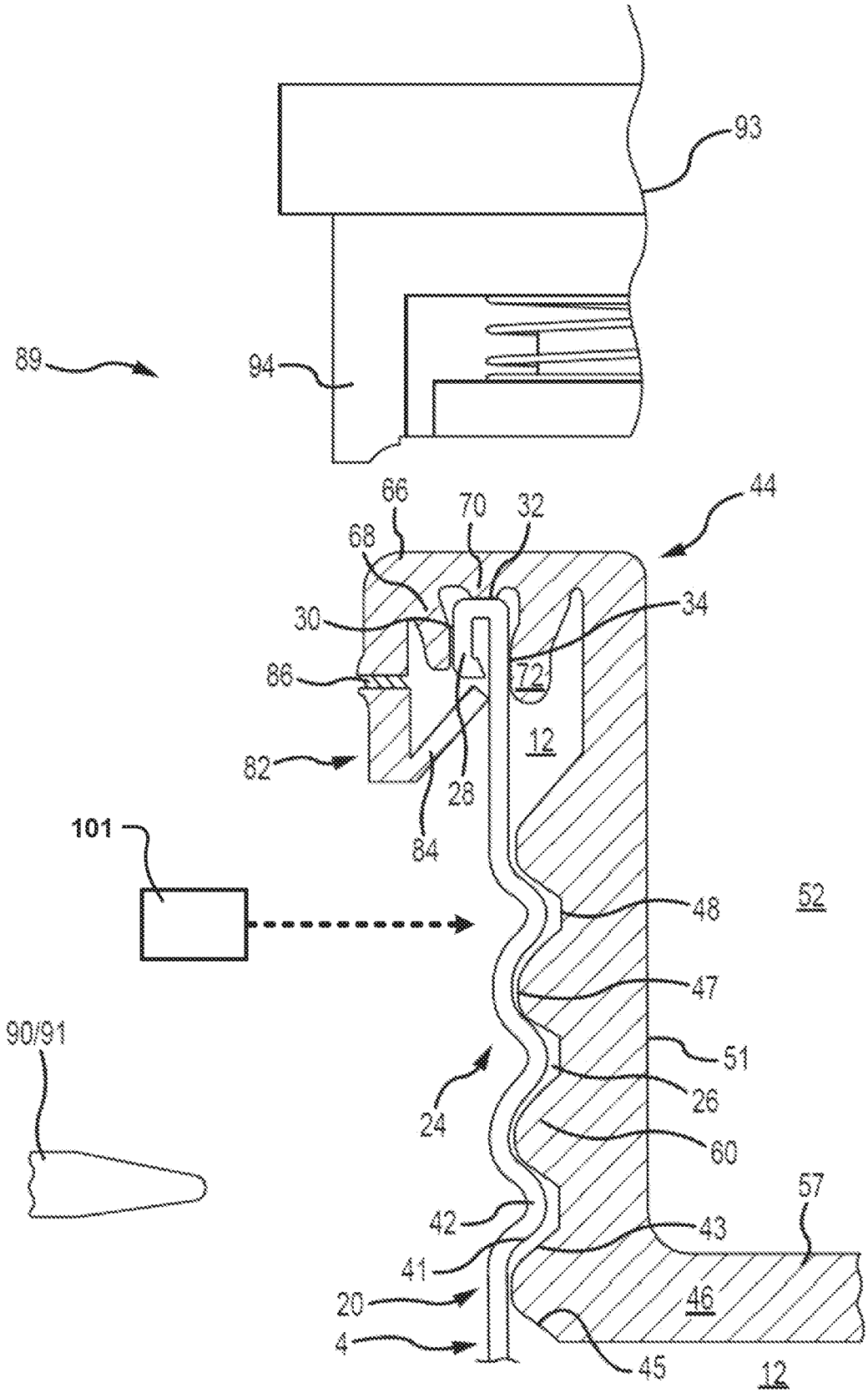
FIG. 5C illustrates a hydraulic tool operable to form container threads on a metallic container according to one embodiment of the present invention.

Additionally, and referring now to FIG. 5B, a tamper indicator 82A may be interconnected to the bottom portion 57 of the body 46 of the threaded closure 44 by a frangible score or serrated band 86A. In one embodiment of the present invention, when forming the container threads 42, the apparatus 89 forms an annular ring 22 in a portion of the neck 20 of the metallic container 4 lower than the thread region 24. The apparatus 89 may form the annular ring 22 before, simultaneously, or after forming the threads 42 on the metallic container. The annular ring 22 may be formed by any tool of the apparatus 89, including the thread roller 90, the pilfer roller 91, the hydraulic bag, the hydraulic tool, or the EM forming tool.

The annular ring 22 prevents the tamper indicator 82A from being removed from the bore 12 of the metallic container 4. As the threaded closure 44 is rotated to open the metallic container 4, an upper surface 83 of the tamper indicator 82A contacts an interior surface 26 of the neck 20 proximate to the annular ring 22, applying a force to the serrated band 86A and separating the tamper indicator 82A from the threaded closure 44. The tamper indicator 82A is then retained within the bore 12 of the metallic container 4 indicating that the threaded closure 44 has been at least partially unthreaded from the metallic container 4. Optionally, the metallic container 4 may include a second annular ring 22A formed below the tamper indicator 82A to prevent the tamper indicator 82A from dropping completely into the metallic container 4. The second annular ring 22A may be either preformed on the metallic container or formed by the apparatus 89 after the threaded closure 44 is inserted in the bore 12.

The serrated band 86A is designed to prevent fracture prior to the application of a predetermined amount of force to the tamper indicator 82A. Accordingly, the serrated band 86A may be adapted to prevent unintended or inadvertent expulsion of the threaded closure 44 from the bore 12 of the metallic container 4 due to pressure within the metallic container. In this manner, although the threads 42, 60 are illustrated wrapping more than one time around the circumferences of the metallic container 4 and the threaded closure 44, in one embodiment a single thread wrap is sufficient to prevent expulsion of the threaded closure 44 when the threaded closure 44 includes the pilfer indicator 82A. In one embodiment, the threaded closure 44 may include two tamper indicators 82, 82A.

Figure 6:
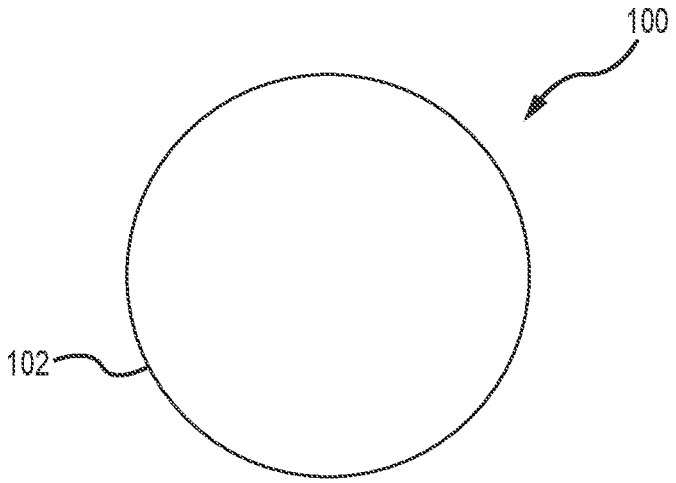
FIG. 6 is a top plan view of a cylindrical mandrel according to one embodiment of the present invention.

Referring now to FIG. 6, the apparatus 89 may include a cylindrical mandrel 100 that is inserted into the chamber 52 of a threaded closure 44 when threads 42 are formed on a metallic container 4. The exterior surface 102 of the cylindrical mandrel 100 provides support to the threaded closure 44 and the metallic container 4 when the apparatus 89 forms the threads 42 on the metallic container 4. After forming the container threads 42, the cylindrical mandrel 100 is removed from the chamber 52. The exterior surface 102 of the cylindrical mandrel may be smooth or have any other external geometry adapted to provide support to the interior surface 51 of a chamber 52 of a threaded closure 44 of any geometry. For example, the exterior surface 102 can have an arcuate shape, a faceted shape, or any other shape known to those of skill in the art.

Figure 7A:
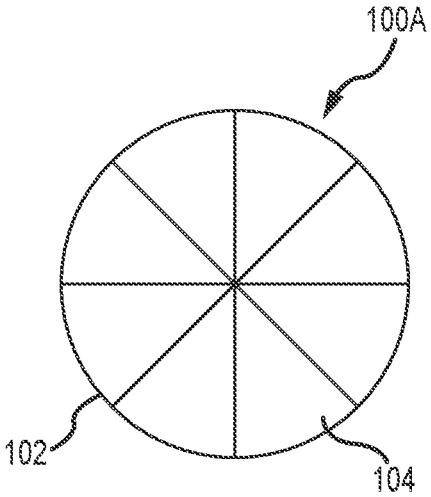
FIGS. 7A-7B are top plan views of another embodiment of a cylindrical mandrel of the present invention.
Figure 7B:
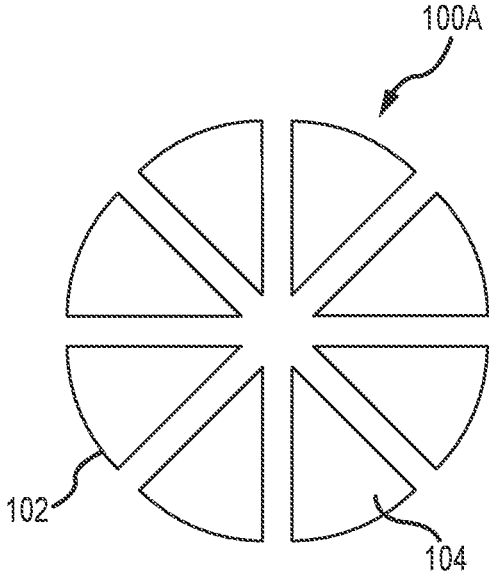

The apparatus 89 may also include a mandrel with a variable diameter that may be inserted into the chamber 52 of a threaded closure 44. Referring now to FIGS. 7A-7B, in one embodiment, the variable diameter mandrel 100A is formed of a plurality of individual sections 104 that can be moved inwardly and outwardly in a manner similar to a collet. The mandrel 100A is inserted into a chamber 52 of a threaded closure 44 with the sections 104 retracted to reduce the exterior diameter of the mandrel 100A as illustrated in FIG. 7A. The sections 104 of the mandrel 100A move outwardly to expand the exterior diameter of the cylindrical mandrel 100A as illustrated in FIG. 7B so that the exterior surfaces 102 of the sections 104 of the mandrel 100A contact the interior surface 51 of the chamber 52 of the threaded closure 44. After the container threads 42 are formed, the sections 104 move inwardly and the mandrel 100A is removed from the chamber 52 of the threaded closure 44. Although the mandrel 100A is illustrated with eight sections 104, the mandrel 100A could have more or fewer sections 104. It is expressly contemplated that number, sizes, shapes, and alignments of the sections 104 of the mandrel 100A may be varied and still comport with the scope and spirit of the present disclosure. For example, in one embodiment, the mandrel has four sections that are generally pie shaped. In another embodiment, the mandrel 100A has sections that have an arcuate shape. In still another embodiment, the mandrel 100A has six sections. In another embodiment (not illustrated), the variable diameter mandrel is inflatable. The inflatable mandrel is positioned within the chamber 52 in a deflated state. The inflatable mandrel is then filled with a compressed gas or a liquid to expand to a predetermined size in contact with the interior surface 51 of the chamber. After the container threads 42 are formed, the gas or liquid is removed and the inflatable mandrel retracts for removal from the chamber 52.

Figure 8A:
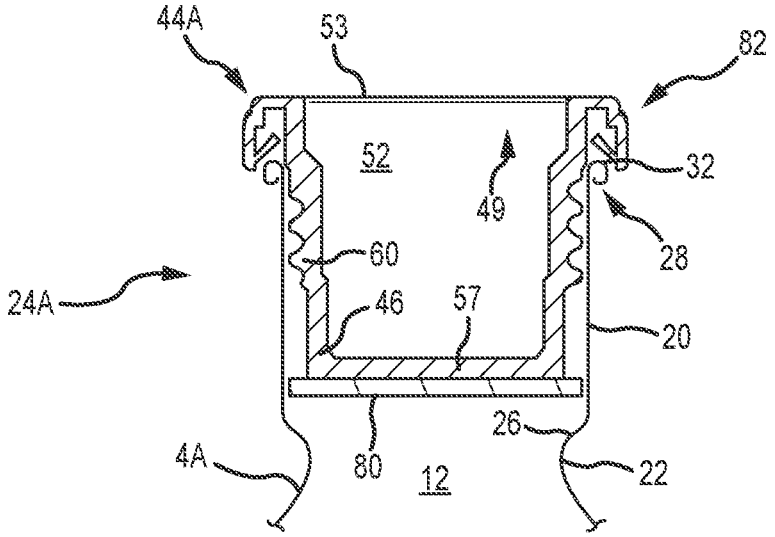
FIG. 8A is a partially fragmented cross-sectional front elevation view of a threaded closure partially inserted into a bore of an unthreaded metallic container according to another embodiment of the present invention with a liner interconnected to a body of the threaded closure.
Figure 8B:
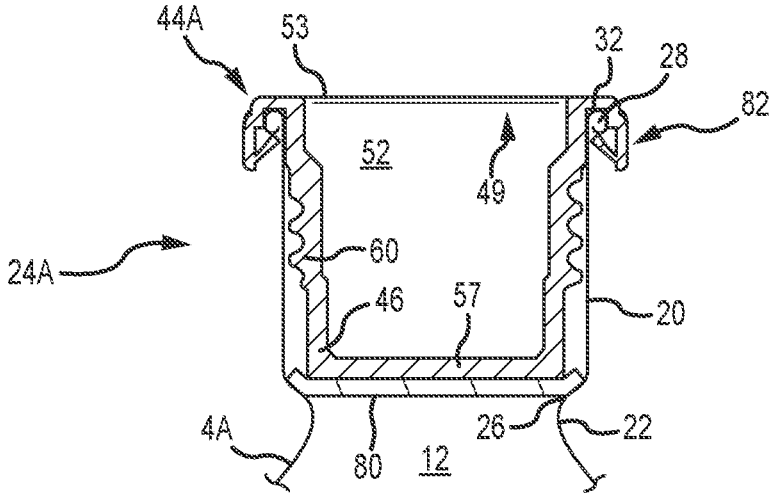
FIG. 8B is a partially fragmented cross-sectional front elevation view of the threaded closure and unthreaded metallic container of FIG. 8A with the threaded closure fully inserted in the bore of the metallic container and the liner of the threaded closure contacting an interior surface of an annular ring of the metallic container.
Figure 8C:
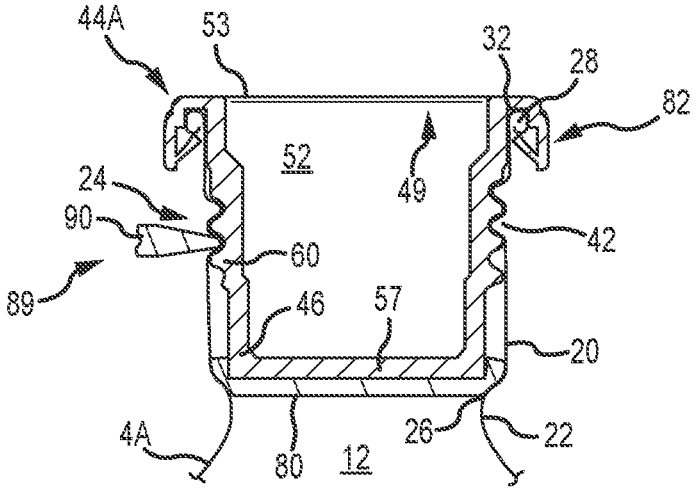
FIG. 8C is a partially fragmented cross-sectional front elevation view of the threaded closure and metallic container of FIG. 8B and associated tools used to form threads on the metallic container wherein as the container threads are formed, a bottom portion of the closure body is drawn axially downward toward the annular ring of the metallic container and the liner of the threaded closure is deformed and compressed to form a seal between the threaded closure and the metallic container.

Referring now to FIGS. 8A-8C, partial cross-sectional views of a threaded closure 44A and a metallic container 4A of another embodiment of the present invention are illustrated. The metallic container 4A is unthreaded and includes a pre-formed annular ring 22 having a decreased diameter. The annular ring 22 may be formed by the apparatus 89.

The threaded closure 44A includes a liner 80 interconnected to the closure body 46. The liner 80 has a predetermined size that is larger than the diameter of the body 46 and larger than the interior diameter of the annular ring 22. In one embodiment, the liner 80 is a disc that is blanked from a sheet of liner material. In another embodiment, the liner 80 is ring shaped with a hole that is substantially centered. In still another embodiment, the liner 80 is adhered a bottom portion 57 or a side surface of the closure body 46. The liner 80 may be formed of any material that is at least partially flexible and compressible and that is substantially impervious to $CO_2$ or $O_2$. In one embodiment, the liner 80 is formed of a material that absorbs $CO_2$ and/or $O_2$. In another embodiment, the liner 80 is formed of one or more of metal, rubber, plastic, and cork, and combinations thereof.

Referring now to FIG. 8B, as the threaded closure 44A is inserted into a bore 12 of the unthreaded metallic container 4A, a portion of the liner 80 contacts an interior surface 26 of the annular ring 22 of the metallic container 4A. The interior surface 26 compresses and deflects the liner 80 upwards. Referring now to FIG. 8C, as the apparatus 89 forms threads 42 on the metallic container 4A, the distance between the top 32 of the curl 28 to the annular ring 22 is decreased, drawing the bottom portion 57 of the closure body 46 axially downward toward the interior surface 26 of the annular ring 22. As a result of the contact between the bottom portion 57 of the closure body 46 and the interior surface 26, a portion of the liner 80 is deformed and compressed between the closure body 46 and the interior surface 26 forming a seal to prevent venting of the contents of the metallic container 4A and/or transmission of $CO_2$ or $O_2$ into, or out of, the interior of the metallic container 4A. The liner 80 may also prevent transmission of $CO_2$ and/or $O_2$ through the body 46 of the closure, increasing the shelf-life of the product sealed within the metallic container 4A without changing the material used to form the threaded closure 44A.

The liner 80 is further operable to allow a controlled release of pressure from within the metallic container 4A as the threaded closure 44A is removed from the bore 12. As the threaded closure 44A is rotated, a gap is formed between the liner 80 and the interior surface 26 of the metallic container 4 before the closure threads 60 lose thread engagement with the container threads 42. In this manner, pressure is released from within the metallic container 4A and escapes between the threaded closure 44A and the metallic container 4A preventing the uncontrolled expulsion of the threaded closure 44A from the bore 12. Additionally, or alternatively, in one embodiment, the liner 80 is not axisymmetric as described above in conjunction with FIG. 5A. In another embodiment, the annular ring 22 is not axisymmetric, as illustrated in FIG. 33B. If the threaded closure 44A is removed from the metallic container 4A, the liner 80 is operable to re-seal the metallic container 4A when the threaded closure 44A is screwed back into the bore 12 of the metallic container 4A.

The threaded closure 44A includes a chamber 52 with an aperture 49 that has been sealed by an optional cover 53. The cover 53 keeps the chamber 52 sanitary and free of contamination. The cover 53 may be made of paper, cardboard, metallic foil, or plastic, or combinations thereof. The cover 53 may be interconnected to the threaded closure 44A by induction or any other method. In one embodiment, the cover 53 is hingedly interconnected to the threaded closure 44A and the cover 53 may be lifted to allow access to the chamber 52 and lowered to reseal or reclose the chamber 52. In another embodiment, a portion of the cover 53 is permanently interconnected to the threaded closure 44A to retain the cover 53 to the threaded closure 44A to prevent litter. Optionally, the chamber 52 may have an uncovered aperture 49.

Figure 9A:
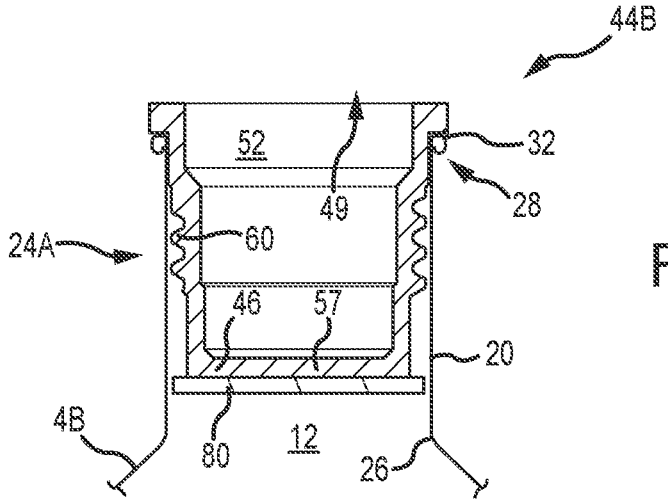
FIG. 9A is a partially fragmented cross-sectional front elevation view of a threaded closure and unthreaded metallic container according to still another embodiment of the present invention, and illustrating a liner interconnected to the threaded closure body.
Figure 9B:
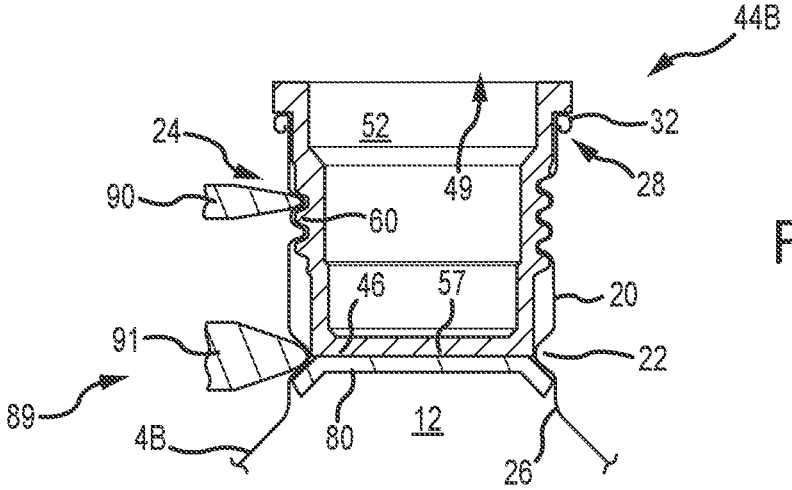
FIG. 9B is a partially fragmented cross-sectional front elevation view of the threaded closure and metallic container of FIG. 9A illustrating a thread roller forming threads on the metallic container and a pilfer roller forming an annular ring on the metallic container, wherein the interior surface of the metallic container contacts and at least partially compresses the liner to form a seal between the threaded closure and the metallic container.
Figure 9C:
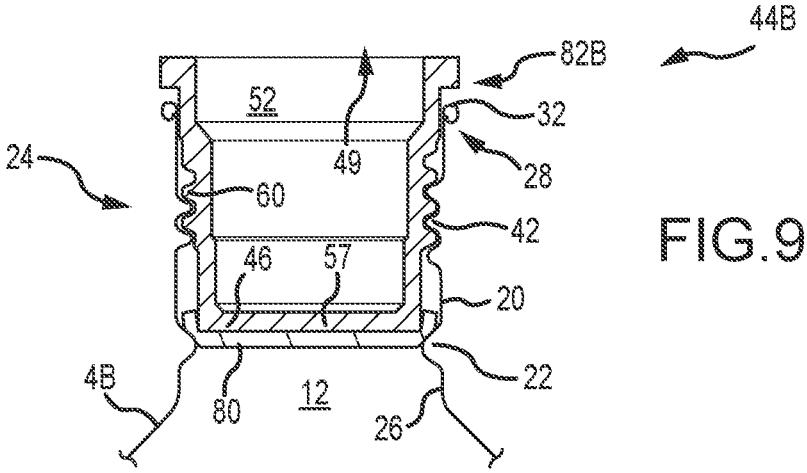
FIG. 9C is a partially fragmented cross-sectional front elevation view of the threaded closure and metallic container of FIG. 9B after the threaded closure has been at least partially removed from the metallic container and illustrating contact between the threaded closure liner and the annular ring preventing further movement of the threaded closure into the bore of the metallic container after contact between the liner and the annular ring has resealed the metallic container.

Referring now to FIGS. 9A-9C, partial cross-sectional views of a threaded closure 44B and a metallic container 4B of another embodiment of the present invention are illustrated. The threaded closure 44B includes a liner 80 interconnected to a body 46B of the threaded closure 44B that is the same as, or similar to, the liner 80 interconnected to the threaded closure 44A. In one embodiment, the liner 80 is interconnected to a bottom portion 57 of the threaded closure 44B.

After the metallic container 4B is filled with a product, the apparatus 89 inserts the threaded closure 44B into the bore 12 as illustrated in FIG. 9B. Container threads 42 are then formed in metallic container 4B by, for example, a thread roller 90 of the apparatus 89 as previously described. A pilfer roller 91 also forms an annular ring 22 in a portion of the neck 20 of the metallic container 4B proximate to the bottom portion 57 of the threaded closure 44B. An interior surface 26 of the neck 20 proximate the annular ring 22 contacts and at least partially compresses the liner 80. A portion of the liner 80 is deformed downwardly further into the bore 12 below the annular ring 22. In one embodiment, the annular ring 22 is formed after the container threads 42 are formed.

The contact between the liner 80 and the interior surface 26 of the annular ring 22 seals the bore 12 of the metallic container, preventing release of the contents of the metallic container 4B and/or transmission of $CO_2$ or $O_2$ into, or out of, the interior of the metallic container 4B. Additionally, the pressure within the metallic container 4B may apply a force to the product side of the liner 80, pressing the liner 80 upwardly against the annular ring 22 to improve the seal between the threaded closure 44B and the metallic container 4B. In one embodiment, the size and shape of the annular ring 22 and the material of the liner 80 may be selected to resist the pressure of the contents of the metallic container 4B. Said another way, the contact of the liner 80 and the interior surface 26 of the metallic container 4B may resist the pressure within the metallic container 4B and prevent inadvertent and unintended expulsion of the threaded closure 44B from the bore 12. Thus, the number of threads and/or the thread wrap of the threads 42, 60 may be reduced. In one embodiment, a threaded closure 44B with a liner 80 may include only a single thread wrap to seal a metallic container 4B and prevent unintended expulsion of the threaded closure 44B.

To open the metallic container, a consumer applies a rotational force to the threaded closure 44B. As the threaded closure 44B is rotated, contact with the annular ring 22 deflects the liner 80 radially inwardly allowing the liner 80 to move upwardly past the annular ring 22. This movement releases the seal and allows a controlled release of pressure from within the interior of the metallic container 4B before thread engagement between the container threads 42 and the closure threads 60 is lost. Additionally, or alternatively, in one embodiment, the liner 80 is not axisymmetric as described above in conjunction with FIG. 5A. In another embodiment, the annular ring 22 is not axisymmetric. Accordingly, an initial controlled release of pressure from within the metallic container 4B at a predetermined location.

Referring now to FIG. 9C, after the threaded closure 44B has been removed from the metallic container 4B, the threaded closure 44B may be used to reclose the metallic container 4B. However, the interior surface 26 of the annular ring 22 prevents the downward movement of the liner 80 and thus the threaded closure 44B cannot be fully rotated into the bore 12 to the position illustrated in FIG. 9B. The threaded closure 44B therefore projects at least slightly above the upper surface 32 of the curl 28 of the metallic container 4B forming a tamper indicator 82B to indicate that the threaded closure 44B has been at least partially unthreaded from the container threads 42.

Figure 10:
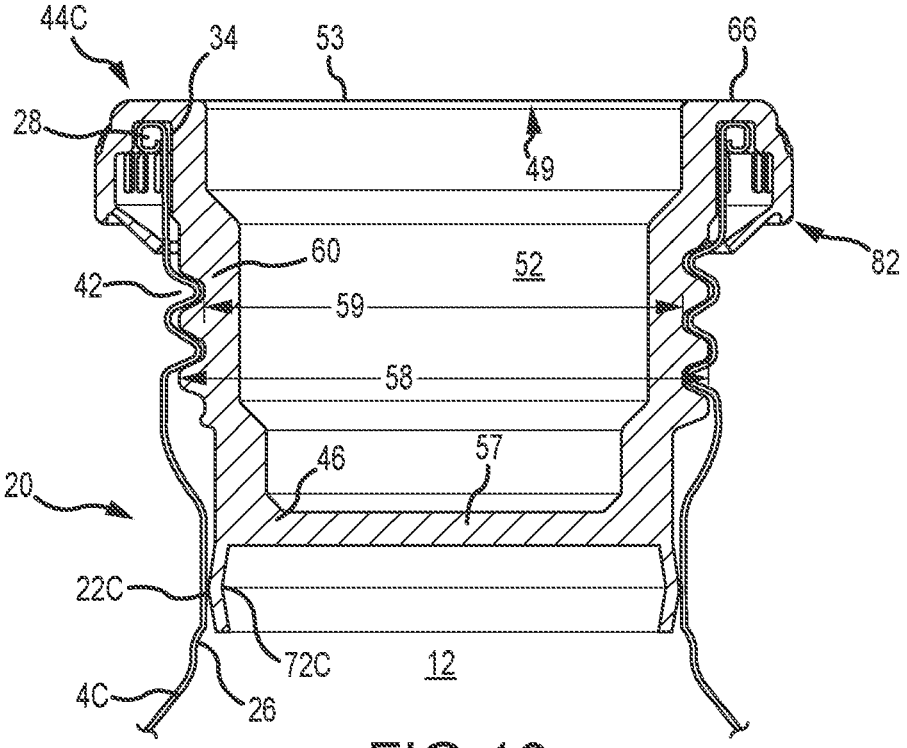
FIG. 10 is a partially fragmented cross-sectional front elevation view of yet another embodiment of a metallic container and a threaded closure of the present invention with a plug seal formed on a lower portion of the body of the threaded closure.

Referring now to FIG. 10, still another embodiment of a threaded closure 44C of the present invention is illustrated sealing another embodiment of a metallic container 4C. The threaded closure 44C includes a plug seal 72C formed on the closure body 46. The plug seal 72C is adapted to contact an interior surface 26 of the neck 20 below the curl 28. As illustrated in FIG. 10, the plug seal 72C comprises a ring extending downwardly from a lower surface of a bottom portion 57 of the closure body 46. The metallic container 4C includes an annular ring 22C on a portion of the neck portion 20 that may be formed before or after the threaded closure 44C is inserted into the bore 12. The plug seal 72C has an exterior surface that makes sealing contact with an interior surface 26 of the annular ring 22C. Pressure within the metallic container 4C presses the exterior surface of the plug seal 72C radially outwardly against the interior surface 26 of the annular ring 22C to increase the force of the sealing contact. In one embodiment, the plug seal 72C is adapted to be flexible. In another embodiment, the plug seal 72C is formed of a different material than the closure body 46 and is interconnected to the threaded closure 44C. In yet another embodiment, additionally or alternatively, at least one of the plug seal 72C and the annular ring 22C is not axisymmetric. Thus, as described above in conjunction with FIG. 5A, when the threaded closure 44C is rotated, pressure from within the metallic bottle 4C may be released at a predetermined location. In still another embodiment, a first plug seal 72 (illustrated in FIG. 5A) may be formed on the extension 66 and a second plug seal 72C may be formed on the closure body 46. The first plug seal 72 may contact the interior surface 34 of the curl 28, and the second plug seal 72C may contact the interior surface 26 of the neck 20 below the curl 28.

Figure 11:
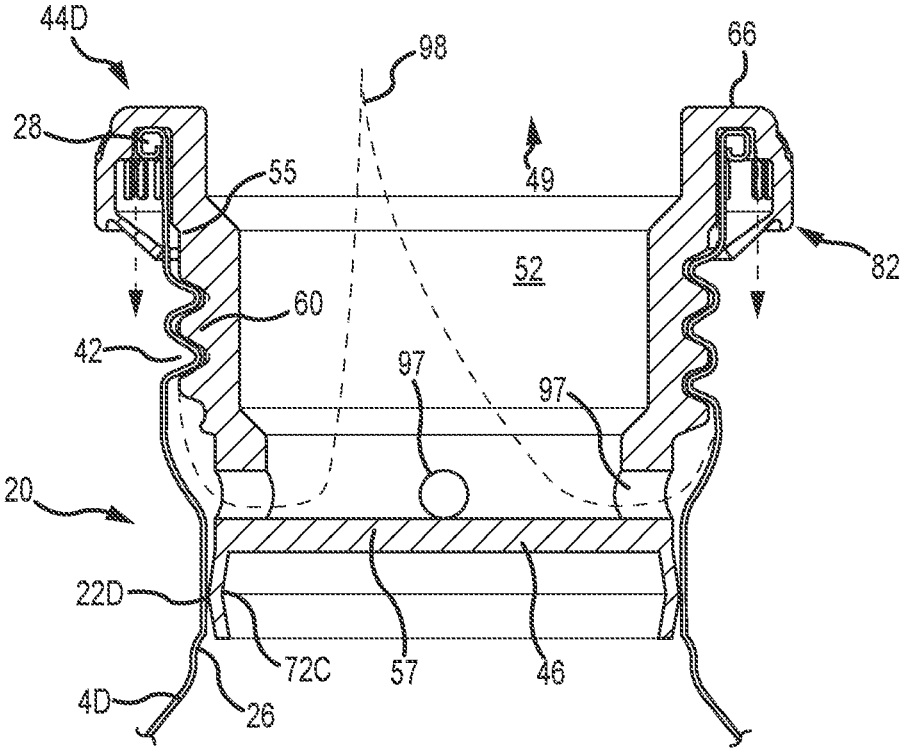
FIG. 11 is a partially fragmented cross-sectional front elevation view of a metallic container and a threaded closure of still another embodiment of the present invention with apertures formed through a side portion of the threaded closure body and illustrating a solution flowing through the apertures to clean a space between the interior surface of the metallic container and the exterior surface of the threaded closure.

Referring now to FIG. 11, a metallic container 4D and a threaded closure 44D of another embodiment of the present invention are illustrated. The threaded closure 44D includes a chamber 52 with an upper aperture 49 that is open and a plug seal 72C formed on the closure body 46. The plug seal 72C contacts an interior surface 26 of an annular ring 22D that may be formed by the apparatus before or after the threaded closure 44D is inserted into the bore 12 of the metallic container 4D. Apertures 97 are formed through the closure body 46.

When the metallic container 4D is filled with a product, the product may contact the interior surface of the neck 20 and become trapped between the closure threads 60 and the container threads 42. If not removed, the trapped product may spoil or contaminate the product sealed in the metallic container 4D. To remove the trapped product, the apparatus 89 includes a tool to direct a sterile cleaning solution 98, such as water, into the chamber 52 after the apparatus 89 inserts the threaded closure 44D into the bore 12 of the metallic container 4D. The apertures 97 enable the cleaning solution 98 to flow from the chamber 52 and up between the closure threads 60 and the container threads 42. In this manner, the cleaning solution 98 can remove any product unintentionally trapped between the threads 42, 60. Additionally, the apparatus 89 may include a tool to force air or another gas to blow out the cleaning solution 98 and dry the space between the threads 42, 60.

Optionally, in one embodiment of the present invention, holes, cuts, or slots may be formed radially through at least a portion of the curl 28 to allow the cleaning solution 98 and air to enter or exit the unthreaded region 55 above the threads 42, 60. Additionally, in another embodiment, thread channels 96 (illustrated in FIG. 3), may be formed on the closure body 46 to allow the cleaning solution 98 and air to move between the threads 42, 60. In still another embodiment, the extension 66 of threaded closure 44D may be formed without seals 68, 70, or 72 to create a path for the cleaning solution 98 and air to pass between the curl 28 and the interior surface of the extension 66. Further, although the cleaning solution 98 is illustrated in FIG. 11 flowing through the apertures 97 after the apparatus 89 has formed the container threads 42, in one embodiment the apparatus 89 removes the trapped product with the cleaning solution before the container threads 42 are formed.

Figure 12:
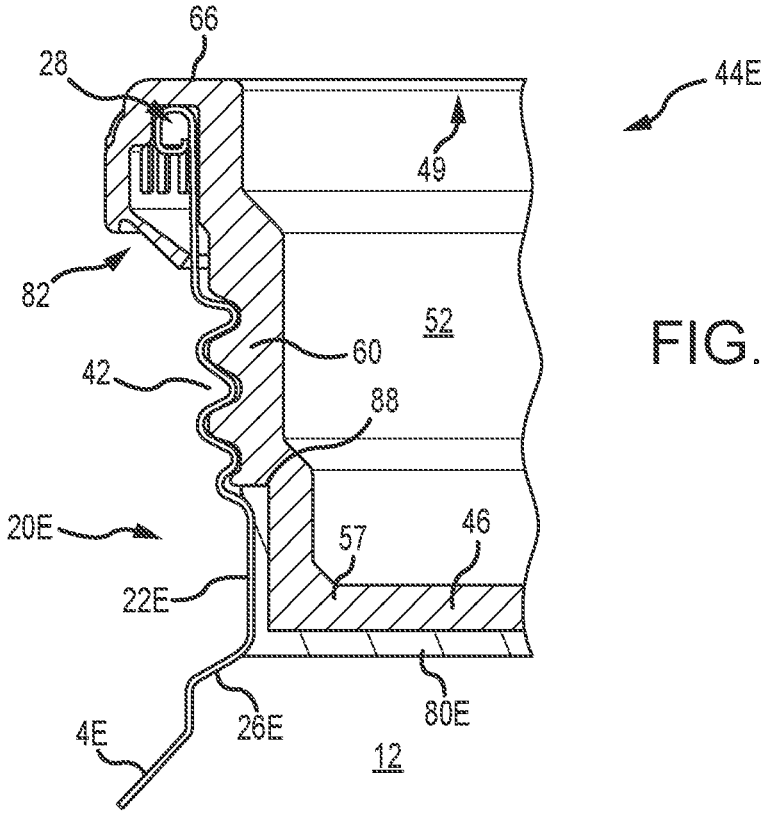
FIG. 12 is a partially fragmented cross-sectional front elevation view of a threaded closure with an exterior liner used to seal a metallic container with a preformed annular ring according to yet another embodiment of the present invention.
Figure 13:
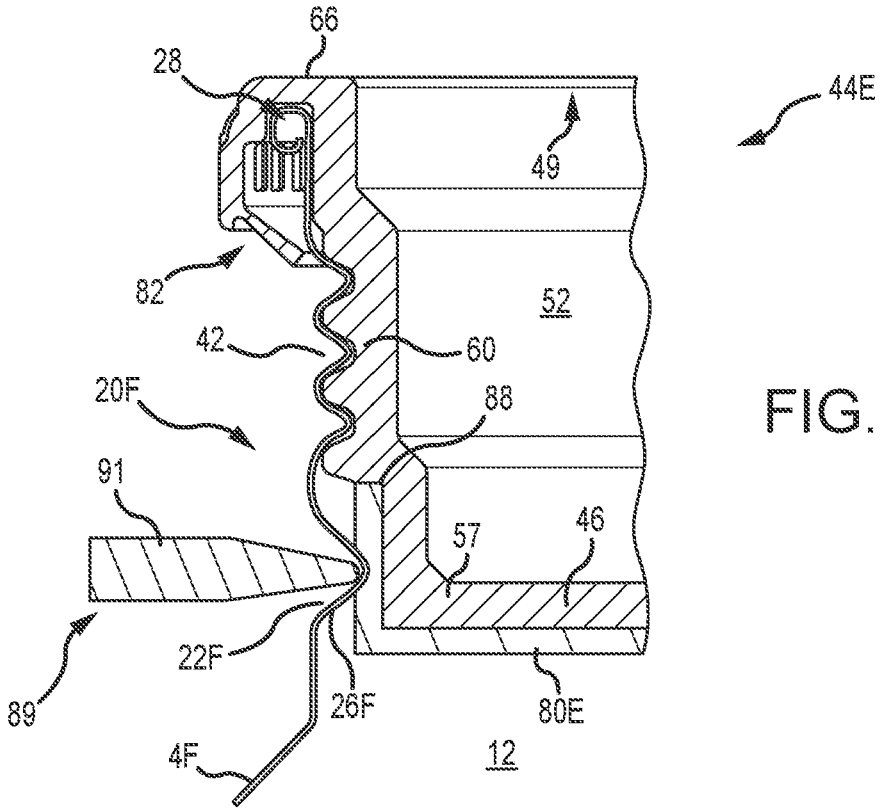
FIG. 13 is a partially fragmented cross-sectional front elevation view of the threaded closure of FIG. 12 used to seal a metallic container according to yet another embodiment of the present invention and illustrating an annular ring formed on the neck of the metallic container after the threaded closure is inserted into the bore of the metallic container.

Referring now to FIGS. 12 and 13, a threaded closure 44E of one embodiment of the present invention is illustrated with an external liner 80E. In one embodiment, a recess 88 is formed on an exterior surface of the body 46 of the threaded closure 44E to receive the liner 80E. In another embodiment, the liner 80E is overmolded onto the body 46 of the threaded closure 44E. In another embodiment, the liner 80E is cup-shaped and is held in place on the body 46 by a friction fit. In still another embodiment, an adhesive is used to interconnect at least one of a bottom or a side surface of the liner 80E to the closure body 46. Although the liner 80E is illustrated in FIGS. 12 and 13 covering the lower surface of a bottom portion 57 of the body 46, it will be appreciated by those of skill in the art that the liner 80E need not completely cover the bottom portion 57 of the body 46. In one embodiment, the liner 80E is a band that is applied to an exterior circumference of the body 46 of the closure below the closure threads 60. The liner 80E is formed of a material that is at least partially compressible, substantially impervious to $CO_2$ or $O_2$, and is a different material than the material of the body 46 of the threaded closure 44E. The liner also prevents the transmission of $CO_2$ or $O_2$ through the body 46. The liner 80E may be formed of the same material as liner 80 illustrated in FIG. 8A.

Referring now to FIG. 12, the threaded closure 44E is operable to seal a metallic container 4E with a preformed annular ring 22E on the neck 20E. As the threaded closure 44E is inserted into the bore 12 of the metallic container 4E, a portion of the liner 80E contacts and is compressed by the interior surface 26E of the annular ring 22E forming a seal between the metallic container 4E and the threaded closure 44E. Alternatively, and referring now to FIG. 13, the threaded closure 44E is further operable to seal a metallic container 4F with an annular ring 22F formed by a tool of the apparatus 89 after the threaded closure 44E is inserted into the bore 12. In one embodiment, the annular ring 22F is formed by a pilfer roller 91. When the annular ring 22F is formed, a portion of the interior surface 26F contacts and compresses the liner 80E to form a seal between the metallic container 4F and the threaded closure 44E. Optionally, in one embodiment, at least one of the liner 80E and the annular rings 22E, 22F are not axisymmetric and are adapted to allow a controlled release of pressure from the metallic bottle, as described above in conjunction with FIG. 5A.

Referring now to FIGS. 14 and 15, threaded closures 44F and 44G including gas permeation barriers 74, 76 of embodiments of the present invention are illustrated. The gas permeation barriers 74, 76 prevent $CO_2$ and/or $O_2$ from migrating through the body 46 of threaded closures 44F, 44G formed of materials that are at least partially permeable to $CO_2$ and $O_2$. Gas permeation barrier 74 comprises a material that is injected into a portion of the body 46 when the threaded closure 44F is formed. Gas permeation barrier 76 is applied to at least one of the interior 51 and the exterior surfaces of the body 46 of the threaded closure 44G. The gas permeation barriers 74, 76 increase the shelf-life of a product sealed in the metallic container 4 by increasing the amount of time required for the product to go flat or become oxidized.

The gas permeation barriers 74, 76 may be formed of any material that creates a barrier to keep $O_2$ out of, and $CO_2$ in, the interior of a metallic container 4. In one embodiment of the present invention, gas permeation barrier 76 is a silicon oxide material applied using a plasma coating process. In another embodiment, gas permeation barrier 76 is a liquid that is applied to the threaded closure 44G. In yet another embodiment, gas permeation barrier 76A, 76B is a film applied to the threaded closure 44G. In still another embodiment, gas permeation barriers 74, 76 are formed of a silicon oxide material. In one embodiment, the material of the gas permeation barriers 74, 76 scavenges or absorbs $CO_2$ and/or $O_2$.

FIGS. 14 and 15 also illustrate plug seals 72F, 72G formed on the exterior surface of the closure body 46 of the threaded closures 44F, 44G. The plug seals 72F, 72G are adapted to contact an interior surface 26 of the neck 20 of a metallic container (not illustrated) below the closure threads 60. The contact between the plug seals 72F, 72G and the interior surface 26 of the neck 20 form a seal between the threaded closure 44F, 44G and the metallic container. In one embodiment, the plug seals 72F, 72G are formed of a different material than the closure body 46 and are interconnected to the threaded closure 44F, 44G. In another embodiment, the protrusion plug seals 72F, 72G are not axisymmetric. Thus, as described above in conjunction with FIG. 5A, when the threaded closure 44C is rotated, pressure from within the metallic bottle 4C may be released at a predetermined location. In still another embodiment, a plug seal 72 (illustrated in FIG. 5A) may be formed on the extension 66 and form a seal between the metallic container and the threaded closure in addition to the seal formed by the plug seals 72F, 72G. The plug seal 72 may contact the interior surface 34 of the curl 28, and the plug seals 72F, 72G may contact the interior surface 26 of the neck 20 below the closure threads 60.

Figure 16A:
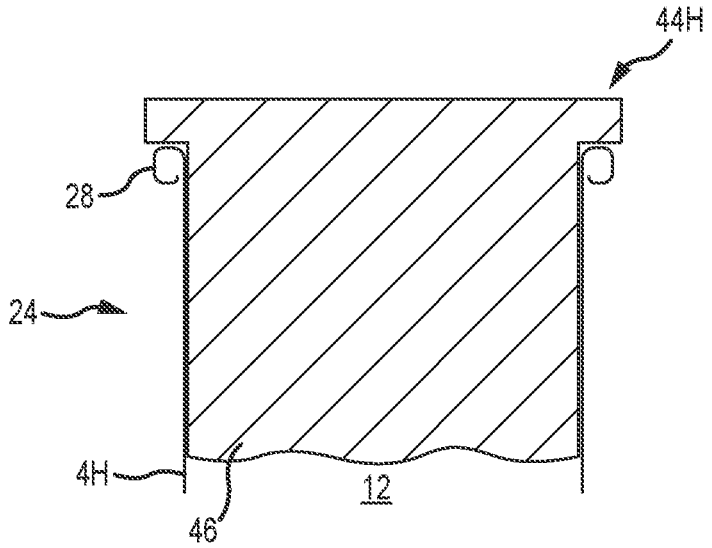
FIG. 16A is a partially fragmented cross-sectional front elevation view of a closure with an unthreaded body inserted in the bore of an unthreaded metallic container of yet another embodiment of the present invention.
Figure 16B:
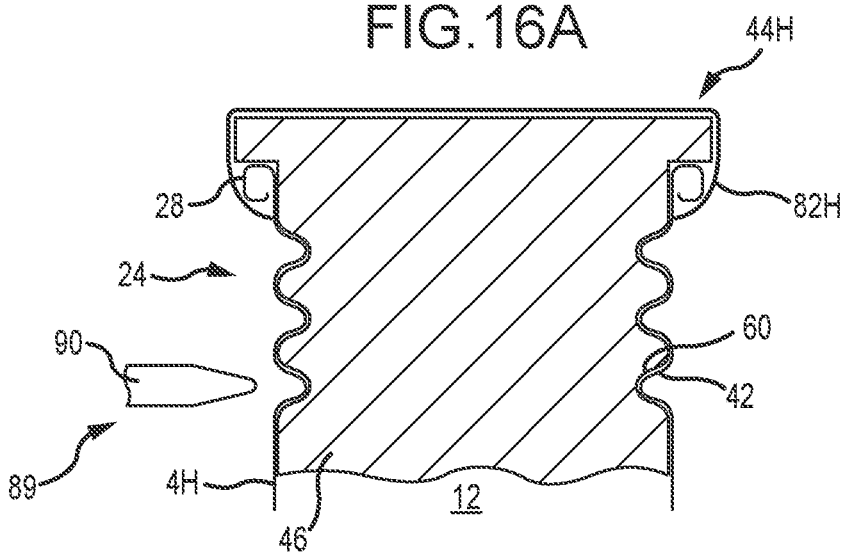
FIG. 16B is a partially fragmented cross-sectional front elevation view of the closure and the metallic container of FIG. 16A and associated tools used to simultaneously form threads on the metallic container and the closure and further illustrating a tamper indicator of an embodiment of the present invention.
Figure 16C:
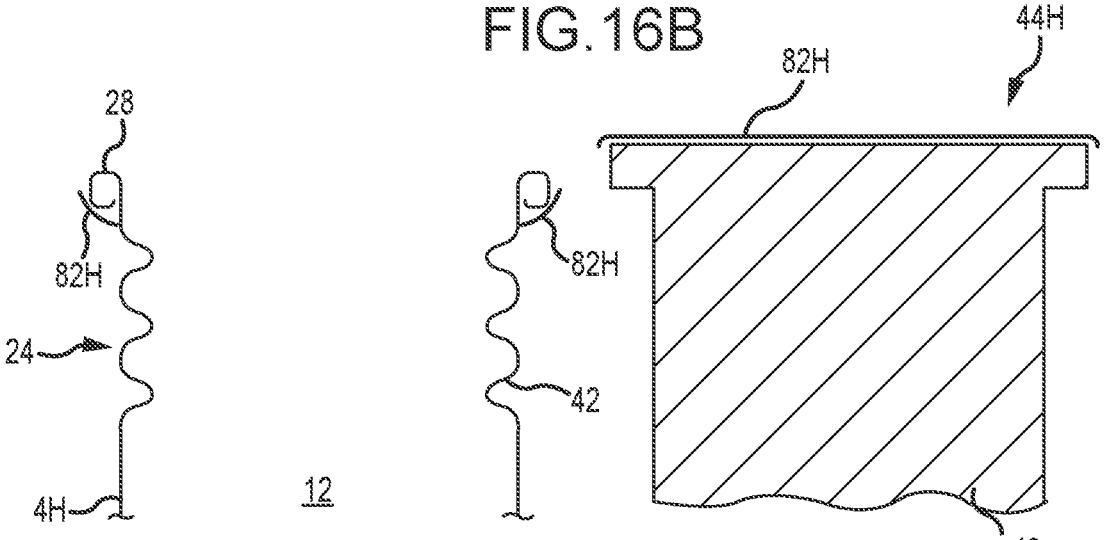
FIG. 16C is a partially fragmented cross-sectional front elevation view of the closure and the metallic container of FIG. 16B and illustrating that the tamper indicator is visibly altered after the closure is removed from the metallic container.

Referring now to FIGS. 16A-16C, still another embodiment of a closure 44H and a metallic container 4H of the present invention are illustrated. Closure 44H has an unthreaded body 46 formed of a material that is at least partially compressible. In one embodiment, the body 46 is formed of a rubber, plastic, cork or a synthetic cork-type material. As shown in FIG. 16A, the closure 44H is inserted into the bore 12 of the metallic container 4H. Referring now to FIG. 16B, threads 42, 60 are simultaneously formed on the metallic container 4H and the closure 44H creating a seal between the metallic container 4H and the closure 44H. In one embodiment, a thread roller 90 of the apparatus 89 presses against the exterior of the metallic container 4H and is driven downwardly to form the container threads 42 and closure threads 60 with a predetermined thread pitch. The apparatus 89 can alter the position of the thread roller 90 to create threads 42, 60 of a desired pitch. Optionally, the apparatus 89 may apply a tamper indicator 82H to the closure 44H and the metallic container 4H. The tamper indicator 82H comprises a strip with at least a first portion interconnected to the closure 44H and a second portion interconnected to at least the curl 28 of the metallic container 4H. In one embodiment of the present invention, the strip of the tamper indicator 82H is formed of shrink film, wax, metallic foil, paper, or paint.

Referring now to FIG. 16C, when the closure 44H is rotated to open the metallic container 4H, the tamper indicator 82H is visibly altered indicating that the closure 44H has been at least partially removed from the metallic container 4H. In one embodiment, the tamper indicator 82H is at least partially damaged. When the closure 44H is removed from the bore 12 of the metallic container 4H, the body 46 of the closure 44H may rebound and the closure 44H may not be reused in the metallic container 4H. In another embodiment, the body 46 of the closure is formed of a material that has a shape memory and the body 46 retains full or partial threads 60 when the closure 44H is removed from the metallic container 4H. In one embodiment, when the closure 44H is removed from the metallic container 4H, portions of the tamper indicator 82H remain interconnected to both the closure 44H and the metallic container 4H.

Figure 17:
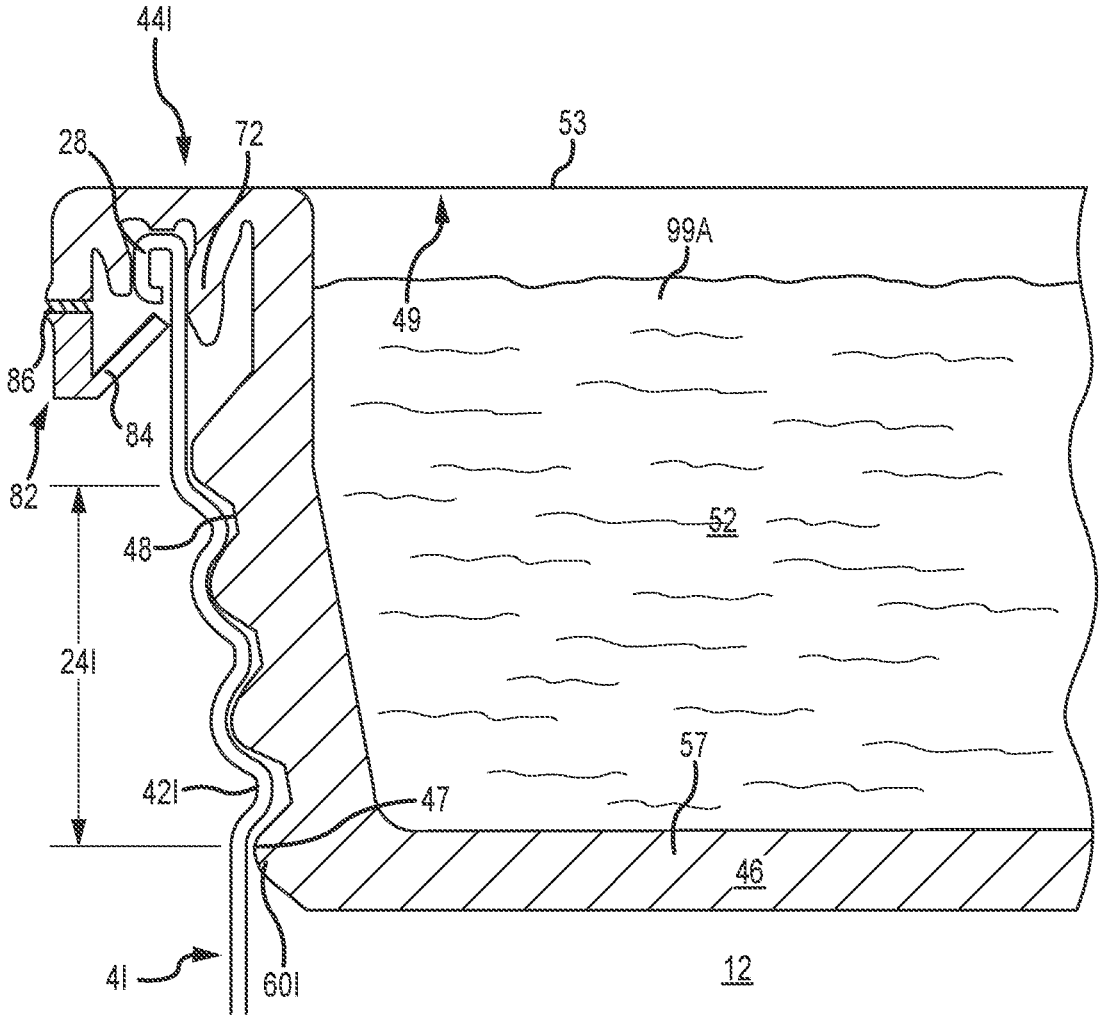
FIG. 17 is a partially fragmented cross-sectional front elevation view of a tapered threaded closure threadably engaged with a tapered thread region of a metallic container according to still another embodiment of the present invention and further illustrating a product sealed in a chamber of the threaded closure.

Referring now to FIG. 17, a metallic container 4I with a tapered thread region 24I and tapered threaded closure 44I according to an alternative embodiment of the present invention are illustrated. The tapered thread region 24I generally has a conical shape, but other geometries and shapes could be used as will be appreciated by one skilled in the art. The threaded closure 44I has a tapered shape with a geometry substantially matching the taper of the tapered thread region 24I. The exterior diameter of a thread peak 47 near the bottom portion 57 of the threaded closure 44I is substantially equal to the diameter of a thread valley 48 near the top of the closure threads 60I. In one embodiment, the exterior diameter of the thread peak 47 is less than the diameter of the thread valley 48. It will be appreciated by one of skill in the art that the amount of the taper of the metallic container 4I and the threaded closure 44I have been exaggerated in FIG. 17 for illustration purposes.

The tapered thread region 24I allows a consumer to quickly remove the closure 44I from the metallic container 4I. For example, in a metallic container with a substantially straight threaded region, a threaded closure must typically be rotated a number of rotations equal to a number of thread revolutions around the thread region to remove the threaded closure from the bore of the metallic container. In a metallic container 4I with a tapered thread region 24I, when the threaded closure 44I is rotated to open the metallic container 4I, the tapered thread region 24I allows the closure threads 60I to lose thread engagement with the container threads 42I in fewer rotations than the number of thread revolutions. Stated otherwise, the closure threads 60I of the threaded closure 44I may lose thread engagement with the container threads 42I after approximately one rotation of the threaded closure 44I. Thus, in this embodiment, multiple thread revolutions may be provided in the metallic container 4I and the threaded closure 44I for a secure seal without requiring the consumer to rotate the threaded closure 44I an equal number of rotations to release the threaded closure 44I.

FIG. 17 also illustrates a product 99A sealed in the chamber 52 of the threaded closure 44I. The product 99A may be a liquid, solid, or gas and can be accessed through the upper aperture 49 by removing the cover 53. The product 99A may be sealed in the chamber 52 before or after the threaded closure 44I is inserted in the bore 12 to seal the metallic container 4I.

Figure 18:
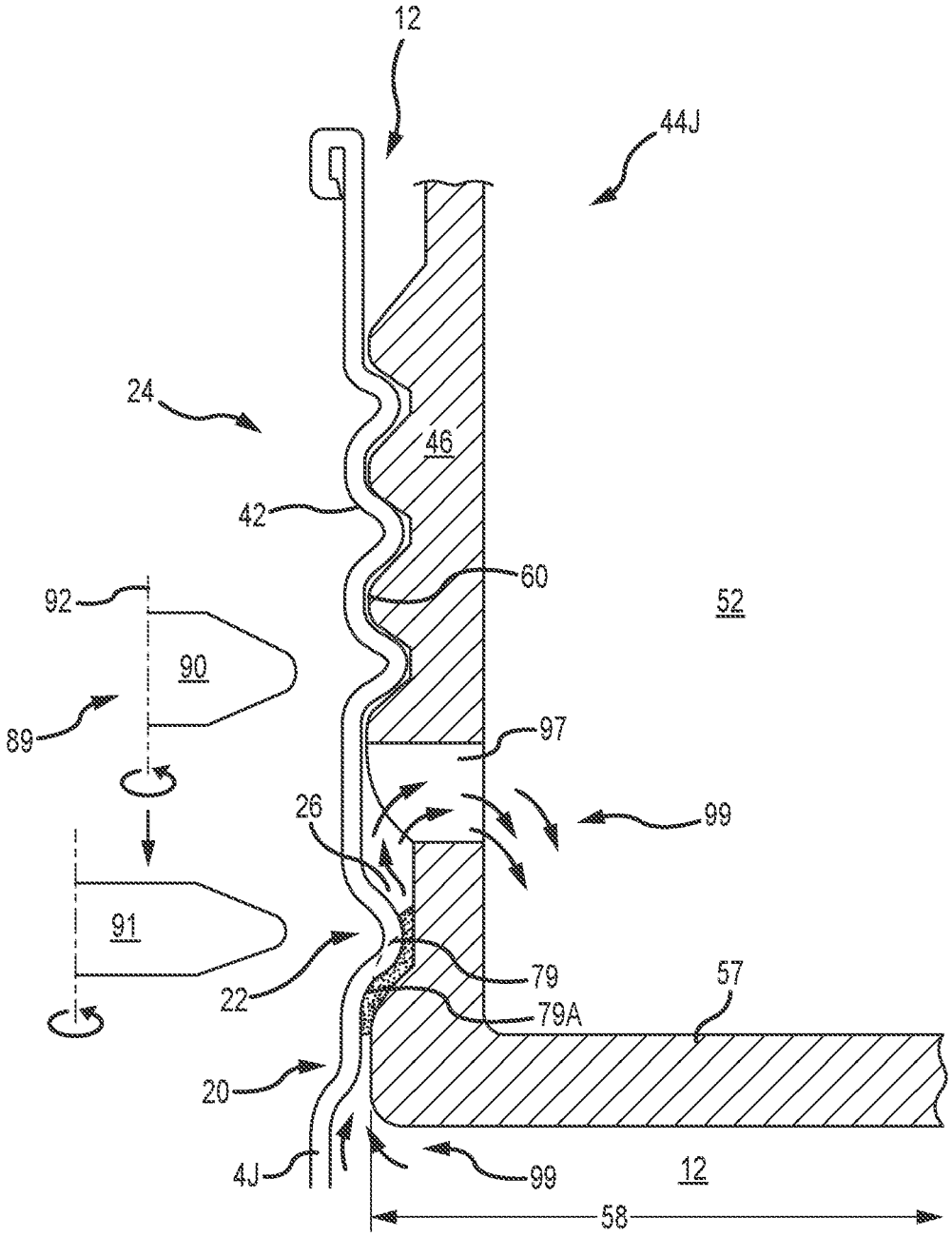
FIG. 18 is a partially fragmented cross-sectional front elevation view of a threaded closure threadably engaged with a metallic container and associated tools used to form threads and an annular ring on the metallic container according to yet another embodiment of the present invention.

Referring now to FIG. 18, a threaded closure 44J with a seal 79 below closure threads 60 according to one embodiment of the present invention is illustrated. Apertures 97 are formed through the closure body 46 beneath the closure threads 60. In one embodiment, the seal 79 may be a gasket, wad, or liquid sealant positioned on the threaded closure 44J or the interior surface 26 of a metallic container 4J beneath the apertures 97. The seal 79 is formed of a material that is substantially impervious to $CO_2$ and/or $O_2$. In another embodiment, a thin layer of a silicon oxide material covers the exterior surface of the closure. In this embodiment, the seal 79 is formed by contact between the interior surface an annular ring 22 formed on the metallic container 4J and the exterior surface of the threaded closure 44J. In another embodiment, the material of the seal 79 scavenges or absorbs $CO_2$ and/or $O_2$. In yet another embodiment, the seal 79 is formed of the same material as liner 80. In still another embodiment, the seal is formed by contact between a predetermined portion of the threaded closure 44J and the metallic container 4J.

After the metallic container 4J is filled with a product, the threaded closure 44J is inserted by the apparatus 89 in the bore 12 to a first position. The apparatus 89 forms threads 42 on the metallic container 4J as described above. Optionally, the threaded closure 44J and the metallic container 4J may have a lug thread 64 as illustrated in FIG. 4A. The apparatus 89 also forms an annular ring 22 in the metallic container 4J. In one embodiment, the apparatus 89 presses a pilfer roller 91 against the exterior surface of the neck 20 to form the annular ring 22. The interior surface 26 of the annular ring 22 contacts the seal 79, thereby compressing the seal 79A between the interior surface 26 and the threaded closure 44J. The annular ring 22 has an interior diameter less than the exterior diameter 58 of the threaded closure 44J, preventing the threaded closure 44J from being removed from the bore 12 of the metallic container 4J. Thus, similar to a stay on tab of a beverage can, the annular ring 22 prevents the threaded closure 44J from becoming litter. Further, because the annular ring 22 prevents removal of the threaded closure 44J from the metallic container 4J, the metallic container 4J can store products at a higher pressure than other containers having a bore with a similar diameter.

To release the compressed seal 79A, the consumer rotates the threaded closure 44J in a first direction moving the threaded closure 44J to a second position, deeper into the bore 12 such that the annular ring 22 does not contact the seal 79. The contents 99 of the metallic container 4J may then flow between the exterior surface of the threaded closure 44J and the interior surface 26 of the neck 20, through the apertures 97, and into the chamber 52 of the threaded closure 44J, as illustrated in FIG. 18. The consumer may then use the chamber 52 as a drinking cup to consume the contents from the chamber 52. The metallic container 4J may be resealed and/or reclosed by rotating the threaded closure 44J in a second direction, raising the seal 79 back into sealing contact with the annular ring 22 and compressing the seal 79A.

In one embodiment, after the metallic container 4J is sealed by threaded closure 44J, the space between the container threads 42 and the closure threads 60 may be cleaned by a cleaning solution when the threaded closure 44J is in the first position. Thus, in a method similar to the method described above in conjunction with FIG. 11, the cleaning solution may be poured into the chamber 52 of the threaded closure 44J. The cleaning solution can then flow upward between the threads 42, 60. Optionally, a second seal may be positioned higher on the body 46 of the threaded closure 44J above the apertures 97. The second seal may be formed of a compressible material that maintains sealing contact between the threaded closure 44J and the metallic container 4J when the threaded closure 44J is in the second position and the annular ring 22 does not contact the seal 79. In this manner, the second seal prevents the contents 99 of the metallic container 4J from flowing above the apertures 97 between the metallic container 4J and the threaded closure 44J.

Figure 19:
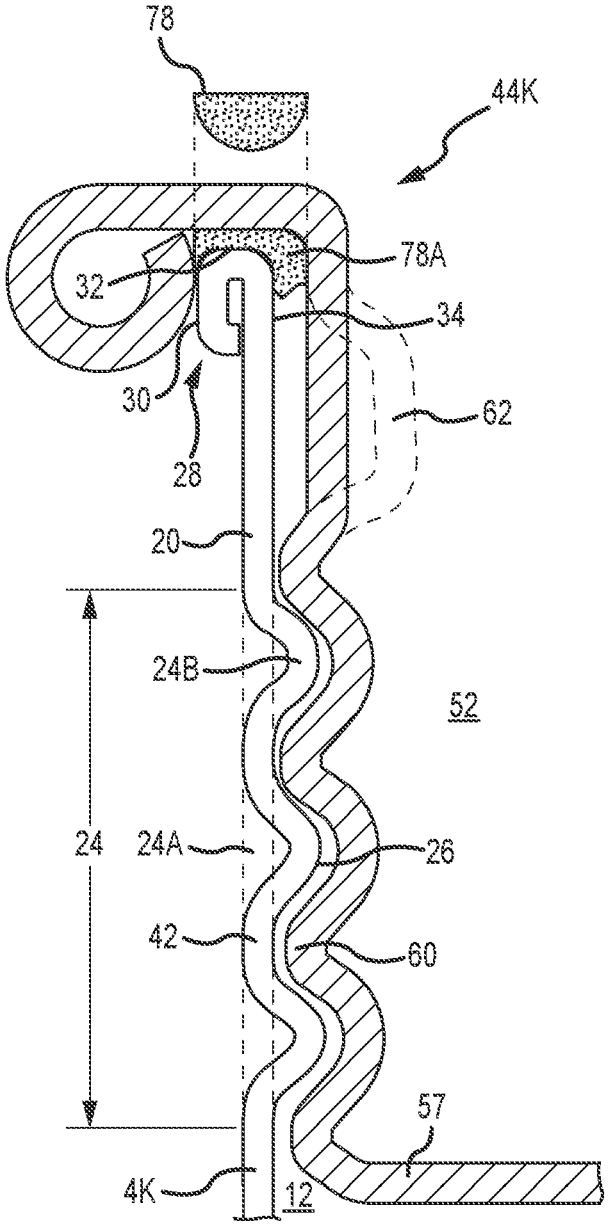
FIG. 19 is a partially fragmented cross-sectional front elevation view of a threaded closure threadably engaged with a neck of a metallic container according to one embodiment of the present invention and also illustrating an optional stiffening band in the threaded closure and a thread region of the metallic container before and after threads are formed on the metallic container.

Referring now to FIG. 19, a partial cross-sectional front elevation view of a metallic container 4K sealed by a threaded closure 44K according to one embodiment of the present invention is illustrated. A ring or bead of sealant 78 that is impervious to gases and liquids is used to replace one or more of the seals 68, 70, 72 of the threaded closure 44K. The sealant 78 is applied to the threaded closure 44K before insertion of the threaded closure 44K into the bore 12 of the metallic container 4. Optionally, the sealant 78 may be applied to the upper surface 32 of the curl 28.

When the apparatus 89 inserts the threaded closure 44K into the bore 12, the pressing block 93 (illustrated in FIG. 5A) can apply a top force to the threaded closure 44K to press the threaded closure 44K into the bore 12, compressing the sealant 78A between the threaded closure 44K and the upper surface 32 of the curl 28. The sealant 78A is deformed around the curl 28 to substantially fill the space between the threaded closure 44K and the curl 28, forming a seal between the metallic container 4 and the threaded closure 44K.

The sealant 78 may be similar to sealants used with crown closures and is well known to those of skill in the art. In one embodiment, the sealant 78 is a liquid sealant that can at least partially flow between the metallic container 4K and the threaded closure 44K and harden to create a seal. In another embodiment, the sealant 78 is a wad of a compressible material. In one embodiment, the sealant 78 may allow a small amount of gas to slowly escape from or enter the metallic container 4K. In still other embodiments, the seal between the metallic container 4K and a threaded closure 44K may be formed of a combination of one or more seals 68, 70, 72 and the sealant 78. In yet another embodiment, the sealant 78 is made of the same material as the liner 80 illustrated in FIG. 8A.

The thread region 24 of metallic container 4K is illustrated before 24A and after 24B the container threads 42 are formed. The threads 24B are formed by the apparatus 89 by any method described above in conjunction with FIG. 5. Although not illustrated in FIG. 19, an optional tamper indicator 82 as described above or other pilfer seals or tamper proof bands known in the art may be formed on the threaded closure 44K or the metallic container 4K.

FIG. 19 also illustrates an optional stiffening band 62 that may be formed in a threaded closure 44 in all embodiments of the present invention. The stiffening band 62 may be formed before or after the threaded closure 44K is inserted into the bore 12 of the metallic container 4K. In one embodiment, a second sealant material or a flexible gasket may optionally be positioned in the stiffening band 62 in sealing contact with the interior surface 26 of the neck 20 of the metallic container 4K.

Figure 20A:
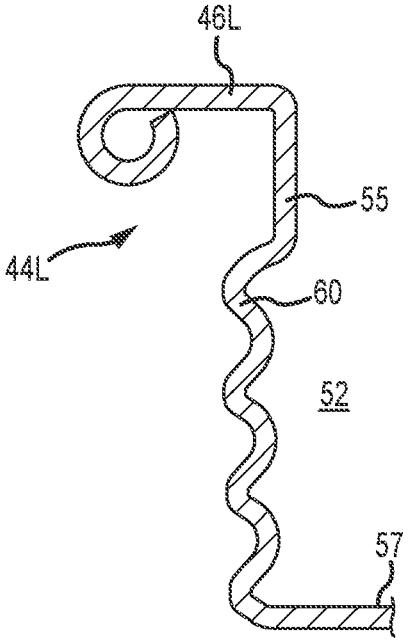
FIG. 20A illustrates a partially fragmented cross-sectional front elevation view of a portion of a threaded closure prior to insertion into a bore of a metallic container according to another embodiment of the present invention.
Figure 20B:
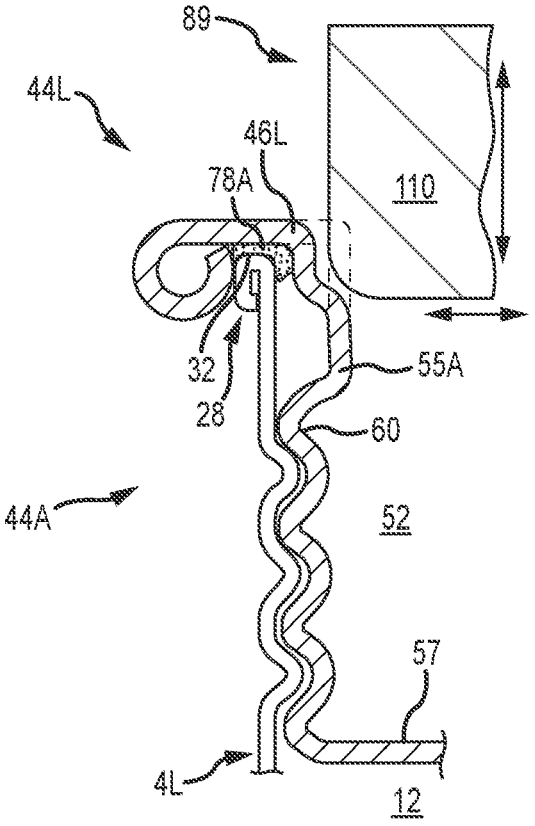
FIG. 20B illustrates the threaded closure of FIG. 20A and a mandrel used to reform the threaded closure after the threaded closure has been inserted into the bore of a metallic container according to another embodiment of the present invention.

Referring now to FIG. 20A, a threaded closure 44L according to one embodiment of the present invention is illustrated before the closure body 46L has been reformed during sealing of a metallic container 4L. The threaded closure 44L has an unthreaded region 55 above the closure threads 60. The threaded closure 44L is inserted into the bore 12 of the metallic container 4L by the apparatus 89 as illustrated in FIG. 20B. The apparatus 89 includes a mandrel 110 operable to move vertically up and down and/or radially left and right. The mandrel 110 is positioned at least partially in the chamber 52 of the threaded closure 44L. The mandrel 110 applies a force to the unthreaded region 55 of the closure body 46L, reforming the unthreaded region 55A to bring a portion of the closure body 46L into intimate contact with a sealant 78. The sealant 78A is compressed between the threaded closure 44L and the upper surface 32 of the curl 28 to substantially fill the space between the threaded closure 44L and the curl 28. In this manner, a seal is formed between the metallic container 4L and the threaded closure 44L. FIG. 20B illustrates the mandrel 110 according to one exemplary embodiment of the present invention. It is expressly contemplated that the size, shape, and geometry of the mandrel 110 may be varied to reform the unthreaded region 55 of threaded closures 44L to a predetermined geometry and still comport with the scope and spirit of the present invention.

Figure 21A:
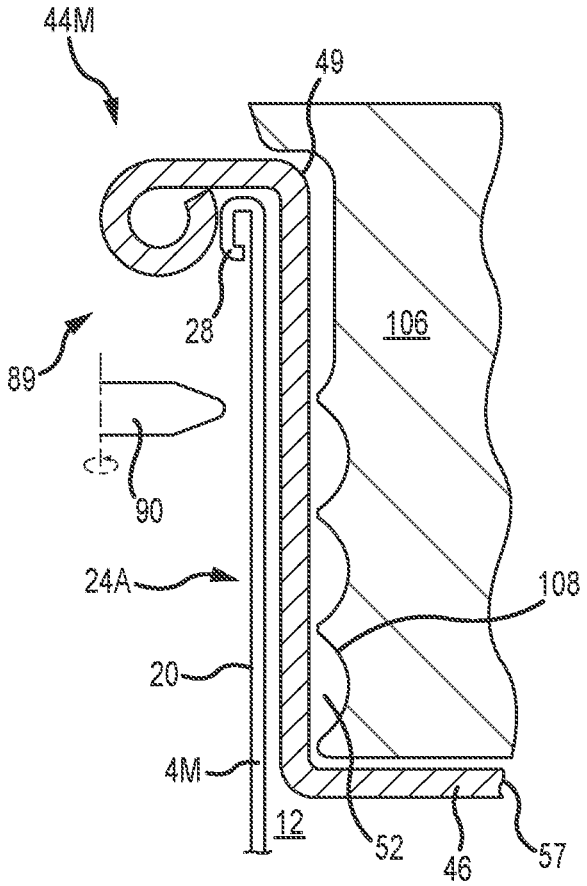
FIG. 21A is a partially fragmented cross-sectional front elevation view depicting a method and the associated tools of an apparatus used to simultaneously form threads on an unthreaded metallic container and an unthreaded closure according to yet another embodiment of the present invention.
Figure 21B:
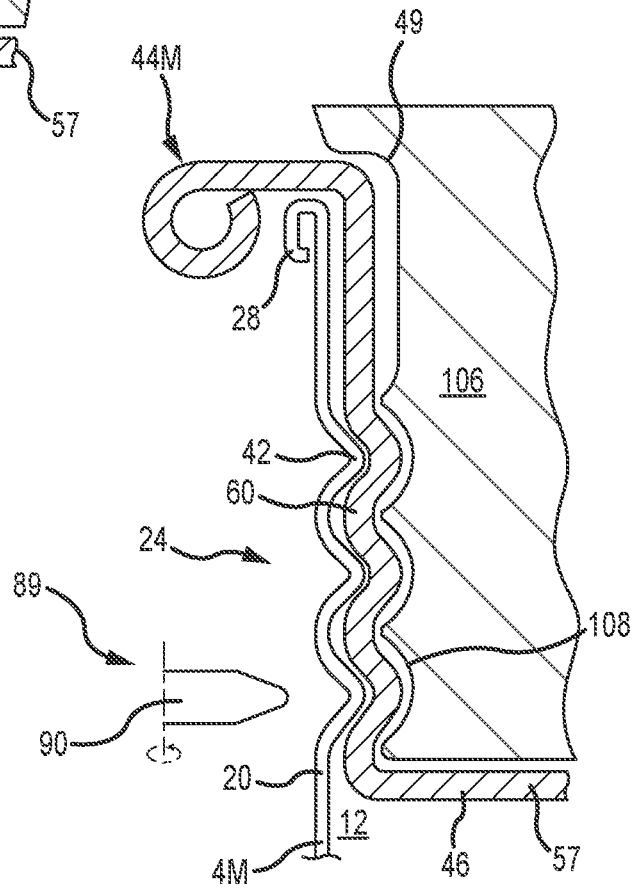
FIG. 21B is a partially fragmented cross-sectional front elevation view of the method and associated tools of the apparatus of FIG. 21A after the tools have been used to simultaneously form threads on the metallic container and the closure.

In another embodiment, illustrated in FIGS. 21A-21B, that apparatus 89 includes a threaded mandrel 106 used to form threads on a metallic container 4M and a closure 44M at the same time. The threaded mandrel 106 has a contoured exterior surface 108 with concave and convex portions of a predetermined shape to form threads 42, 60 on both the metallic container 4M and the closure 44M. An unthreaded closure 44M is inserted into the bore 12 of a metallic container 4M with an unthreaded thread region 24A. The unthreaded closure 44M has a chamber 52 that is accessible through an upwardly facing open aperture 49. The threaded mandrel 106 is positioned in the chamber 52 of the closure 44M as illustrated in FIG. 21A.

The apparatus 89 then applies a force to the exterior surface of the thread region 24 of the metallic container 4M. The force compresses the material of the metallic container 4M and the material of the closure body 46 against the contoured surface 108 to form the threads 42, 60. In one embodiment, the apparatus 89 forms the threads on the metallic container 4M and the closure 44M by a hydraulic bag, a hydraulic tool, or by an EM forming tool as described above in conjunction with FIG. 5A. In another embodiment, as illustrated in FIG. 21B, the apparatus 89 forms the threads 42, 60 with a thread roller 90 positioned in contact with an exterior surface of the thread region 24 on the neck 20 of the metallic container 4M. After forming the threads 42, 60, the apparatus 89 rotates the mandrel 106 to unthread and remove the mandrel 106 from the chamber 52 of the closure 44M. In another embodiment, the mandrel 106 can collapse for removal from the chamber 52. In still another embodiment, the mandrel 106 is unthreaded and is formed of a material that is at least partially compressible. Accordingly, in a manner similar to that illustrated in FIG. 16, the apparatus 89 forms the threads 42, 60 by applying a force to the exterior surface of the thread region 24 and at least partially compressing the material of the mandrel 106. The apparatus 89 can alter the application of the force to create container threads 42, 60 of a desired pitch. After the threads are formed and the mandrel 106 is removed from the bore, the mandrel 106 may rebound to its original non-compressed shape and be reused to form threads on another metallic container 4M and closure 44M.

The metallic container 4M may be sealed by any seal described herein. For example, in one embodiment, a seal may be formed by contact between the closure 44M and the curl 28 of the metallic container 4M, as illustrated in FIG. 5A. In another embodiment, the closure 44M may include a liner 80 that contacts an annular ring 22 formed on the metallic container 4M as illustrated in FIG. 8 or FIG. 9. In still another embodiment, the closure 44M may include a plug seal 72C that contacts an annular ring 22 as illustrated in FIG. 10. In yet another embodiment, in a manner similar to that illustrated in FIGS. 12 and 13, an annular ring 22 formed before or after the closure 44M is inserted in the metallic container 4M compresses and makes sealing contact with a liner 80E interconnected to the closure 44M. In one embodiment, the closure 44M includes a skirt positioned below the closure threads 60. The skirt is the same as or similar to the skirt 75 illustrated in FIG. 30 and makes sealing contact with the interior surface of the metallic bottle 4M.

Figure 22:
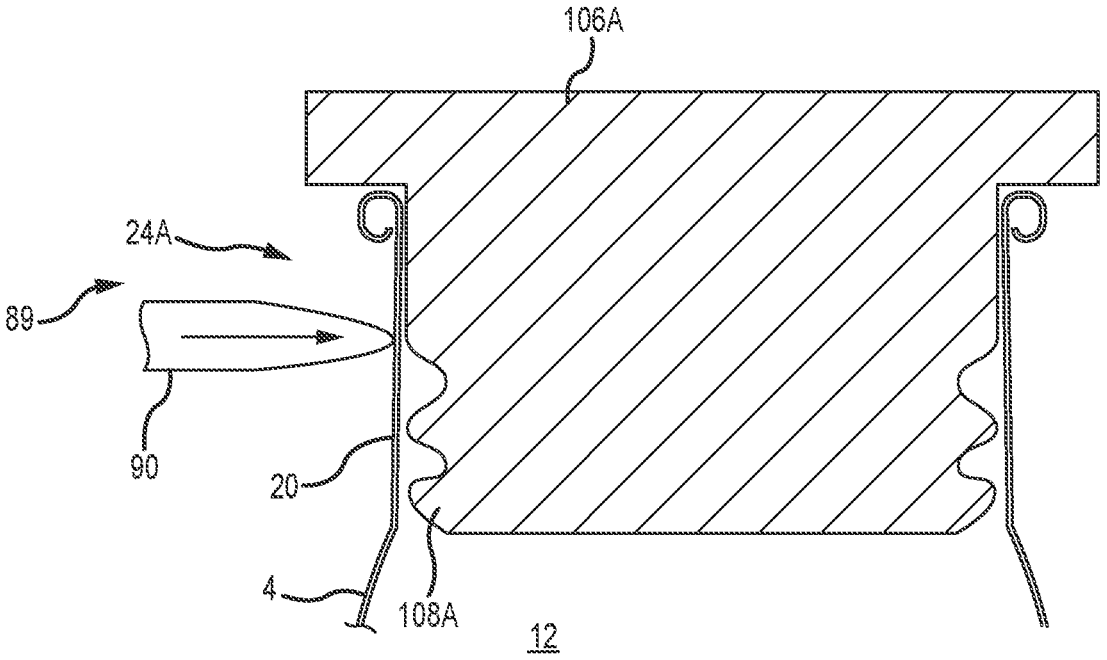
FIG. 22 illustrates a partially fragmented cross-sectional front elevation view of a method and associated tools of an apparatus used to form threads on a portion of a neck of a metallic container according to still another embodiment of the present invention.

Referring now to FIG. 22, in one embodiment, the apparatus 89 may form container threads 42 on a metallic container 4 by inserting a threaded mandrel 106A in the bore 12 of the metallic container 4. The threaded mandrel 106A may have substantially the same diameter and thread geometry of a threaded closure 44 intended to seal and close the metallic container 4. After the threaded mandrel 106A is positioned in the bore 12, container threads 42 are formed by the apparatus 89 by applying a force to the thread region 24 by any method described in conjunction with FIG. 5A. In one embodiment, the apparatus 89 forms the container threads 42 by pressing a thread roller 90 against the exterior surface of the unthreaded thread region 24A as described above. After the thread roller 90 forms the container threads 42, the threaded mandrel 106A is rotated to unthread and remove the threaded mandrel from the metallic container 4. The threaded metallic container 4 may then be filled with a beverage at a later time. After filling the metallic container 4, a threaded closure 44 may be rotatably inserted into the bore 12 to seal the metallic container 4.

In still another embodiment, the apparatus 89 inserts a cylindrical mandrel 100, 100A formed of a compressible material into the bore 12 of an unthreaded metallic container. The apparatus 89 may then form the threads 42 by compressing the thread region 24 of the neck with a thread roller 90 in a manner similar to the method illustrated in FIG. 16. The apparatus 89 can alter the position of the thread roller 90 to create threads 42 of a desired pitch.

Figure 23:
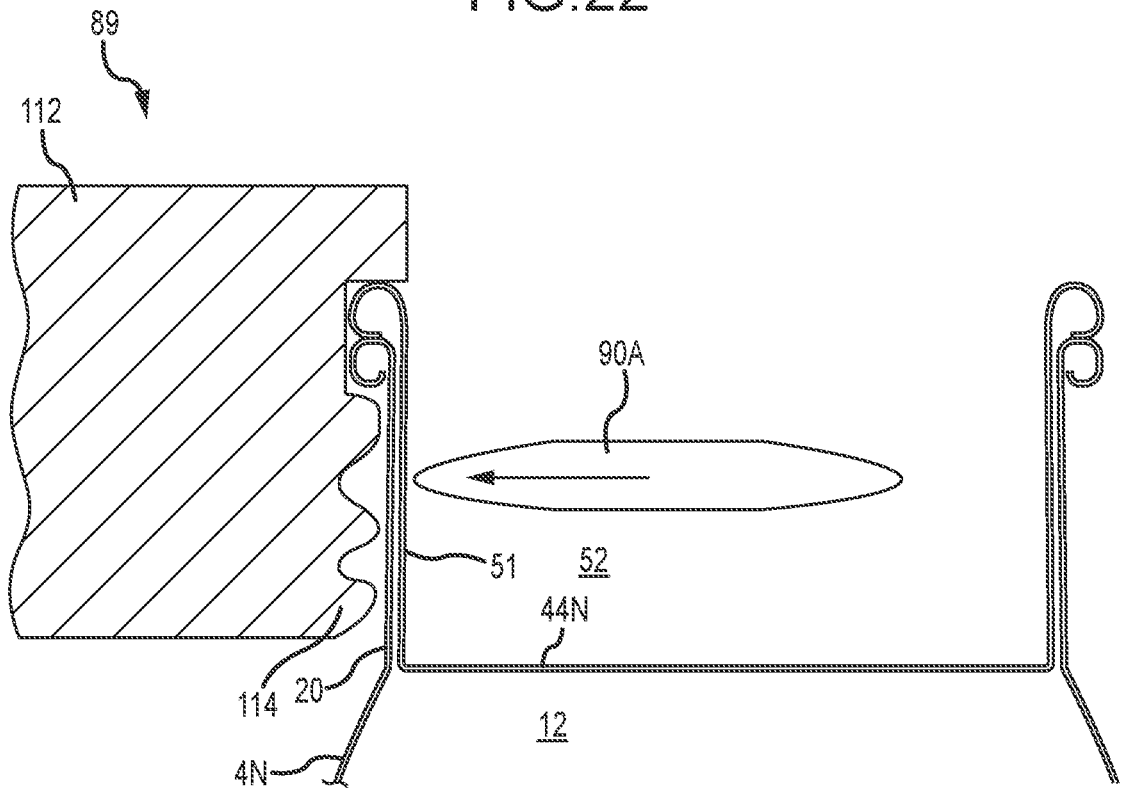
FIG. 23 is a partially fragmented cross-sectional front elevation view depicting another method and the associated tools of an apparatus used to simultaneously form threads on an unthreaded metallic container and an unthreaded closure according to yet another embodiment of the present invention.

Referring now to FIG. 23, in one embodiment of the present invention, the apparatus 89 further includes a thread split 112. The thread split 112 is used by the apparatus 89 to form threads 42, 60 on the metallic container 4N and a closure 44N at the same time. In one embodiment, the thread split 112 is operable to move vertically and laterally and can rotate about a substantially vertical axis. In another embodiment, the thread split 112 is formed of at least two pieces that fit around the exterior circumference of the neck 20 of the metallic container 4N. The unthreaded closure 44N is positioned within the bore 12 of the metallic container 4N by the apparatus 89. The thread split 112 is then positioned proximate to an exterior surface of the neck 20 of the metallic container 4N. Threads are then formed on the metallic container 4 and the closure 44N by pressing the material of the metallic container 4N and the closure 44N outwardly against the contoured surface 114 of the thread split 112. In one embodiment, a thread roller 90A is positioned within the chamber 52 of the closure 44N. The thread roller 90A applies a force to an interior surface 51 of the closure 44N to simultaneously form the threads 42, 60. Alternatively, the apparatus 89 may form the threads using one or more of a hydraulic bag, hydro-forming, and electro-magnetic forming as described above in conjunction with FIG. 5A or any other means to push the material of the closure 44N and the metallic container 4N outwardly against the contoured surface 114 of the thread split 112 to form the threads 42, 60.

Figure 24A:
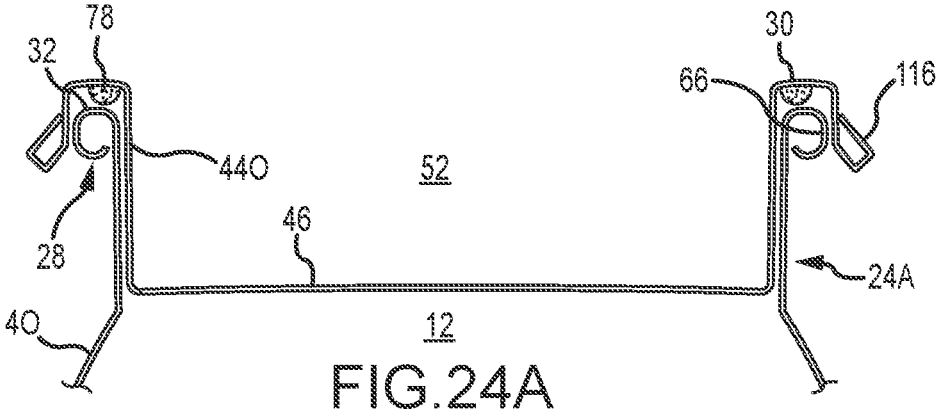
FIG. 24A is a partially fragmented cross-sectional front elevation view of an unthreaded metallic container and an unthreaded closure of still another embodiment of the present invention.
Figure 24B:
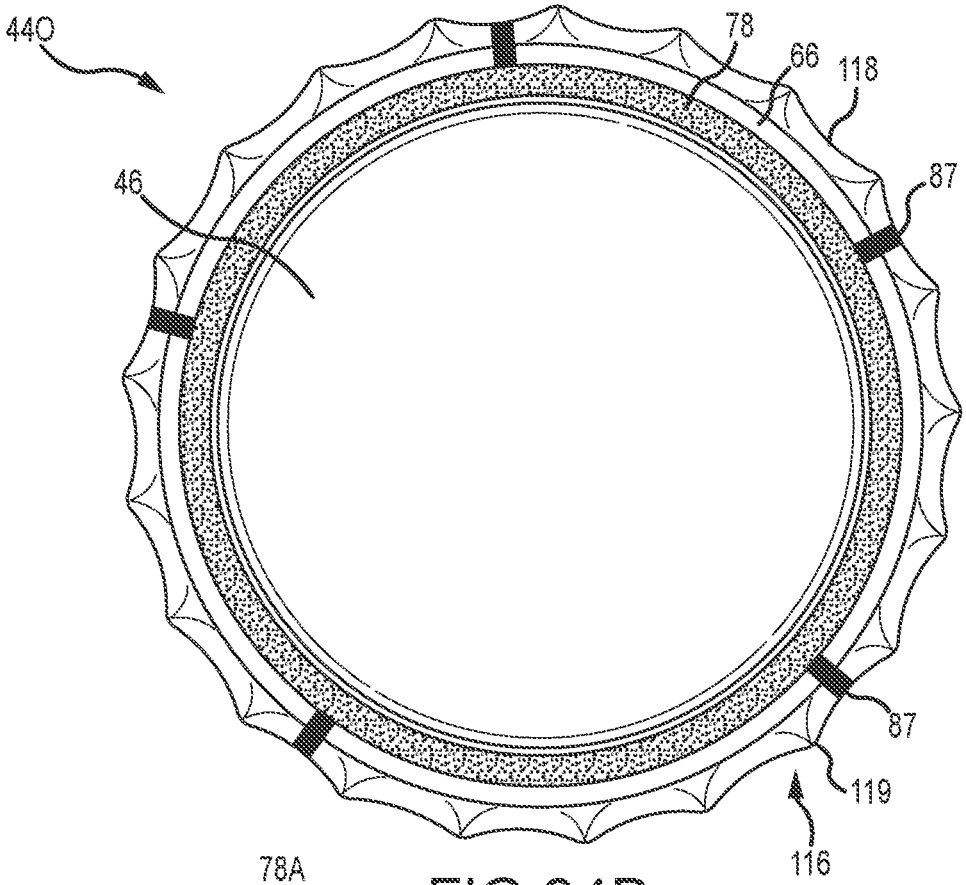
FIG. 24B is a bottom plan view of the closure of FIG. 24A illustrating axial serrations formed on flutes of the unthreaded closure.
Figure 24C:
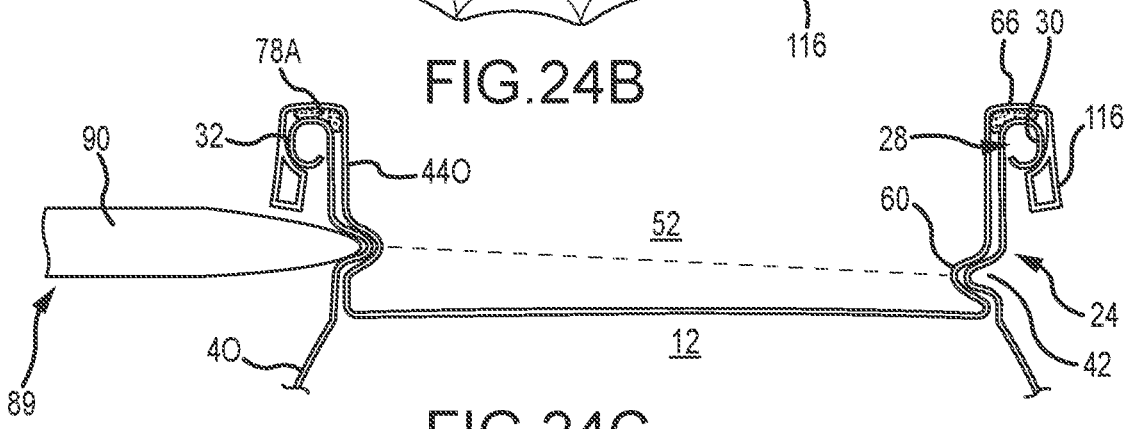
FIG. 24C is a partially fragmented cross-sectional front elevation view of the metallic container and the closure of FIG. 24A and associated tools simultaneously forming threads on the metallic container and the closure and illustrating the closure flutes pressed against an exterior surface of a curl of the metallic container.

Referring now to FIGS. 24A-24C, a closure 44O and a metallic container 4O of another embodiment of the present invention are illustrated. The closure 44O includes an extension 66 with downwardly projecting flutes 116 adapted to fit over an exterior surface 30 of a curl 28 of a metallic container 4O. Axial serrations 87, illustrated in FIG. 24B, are formed in the flutes 116. In one embodiment, the axial serrations 87 are formed on valleys 118 at inner portions of the flutes 116. The axial serrations 87 are adapted to break or separate when a predetermined amount of force is applied to the flutes 116.

To seal the metallic container 4O, a ring or bead of a sealant 78 is applied to the closure 44O or an upper surface 32 of a curl 28 of the metallic container 4O as described above in conjunction with FIG. 19. The closure 44O is then positioned within the bore 12 of the metallic container 4O by the apparatus 89 as illustrated in FIG. 24C. The flutes 116 are crimped or pressed against the exterior surface 30 of the curl 28 of the metallic container 4O, drawing the closure 44O further into the bore 12 and compressing the sealant 78A to create a seal between the closure 44O and the metallic container 4. In one embodiment, the apparatus 89 includes a tool that can move vertically up and down. The tool presses the flutes against the exterior surface 30 of the curl 28. As will be appreciated by those of skill in the art, the tool is similar to tools used in applying crown closures to containers. In another embodiment, the tool is generally donut shaped with a substantially centered void. The void is adapted to at least partially receive the closure 44O and apply a force to the flutes 116. In still another embodiment, the tool may be interconnected to the chuck 94 of the apparatus 89.

The apparatus 89 forms threads 42, 60 with at least one thread wrap on the metallic container 4O and the closure 44O as described above in conjunction with FIG. 5. In one embodiment, a thread roller 90 forms the threads 42, 60 by pressing against the thread region 24 of the metallic container 4O. Optionally, a mandrel (not illustrated) may be positioned within the chamber 52 of the closure 44O when the threads 42, 60 are formed. In one embodiment, the mandrel is a threaded mandrel 106.

In operation, as a consumer rotates the closure 44O to open the metallic container 4O the flutes 116 are forced over the curl 28 rupturing the axial serrations 87 indicating that the closure 44O has been at least partially unthreaded from the metallic container 4O. By forming the axial serrations 87 on the valleys 118 of the flutes 116, the consumer's fingers do not contact the severed edges of the axial serrations 87 because the axial serration 87 face inward and are radially inward of the unsevered peaks 119 of the flutes 116. In one embodiment, the severed portions of the flutes 116 flair outwardly away from the exterior portion of the neck 20 of the metallic container 4O. In another embodiment, the flutes 116 may be formed of a plastic or a metal material that is different than the material used to form the threaded closure 44O.

Figure 25:
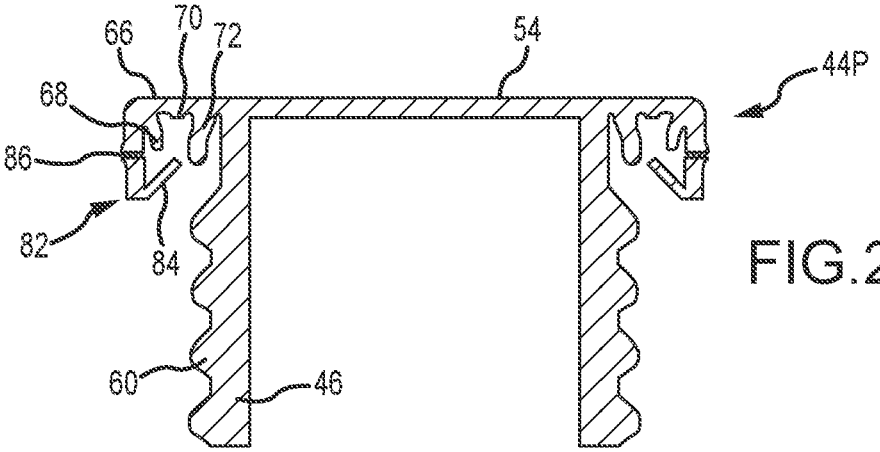
FIG. 25 is a cross-sectional front elevation view of a threaded closure with a solid top portion according to one embodiment of the present invention.
Figure 26:
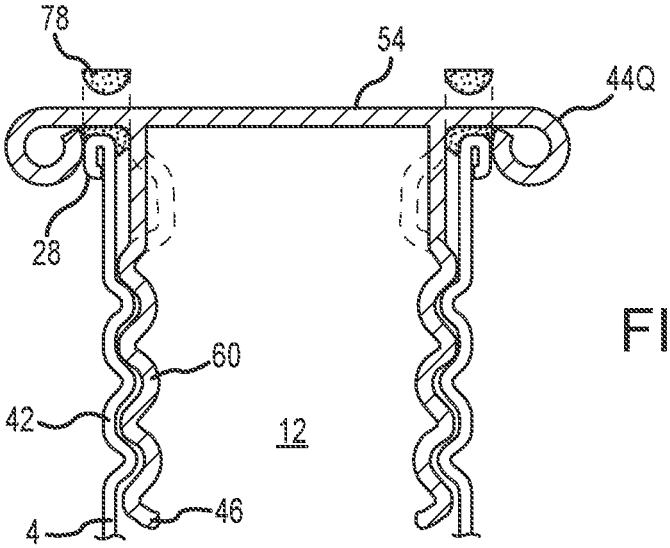
FIG. 26 is a partially fragmented cross-sectional front elevation view of a threaded closure with a solid top portion threadably engaged with a metallic container according to another embodiment of the present invention.
Figure 27:
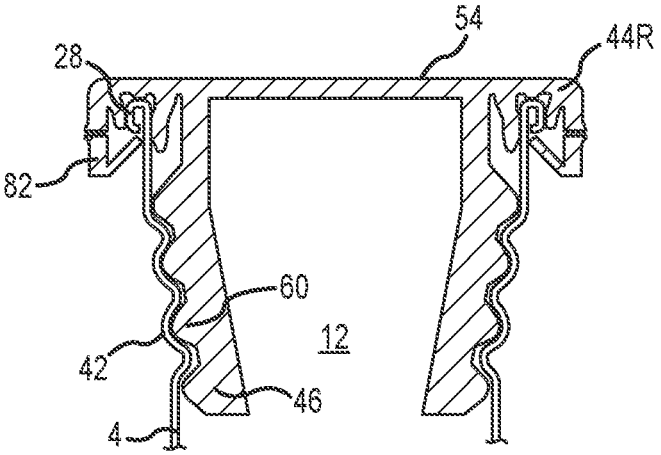
FIG. 27 is a partially fragmented cross-sectional front elevation view of a tapered threaded closure with a solid top portion threadably engaged with a tapered thread region of a metallic container according to yet another embodiment of the present invention.

Referring now to FIGS. 25-27, threaded closures 44 of the present invention can optionally be formed having a closure body 46 with a solid top portion 54. The threaded closures 44 with a solid top portion 54 may be used interchangeably with the threaded closures 44 described above in conjunction with FIGS. 3-24. Optionally, threaded closures 44 with a solid top portion 54 may have an internal web to provide structural support to the threaded closures 44.

Figure 28:
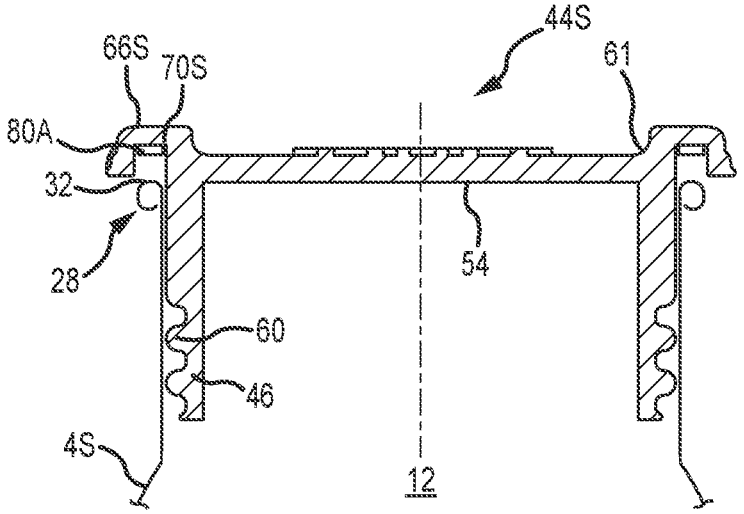
FIG. 28 is a partially fragmented cross-sectional front elevation view of a threaded closure partially inserted in the bore of an unthreaded metallic container of the present invention and further illustrating a gas permeation barrier formed by a liner interconnected to a portion of the threaded closure.

Referring now to FIG. 28, another embodiment of a threaded closure 44S of the present invention is illustrated. A liner 80A is interconnected to a lower surface of the extension 66S of the closure 44S. When the threaded closure 44S is inserted into the bore 12 of a metallic container 4S, shown in FIG. 28 before threads are formed on the metallic container, the liner 80A is compressed between a lower surface 70S of the extension 66S and an upper surface 32 of a curl 28 of the metallic container 4S. The compression of the liner 80A forms a seal to prevent venting of the contents of the metallic container 4S and/or transmission of $CO_2$ or $O_2$ into, or out of, the interior of the metallic container 4S. Threads 42 are formed on the metallic container 4S by the apparatus 89 as described above. The liner 80A may be formed of the same partially flexible and substantially impervious material as liner 80 described above in conjunction with FIG. 8. In one embodiment, the liner 80A is formed of a material that absorbs $CO_2$ and/or $O_2$.

When a consumer rotates the threaded closure 44S to open the metallic container 4S, the lower surface 70S of the extension 66S and the liner 80A move away from the upper surface 32 of the curl 28. Separation of the liner 80A from the upper surface 32 allows a controlled release of pressure from within the metallic container 4S before the threads 60 of the threaded closure 44S lose thread engagement with the container threads formed on the metallic container 4S. The controlled release of pressure prevents an uncontrolled expulsion of the threaded closure 44S from the metallic container 4S. The threaded closure 44S may be screwed back into the bore 12 of the metallic container 4S to again compress the liner 80A and reseal and/or reclose the metallic container 4S.

Threaded closure 44S also includes a top portion 54 with an optional debossed portion 61. Optionally, the top portion 54 may include an embossed portion. The debossed portion 61 and the embossed portion are adapted to increase the rigidity of the threaded closure 44S. In one embodiment, the debossed portion 61 and/or the embossed portion of the top portion 54 prevent unintended doming of the top portion 54.

Figure 29A:
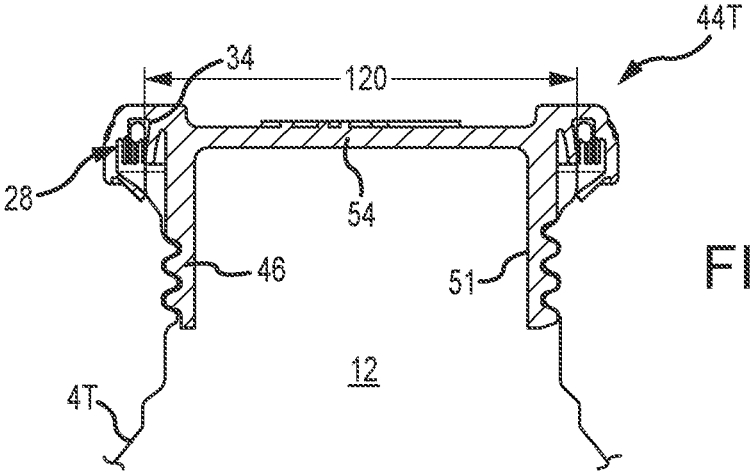
FIG. 29A is a partially fragmented cross-sectional front elevation view of a threaded closure threadably engaged to a metallic container according to still another embodiment of the present invention.
Figure 29B:
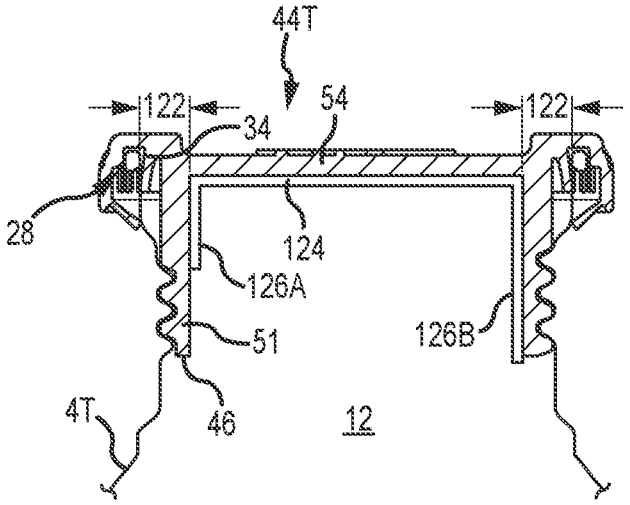
FIG. 29B is a partially fragmented cross-sectional front elevation view of the threaded closure and the metallic container of FIG. 29A with a gas permeation barrier formed by one or more liners interconnected to interior surfaces of the threaded closure.

Referring now to FIGS. 29A-29B, still another embodiment of a threaded closure 44T and a metallic bottle 4T of the present invention are illustrated. Some materials used to form threaded closures 44 are at least slightly gas-permeable and allow some transmission of gases such as $CO_2$ and/or $O_2$ through the closure body 46 and into, or out of, the interior of a metallic container 4T. This unintended transmission of gas may cause the contents of the metallic container 4T to spoil, go flat, or be oxidized. As illustrated in FIG. 29A, the gases can enter or leave the metallic container 4T in the area 120 between the interior surfaces 34 of the curl 28 of the metallic container 4T. The size of area 120 is directly related to the rate of transmission of gases through the closure body 46 and how quickly a product sealed in the metallic container 4T will spoil, go flat, or be oxidized.

Referring now to FIG. 29B, to reduce the size of area 120 of gas transmission, a gas permeation barrier 124 is applied to an interior surface of a top portion 54 of the threaded closure 44T before the threaded closure 44T is inserted into the bore 12 of the metallic container 4T. The gas permeation barrier 124 reduces the size of area 120 to an area 122, increasing the shelf-life of the product sealed in the metallic container 4T. In this manner, it is possible to slow or prevent the transmission of gases through the threaded closure 44T without using a different or more costly material to form the threaded closure 44T. Optionally, in one embodiment, a gas permeation barrier 126 may be applied to at least a portion of an interior surface 51 of the body 46 of the threaded closure 44T to further reduce the transmission of gases through the body 46. The gas permeation barrier 126A may cover a portion of the interior surface 51 of the threaded closure 44T. Optionally, the gas permeation barrier 126B may cover substantially all of the interior surface 51 of the threaded closure 44T. Gas permeation barriers 124, 126 may be formed of any material that at least partially prevents the transmission of $CO_2$ and/or $O_2$ and/or scavenges $CO_2$ and/or $O_2$. In one embodiment, gas permeation barriers 124, 126 are formed of the same material as liner 80 described above in conjunction with FIG. 8. In another embodiment, barriers 124, 126 are made of the same material as gas permeation barrier 76 described above in conjunction with FIG. 15. The gas permeation barriers 124, 126 may be applied to the surfaces facing the product sealed in the metallic container for all embodiments of the threaded closures described herein. In one embodiment, gas permeation barriers 124, 126 may be combined to form a single gas permeation barrier.

Figure 30:
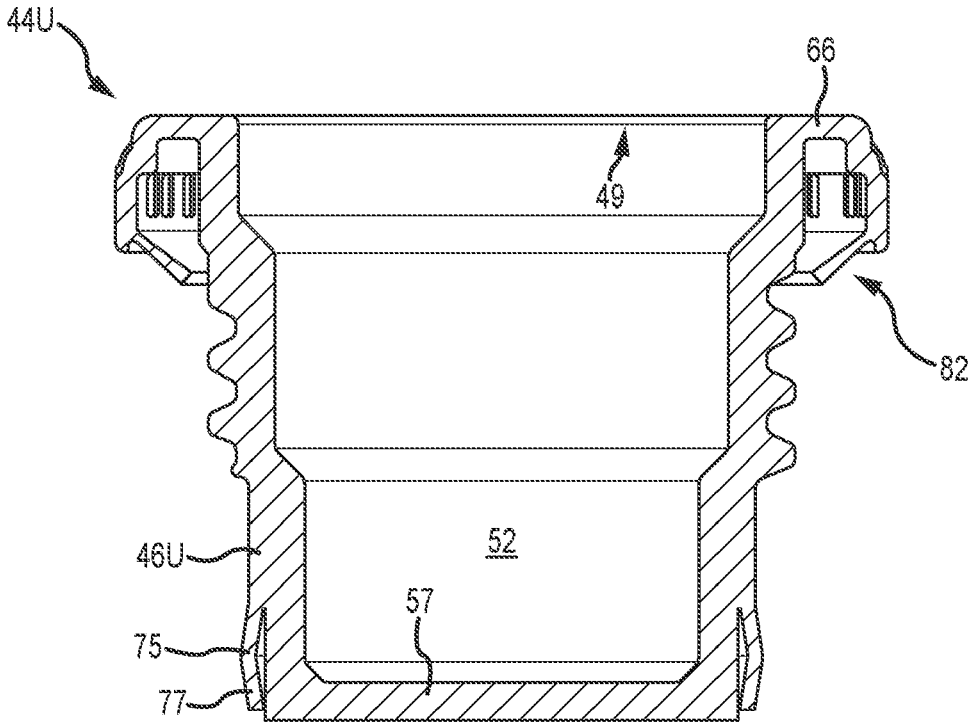
FIG. 30 is a cross-sectional front elevation view of a threaded closure with a flexible skirt according to another embodiment of the present invention.

Referring now to FIG. 30, still another embodiment of a threaded closure 44U of the present invention is illustrated.

A skirt 75 that is flexible is formed on a lower portion of the closure body 46U. The skirt 75 has a maximum outer diameter that is adapted to be slightly greater than a predetermined portion of the interior diameter 10 of the bore 12 of a metallic container 4 (not illustrated) below the thread region. As the threaded closure 44U is inserted into the bore 12, a lower portion 77 of the skirt 75 contacts the interior surface of the bore 12 of the metallic container 4. The skirt 75 is deflected radially inwardly. The lower portion 77 may contact the exterior surface of the closure body 46U. The skirt 75 will be under stress while the skirt 75 is compressed in the bore 12, creating an interference fit with the interior surface of the bore 12 and forming a seal between the threaded closure 44U and the metallic container 4. Because the skirt 75 is flexible, the tolerance between the interior diameter 10 of the bore 12 and the outer diameter of the skirt 75 can be greater than some other interference fit seals because the skirt 75 can be adapted to different diameters. When the threaded closure 44U is removed from the bore 12, the skirt 75 will spring outwardly to substantially the initial position. Although the skirt 75 is illustrated in FIG. 30 below the closure threads, it will be appreciated by one of skill in the art that the skirt 75 may be positioned above the closure threads. In one embodiment, the skirt 75 is integrally formed with the closure body 46U. In another embodiment, the skirt 75 is formed separately and interconnected to the closure body 46U. In still another embodiment, the skirt 75 may be compressed by an annular ring 22 formed before or after the threaded closure 44U is inserted into the bore 12 of the metallic container 4. In one embodiment, the skirt 75 is not axisymmetric, as described above in conjunction with FIGS. 5A and 10.

Referring now to FIGS. 31A-31D, a threaded closure 44V and a metallic container 4V of another embodiment of the present invention are illustrated. The threaded closure 44V includes a plurality of tamper projections 81 on an exterior surface of the threaded closure body 46. The tamper projections 81 are at least partially flexible radially but are not flexible axially. Although the tamper projections 81 are illustrated positioned below the closure threads 60, it will be appreciated by one of skill in the art that the tamper projections 81 may also be positioned above the closure threads 60. In one embodiment, the tamper projections 81 are interconnected to the threaded closure body 46. In another embodiment, the tamper projections 81 are integrally formed on the threaded closure body 46.

Figure 31A:
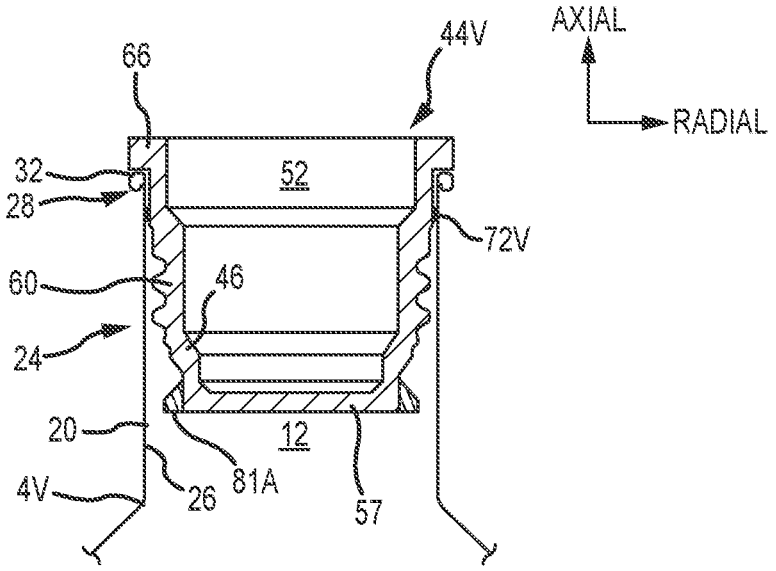
FIG. 31A depicts a partially fragmented cross-sectional front elevation view of a threaded closure including tamper projections inserted into the bore of an unthreaded metallic container according to one embodiment of the present invention.

After the metallic container 4V is filled with a product, the threaded closure 44V is inserted into the bore 12 of the metallic container 4V as illustrated in FIG. 31A. The tamper projections 81 are generally in an unbent or unfolded position 81A. A lower surface of an extension 66 of the threaded closure 44V is positioned proximate to the upper surface 32 of the curl 28 of the metallic container 4V. A seal 72V formed on the threaded closure body 46 contacts an interior surface 26 of the neck 20 creating a seal between the threaded closure 44V and the metallic container 4V. The seal 72V may comprise any seal described herein, including but not limited to a plug seal 72, 72C, 72F, a seal 79, a seal including a sealant 78, a skirt 75, or a liner 80. In one embodiment, illustrated in FIGS. 31A-31D, the seal 72V is positioned above the closure threads 60. In another embodiment, the seal 72V may be the same as, or similar to, seals 72C, 72F, a skirt 75, or a liner 80, 80E and is positioned below the closure threads.

Figure 31B:
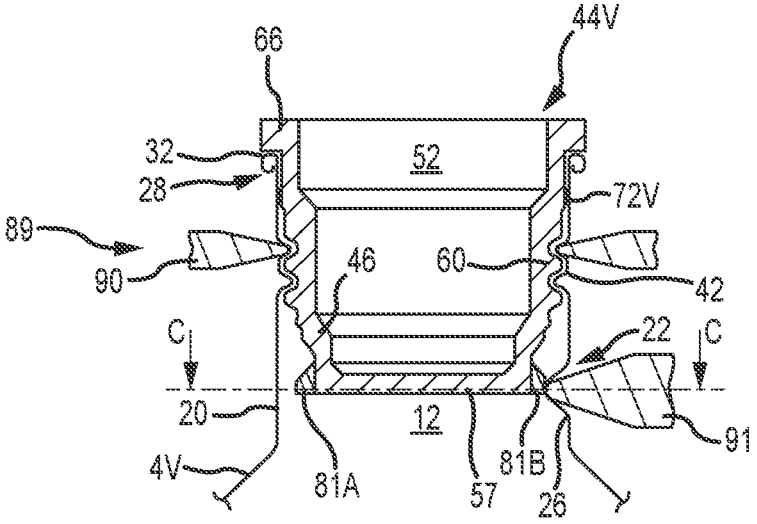
FIG. 31B depicts a partially fragmented cross-sectional front elevation view of the metallic container and threaded closure of FIG. 31A as thread rollers and a pilfer roller form threads and an annular ring in the metallic container and further illustrates an interior surface of the annular ring contacting the tamper projections of the threaded closure.
Figure 31C:
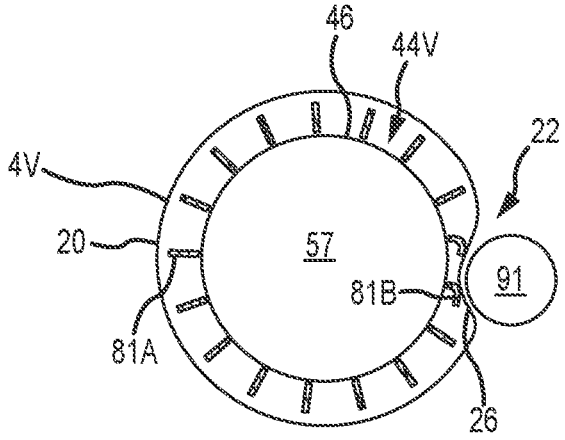
FIG. 31C depicts a cross-sectional top plan view of the metallic container and threaded closure of FIG. 31B taken along line C-C illustrating the interior surface of the annular ring contacting the tamper projections and moving the tamper projections to the folded position as the annular ring is formed in the neck of the metallic container.

Referring now to FIGS. 31B and 31C, container threads 42 are formed in the neck of the metallic container 4V by, for example, a thread roller 90 of the apparatus 89. A pilfer roller 91 forms an annular ring 22 in a portion of the neck 20 of the metallic container 4V proximate to the tamper projections 81 of the threaded closure 44V. An interior surface 26 of the neck 20 proximate the annular ring 22 contacts the tamper projections 81 which move to an at least partially bent or folded position 81B. The pilfer roller 91 continues around the exterior circumference of the neck 20 of the metallic container 4V and all of the tamper projections 81 are moved to the folded position 81B as the annular ring 22 is formed. Although the threaded closure 44V illustrated in FIGS. 31A and 31B with pre-formed threads 60, it will be appreciated by one of skill in the art that the tamper projections 81 may be included on a closure with an unthreaded closure body. After the unthreaded closure is inserted into the bore 12 of the unthreaded metallic container 4V, the threads 42, 60 may be simultaneously formed on the metallic container 4V and closure 44V as previously described in conjunction with FIGS. 21 and 23.

Figure 31D:
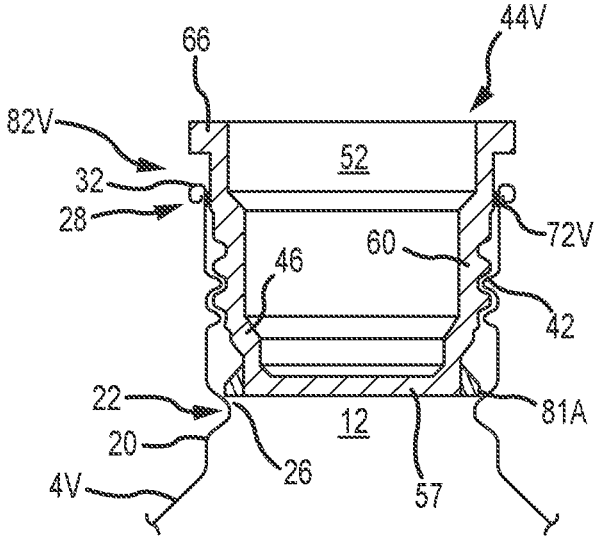
FIG. 31D depicts a partially fragmented cross-sectional front elevation view of the threaded closure and metallic container of FIG. 31B and illustrating that the tamper projections return to the initial unfolded position after the threaded closure has been at least partially removed from the metallic container.

Referring now to FIG. 31D, when the threaded closure 44V is at least partially removed from the metallic container 4V, the tamper projections 81 move axially upward past the annular ring 22 and return to a substantially unfolded position 81A. The exterior diameter of the tamper projections 81 is less than the interior diameter of the container threads 42 allowing the complete removal of the threaded closure 44V from the metallic container 4V. The threaded closure 44V may be used to reclose and/or reseal the metallic container 4V. However, the threaded closure 44V cannot be fully rotated into the bore 12 of the metallic container 4V to the position illustrated in FIG. 31B because the unfolded tamper projections 81A contact the interior surface 26 of the annular ring 22 and prevent the downward movement of the threaded closure 44V. The lower surface of the extension 66 of the threaded closure 44V therefore projects at least slightly above the upper surface 32 of the curl 28 of the metallic container 4V. The separation of the lower surface of the extension 66 from the upper surface 32 of the curl 28 forms a tamper indicator 82V to indicate that the threaded closure 44V has been at least partially unthreaded from the container threads 42.

Figure 32A:
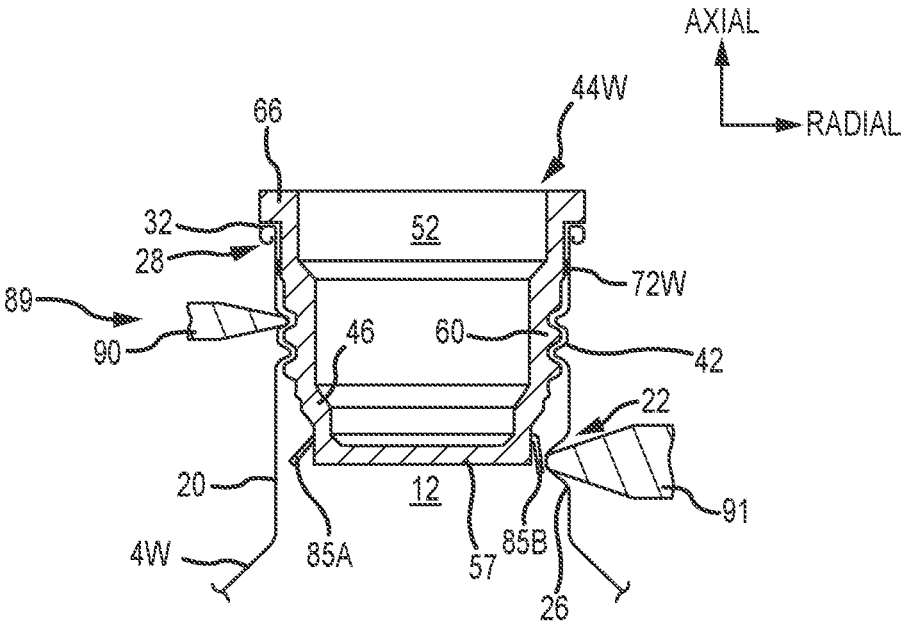
FIG. 32A illustrates a partial cross-sectional front elevation view of a threaded closure including a tamper skirt and sealing a metallic container according to still another embodiment of the present invention and associated tools used to form threads and an annular ring on the metallic container.
Figure 32B:
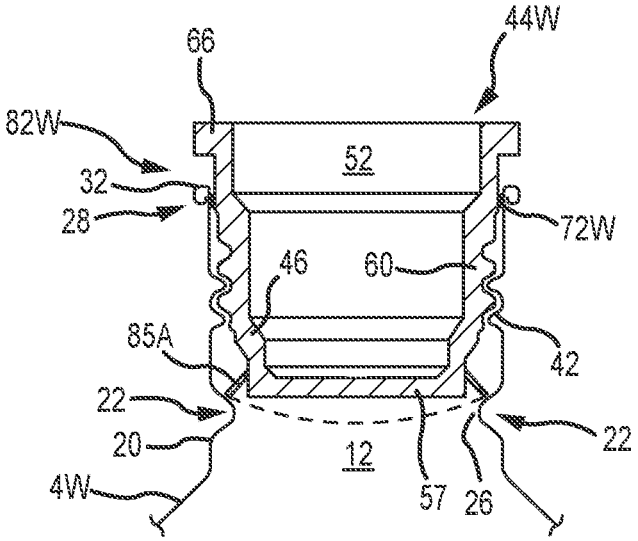
FIG. 32B depicts a partially fragmented cross-sectional front elevation view of the threaded closure and metallic container of FIG. 32B after the threaded closure is at least partially removed from the metallic container and illustrating that the tamper skirt returns to an initial unfolded position preventing the threaded closure from moving downward back into the bore of the metallic bottle.

Referring now to FIGS. 32A-32B, yet another embodiment of a threaded closure 44W and a metallic container 4W of the present invention are illustrated. The exterior surface of the threaded closure body 46 includes a tamper skirt 85 that is at least partially flexible. The tamper skirt 85 may be a single element or formed of several individual pieces. The tamper skirt 85 may be either interconnected to the threaded closure body 46 or integrally formed on the threaded closure body 46. Although illustrated in FIGS. 32A-32B with the tamper skirt 85 positioned below the closure threads 60, it will be appreciated by one of skill in the art that the tamper skirt 85 may also be positioned above the closure threads 60.

The threaded closure 44W is inserted into the bore 12 of the metallic container 4W by the apparatus 89 as illustrated in FIG. 32A. As shown, the tamper skirt 85 is in an unbent or unfolded position 85A. A lower surface of an extension 66 of the threaded closure 44W is proximate to the upper surface 32 of the curl 28 of the metallic container 4W. Contact between the interior surface 26 of the neck 20 of the metallic container 4W and a seal 72W formed on the threaded closure body 46 creates a seal between the threaded closure 44W and the metallic container 4W. The seal 72W may comprise any seal described herein, including but not limited to a plug seal 72, 72C, 72F, a seal 79, a seal including a sealant 78, a skirt 75, or a liner 80. In one embodiment, illustrated in FIGS. 32A-32B, the seal 72W is positioned above the closure threads 60. In another embodiment, the seal 72W may be the same as, or similar to, seals 72C, 72F, a skirt 75, or a liner 80, 80E and is positioned below the closure threads.

A pilfer roller 91 of the apparatus 89 forms an annular ring 22 in a portion of the neck 20 of the metallic container 4W proximate to the tamper skirt 85 of the threaded closure 44W. The annular ring 22 is illustrated in FIG. 32A as only partially formed. The interior surface 26 of the neck 20 which is positioned proximate to the annular ring 22 contacts and applies a force to the tamper skirt 85 which moves radially inward to an at least partially bent or folded position 85B. As the pilfer roller 91 moves around the exterior of the metallic container 4W forming the annular ring 22, the entire tamper skirt is moved to the folded position 85B. The apparatus 89 also forms container threads 42 on the metallic container 4W. In one embodiment, the container threads 42 are formed with a thread roller 90. In another embodiment, an unthreaded closure with a tamper skirt 85 is inserted into the bore 12 of the unthreaded metallic container 4W. The apparatus then simultaneously forms the container threads 42 and the closure threads 60 as previously described in conjunction with FIGS. 21 and 23.

Referring now to FIG. 32B, as the threaded closure 44W is rotated to open the metallic container 4W, the tamper skirt 85 moves axially upward above the annular ring 22. When the free end of the tamper skirt 85 moves above the annular ring 22, the tamper skirt 85 moves radially outwardly and returns to the substantially unfolded position 85A. The exterior diameter of the tamper skirt 85 is less than the interior diameter of the container threads 42 and the threaded closure 44W may be completely removed from the metallic container 4W. However, if the threaded closure 44W is re-inserted into the bore 12 of the metallic container, the seal 72W is operable to reseal the metallic container 4W. If the consumer continues to rotate the threaded closure 44W into the metallic container 4W after the seal 72W makes sealing contact with the interior surface 26 of the metallic container 4W, the free end of the tamper skirt 85 will contact the interior surface 26 of the annular ring 22 and prevent further downward movement of the threaded closure 44W, thus forming a visual indication to the consumer that the seal has been compromised. A gap forming a tamper indicator 82W is left between the lower surface of the extension 66 of the threaded closure 44W and the upper surface 32 of the curl 28 of the metallic container 4W. The tamper indicator 82W visually identifies that the threaded closure 44W has been at least partially removed from the metallic container 4W.

Figure 33A:
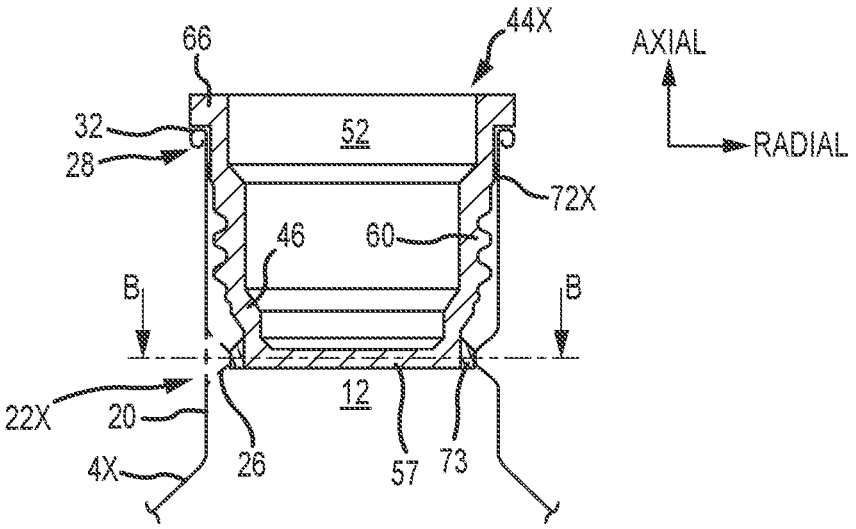
FIG. 33A is a partially fragmented cross-sectional front elevation view of still another embodiment of a threaded closure and a metallic container of the present invention illustrating uni-directional extensions of the threaded closure and a discontinuous annular ring formed on the metallic container.
Figure 33B:
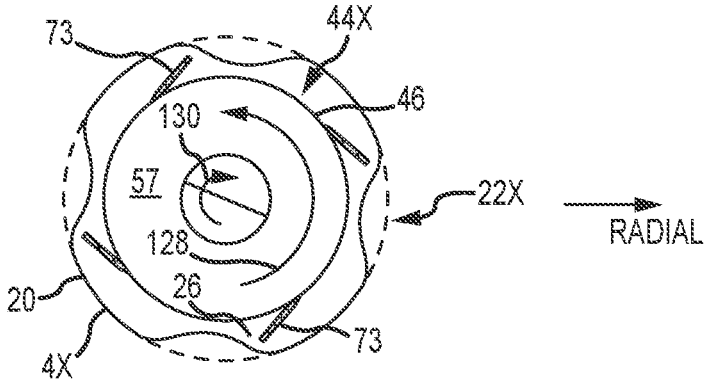
FIG. 33B is a cross-sectional top plan view of the metallic container and threaded closure of FIG. 33A taken along line B-B and further illustrating the extensions of the threaded closure and the discontinuous annular ring of the metallic container allow rotation of the threaded closure in an opening direction but not in a closing direction.
Figure 33C:
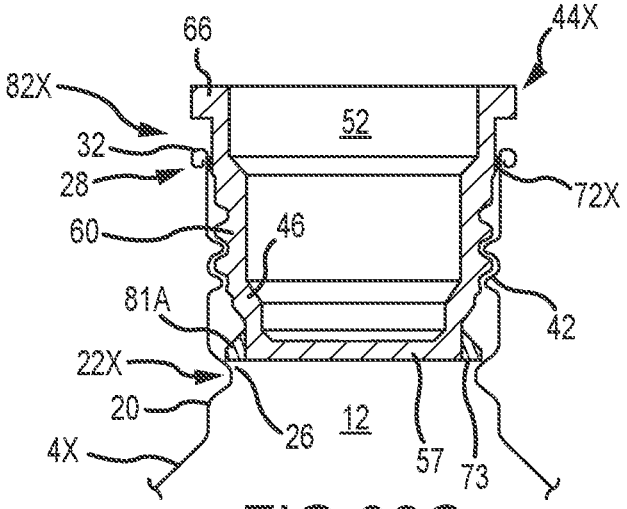
FIG. 33C is a partially fragmented cross-sectional front elevation view of the threaded closure and metallic container of FIG. 33A illustrating that after the threaded closure is at least partially removed from the metallic container the threaded closure can be rotated to reseal the metallic container but contact between the threaded closure extensions and the discontinuous annular ring prevent further rotation of the threaded closure in the closing direction.

Referring now to FIGS. 33A-33C, a threaded closure 44X and a metallic container 4X of still another embodiment of the present invention are illustrated. The threaded closure 44X includes a number of uni-directional extensions 73 that project from the exterior surface of the threaded closure body 46. The threaded closure 44X is inserted axially into the metallic container 4X before container threads 42 are formed on the metallic container 4X. The metallic container 4X includes a discontinuous annular ring 22X. The annular ring 22X may be pre-formed before the threaded closure 44X is inserted into the bore 12 of the metallic container. Optionally, in one embodiment of the present invention, the discontinuous annular ring 22X may be formed after the threaded closure 44X is inserted into the bore 12. The extensions 73 are adapted to be inwardly flexible radially in response to a direct vertical (or axial) movement of the threaded closure 44X.

Referring now to FIG. 33B, after the container threads 42 are formed, the threaded closure 44X must be rotated to remove the threaded closure 44X from the bore 12 of the metallic container 4X. The extensions 73 are oriented to bend or flex radially inwardly when the threaded closure 44X is rotated in an opening direction 128. As the consumer recloses and/or reseals the metallic container 4X, the threaded closure 44X is rotated in an opposite closing direction 130. After the seal 72X is reestablished between the metallic container 4X and the threaded closure 44X, if the consumer continues to rotate the threaded closure 44X in the closing direction 130, the extensions 73 will contact the interior surface 26 of the discontinuous annular ring 22X. The extensions 73 are oriented to prevent bending or flexing radially outwardly in a manner similar to a ratchet. Accordingly, the extensions 73 comprise a lock and prevent further rotation of the threaded closure 44X in the closing direction 130. As illustrated in FIG. 33C, a gap remains between the lower surface of the extension 66 of the threaded closure 44X and the upper surface 32 of the curl 28 of the metallic container 4X. The gap forms a tamper indicator 82X to visually indicate that the threaded closure 44X has been at least partially removed or unthreaded from the metallic container 4X.

The uni-directional extensions 73 may be positioned either axially above or axially below the closure threads 60. Any number of extensions 73 and discontinuous annular ring 22X segments may be provided as predetermined to prevent rotation of the threaded closure 44X in the closing direction 130 after the metallic container is re-sealed. In one embodiment, the extensions 73 are interconnected to the threaded closure body 46. In another embodiment, the extensions 73 are integrally formed on the threaded closure body 46. Although the threaded closure 44X is illustrated in FIG. 33A with pre-formed threads 60, it will be appreciated that the extensions 73 may be included on a closure with an unthreaded closure body. After the unthreaded closure is inserted into the bore of the unthreaded metallic container, the threads 42, 60 may be simultaneously formed on the metallic container 4X and closure 44X as previously described in conjunction with FIGS. 21 and 23. It will be appreciated by one of skill in the art that the extensions 73 may be adapted to allow a clockwise opening direction 128 and prevent a counter clockwise opening direction 130.

Although various aspects and embodiments of the present invention have been described with respect to metallic containers, the present invention is not limited to use with metallic containers and can be practiced with containers formed of any material and having any desired size or shape. For example, the extensions 73, tamper projections 81, and tamper skirt 85 may be used with containers formed of plastic, glass, paper, or metal. Further, the apparatus 89 of the present invention may be used to form threads or annular rings on a container formed of any material, including without limitation plastic, glass, paper, or metal, and combinations thereof.

The present invention has many benefits compared to prior art bottles and closures. Metallic containers 4 and threaded closures 44 of the present invention are less expensive to produce than bottles or other containers with external threads. The threaded closure 44 of the present invention has increased resistance to pressure induced blowout and leakage than closures that engage external threads of a metallic container. Therefore, a metallic container 4 sealed with a closure 44 of the present invention may have a larger neck diameter 10 for a given internal pressure than is possible with known metallic containers and closures that engage external container threads. Larger diameter necks can provide a faster product dispense rate and a better pour of a product from the container without glugging, resulting in a more enjoyable experience for the consumer. The threaded closures of the present invention may have thread channels to release pressure from within the metallic container while the closure threads are still engaged with the container threads, preventing pressure induced blowout of the closure. In addition, consumers can use the threaded closures 44 to reclose and/or reseal metallic containers 4 decreasing the amount of product lost due to spoilage and spills. The metallic containers 4 of the present invention are also lighter and more durable than glass bottles. Finally, threaded closures 44 of the present invention provide a novel internal chamber 52 that can be sealed and used to store optional contents. In one embodiment, the internal chamber 52 can be used to store a product within the metallic container 4.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. An apparatus to seal a metallic container having a neck portion that is unthreaded with a threaded closure, comprising:

a first tool having a chuck configured to engage the metallic container, the first tool configured to apply a top-load to the threaded closure positioned in an opening of the metallic container, wherein the threaded closure comprises a closure body with an outer surface including closure threads, and wherein the metallic container includes a bottom portion, a sidewall portion, the neck portion that is unthreaded which extends upwardly from the sidewall portion, and the opening positioned opposite to the bottom portion; and a second tool configured to apply a force to an exterior surface of the neck portion of the metallic container to form container threads on the neck portion of the metallic container which have a geometric profile which substantially coincides with the closure threads of the threaded closure.

2. The apparatus of claim 1, wherein the first tool comprises a pressure block.

3. The apparatus of claim 1, wherein the first tool applies the top-load to an extension of the threaded closure, the extension projecting outwardly from the closure body.

4. The apparatus of claim 1, wherein the second tool comprises a thread roller configured to contact the exterior surface of the container neck portion to press the container neck portion against the closure threads.

5. The apparatus of claim 4, wherein the force applied by the thread roller to the exterior surface of the metallic container neck portion is less than about 3 lbs.

6. The apparatus of claim 4, wherein the thread roller is operable to move vertically relative to a longitudinal axis of the metallic container.

7. The apparatus of claim 4, wherein the thread roller is operable to rotate around a vertical axis extending through the thread roller.

8. The apparatus of claim 4, wherein the thread roller is operable to rotate around the exterior surface of the metallic container neck portion.

9. The apparatus of claim 1, further comprising a mandrel operable to be inserted into an open chamber of the closure body.

10. The apparatus of claim 9, wherein the mandrel has a cylindrical exterior surface.

11. The apparatus of claim 10, wherein the mandrel is operable to support the closure body when the force is applied to the exterior surface of the neck portion of the metallic container to form the container threads.

12. The apparatus of claim 10, wherein the mandrel has an exterior diameter that is variable, wherein when the mandrel is inserted into the open chamber of the closure body the mandrel has a first exterior diameter, and wherein after the mandrel is positioned in the open chamber the mandrel expands to a second exterior diameter to contact an interior surface of the open chamber, the second exterior diameter being greater than the first exterior diameter.

13. The apparatus of claim 12, wherein the mandrel comprises a plurality of individual sections operable to move inwardly and outwardly to adjust the exterior diameter of the mandrel.

14. The apparatus of claim 1, wherein the second tool presses the container neck portion into a valley of the closure threads.

15. The apparatus of claim 1, wherein the second tool is configured to form the container threads that include peaks that project inwardly from an interior surface of the neck portion and inwardly oriented valleys on the exterior surface of the neck portion, the valleys corresponding to the peaks.

16. The apparatus of claim 1, wherein a second chuck is operable to press the threaded closure downwardly relative to a longitudinal axis of the metallic container.

17. The apparatus of claim 16, wherein the second chuck is operable to rotate the threaded closure.

18. The apparatus of claim 1, wherein the apparatus is operable to position the closure body in the opening of the metallic container after the metallic container is filled with a beverage.

19. An apparatus to seal a metallic container having a neck portion that is unthreaded with a threaded closure, comprising:

a first tool having a chuck, the first tool configured to apply a top-load to the threaded closure positioned in an opening of the metallic container, wherein the threaded closure comprises a closure body with an outer surface including closure threads, wherein the metallic container includes a bottom portion, a sidewall portion, the neck portion that is unthreaded which extends upwardly from the sidewall portion, and the opening positioned opposite to the bottom portion, wherein the chuck is operable to press the threaded closure downwardly relative to a longitudinal axis of the metallic container, and wherein the chuck is operable to rotate the threaded closure; and a second tool configured to apply a force to an exterior surface of the neck portion of the metallic container to form container threads on the neck portion of the metallic container which have a geometric profile which substantially coincides with the closure threads of the threaded closure.

20. An apparatus to seal a metallic container having a neck portion that is unthreaded with a threaded closure, comprising:

a first tool configured to apply a top-load to the threaded closure positioned in an opening of the metallic container, wherein the threaded closure comprises a closure body with an outer surface including closure threads, and wherein the metallic container includes a bottom portion, a sidewall portion, the neck portion that is unthreaded and which extends upwardly from the sidewall portion, and the opening positioned opposite to the bottom portion;

a second tool configured to apply a force to an exterior surface of the neck portion of the metallic container to form container threads on the neck portion of the metallic container which have a geometric profile which substantially coincides with the closure threads of the threaded closure; and a mandrel operable to be inserted into an open chamber of the closure body, wherein the mandrel has a cylindrical exterior surface, wherein the mandrel has an exterior diameter that is variable, wherein, when the mandrel is inserted into the open chamber of the closure body, the mandrel has a first exterior diameter, and wherein, after the mandrel is positioned in the open chamber, the mandrel expands to a second exterior diameter to contact an interior surface of the open chamber, the second exterior diameter being greater than the first exterior diameter.

* * * * *